US010633224B2

(12) United States Patent
Nguyen

(10) Patent No.: US 10,633,224 B2
(45) Date of Patent: Apr. 28, 2020

(54) CLAMPING DEVICE WITH SINGLE MOVABLE JAW

(71) Applicant: Nhon Hoa Nguyen, Bankstown (AU)

(72) Inventor: Nhon Hoa Nguyen, Bankstown (AU)

( * ) Notice: Subject to any disclaimer, the term of this patent is extended or adjusted under 35 U.S.C. 154(b) by 0 days.

(21) Appl. No.: 16/154,734

(22) Filed: Oct. 9, 2018

(65) Prior Publication Data

US 2019/0106299 A1 Apr. 11, 2019

Related U.S. Application Data

(60) Provisional application No. 62/570,108, filed on Oct. 10, 2017, provisional application No. 62/584,923, filed on Nov. 13, 2017, provisional application No. 62/741,555, filed on Oct. 5, 2018, provisional application No. 62/741,557, filed on Oct. 5, 2018.

(51) Int. Cl.
*B66C 1/48* (2006.01)

(52) U.S. Cl.
CPC ..... *B66C 1/48* (2013.01)

(58) Field of Classification Search
CPC ..... B66C 1/48
USPC ..... 294/81.3, 67.5, 67.3, 110.1
See application file for complete search history.

(56) References Cited

U.S. PATENT DOCUMENTS 3,153,555 A * 10/1964 Kaplan ..... B21C 47/24 294/197
7,490,882 B2 * 2/2009 Nguyen ..... B66C 1/48 269/95
8,328,258 B2 * 12/2012 Kjol ..... B66C 1/58 294/106
9,902,574 B1 * 2/2018 Nguyen ..... B66C 1/48
2006/0197350 A1 * 9/2006 Nguyen ..... B66C 1/442 294/102.1
2006/0202496 A1 * 9/2006 Davis ..... B66C 1/442 294/102.1
2009/0229708 A1 * 9/2009 Quigg ..... A01G 23/003 144/4.1
2010/0066110 A1 * 3/2010 Gillesse ..... B66C 1/48 294/101
2010/0127522 A1 * 5/2010 Probst ..... B66C 1/442 294/104
2014/0028038 A1 * 1/2014 LaValley ..... B66C 1/44 294/81.61

* cited by examiner

*Primary Examiner* — Paul T Chin
(74) *Attorney, Agent, or Firm* — Tue Nguyen

(57) ABSTRACT

A clamping device for lifting and moving objects can include a fixed and rotatable jaw facing a movable and rotatable jaw, which is activated by an arm assembly coupled to a fixed body. The clamping device can include a hand-free mechanism for switching between a clamping action and a jaw opening action for inserting the object. The clamping device can include a guiding mechanism for guiding an object to the space between the jaws, effectively enlarging the jaw opening for ease of clamping on thicker objects.

20 Claims, 36 Drawing Sheets

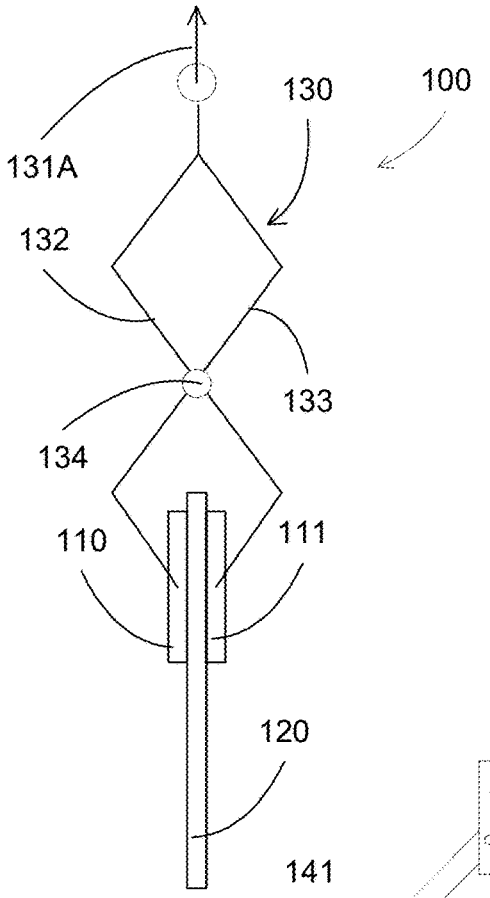
FIG. 1A
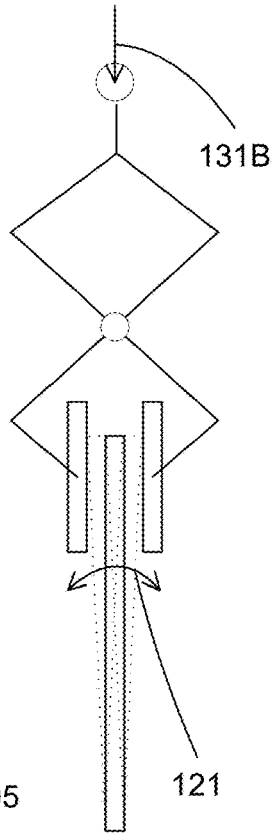
FIG. 1B
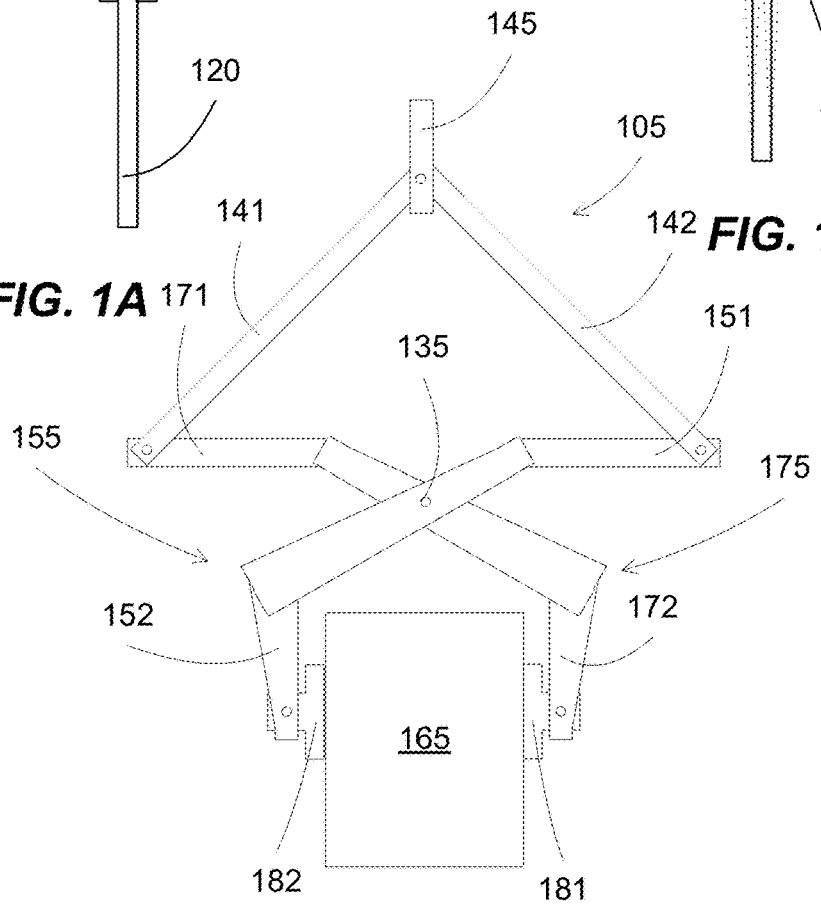
FIG. 1C
FIG. 1 (Prior Art)

Forming a clamping device, wherein the clamping device comprises an arm assembly rotatably coupled to a body of the clamping device, wherein the body comprises a first jaw, wherein the arm assembly comprises a second jaw movable by the rotation of the arm assembly, wherein the rotation of the arm assembly is configured to provide a clamping action of the first and second jaws on an object
500

*FIG. 5A*

Lowering an empty half scissor clamp on an object, wherein the half scissor clamp comprises a first jaw and a second jaw movable by a scissor action of the half scissor clamp
520

↓

Raising the half scissor clamp, wherein the half scissor clamp clamps on the object for lifting the object
530

*FIG. 5B*

Lowering a half scissor clamp carrying an object to a destination, wherein the half scissor clamp comprises a first jaw and a second jaw movable by a scissor action of the half scissor clamp
550

↓

Continuing lowering the half scissor clamp to enlarging the distance between the first and second jaws for releasing the object
560

↓

Raising the half scissor clamp, leaving the object at the destination
570

*FIG. 5C*

Forming a clamping device, wherein the clamping device comprises two or more half scissor mechanisms acting on two opposite elongated jaws
1000

FIG. 10A

Forming a clamping device, wherein the clamping device comprises a body, wherein the body is coupled to a first elongated jaw, wherein the clamping device comprises two or more arm assemblies, wherein each of the arm assemblies is configured to be rotatably coupled to the body, wherein a first end of each arm assemblies is coupled together, wherein a second end of each arm assemblies is coupled to a second elongated jaw, wherein the coupled first ends are movably coupled to body so that when the coupled first ends move, the arm assemblies rotates causing the second elongated to move toward or away from the first elongated jaw
1020

FIG. 10B

Lowering an empty clamping device on an object, wherein the clamping device comprises a first and a second elongated jaws with each elongated jaw operable by two or more clamping actions caused by two or more clamping arm assemblies
1040

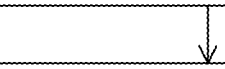

Raising the clamping device, wherein the object is clamped by the elongated jaws with a clamping force distributed over the areas of the elongated jaws
1050

FIG. 10C

Switching states of a locking mechanism of a clamping device by pushing a movable portion of the clamping device against a fixed portion of the clamping device, followed by moving the movable portion away from the fixed portion
1700

FIG. 17A

Disengaging a locking mechanism for lifting and moving an object
1720

FIG. 17B

Engaging a locking mechanism for lifting and moving an empty clamping device
1740

FIG. 17C

Engaging a locking mechanism for lifting and moving an empty clamping device
1760

↓

Receiving an object while disengaging the locking mechanism
1770

↓

Lifting and moving the object
1780

FIG. 17D

Toggling between a movable status and an unmovable status for a component of a clamping mechanism of a clamping device, wherein the toggling process is activated when at least one of the jaws of the clamping device is in a vicinity of an opening distance from the other jaw, wherein in the movable status, the component is configured to allow jaws of the clamping device to be movable toward each other to clamp on an object, wherein in the unmovable status, the component is configured to have the jaws remaining opened
1800

*FIG. 18A*

Moving a component of a clamping mechanism of a clamping device downward, wherein when the component reaches a position, a toggling mechanism is activated to toggle between a movable status and an unmovable status for at least a jaw of the clamping device, wherein in the movable status, the jaw is configured to be movably reachable toward an object disposed between the jaw and another jaw of the clamping device, wherein in the unmovable status, the jaws are configured to remain opened
1820

*FIG. 18B*

Moving a component of a clamping mechanism of a clamping device downward to toggle at least a jaw of the clamping device between movably reachable toward an object disposed between the jaw and another jaw of the clamping device for clamping on the object and remaining opened without clamping on the object
1840

*FIG. 18C*

Forming two slanting surfaces facing each other, and sandwiching and surrounding a contact element, wherein the contact element is configured so that when the contact element moves toward a first slanting surface, the contact element moves along the slanting surface to rotate a first angle, wherein the contact element is configured so that when the contact element moves in an opposite direction toward a second slanting surface, the contact element moves along the slanting surface to rotate a second angle
2200

*FIG. 22A*

Forming a rod having a latchable element at one end and a protruding pin near an opposite end, wherein the rod is surrounded by two rings having slanting surfaces, wherein the rod is disposed so that the protruding pin is located between the slanting surfaces, wherein the slanting surfaces are configured so that the rod rotates when the protruding pin contacts the slanting surfaces
2220

*FIG. 22B*

Forming multiple first slanting surfaces surrounding a rod
Forming multiple second slanting surfaces surrounding the rod and facing and spaced from the first slanting surfaces
Wherein the rod comprises a latchable element at one end,
Wherein the rod comprises a protruding pin near an opposite end,
Wherein the protruding pin is disposed between the first and second slanting surfaces
2240

*FIG. 22C*

Forming two slanting surfaces facing away from each other, and surrounding a contact element, wherein the contact element is configured to sandwich the two slanting surfaces, wherein the contact element is configured so that when the contact element moves toward a first slanting surface, the contact element moves along the slanting surface to rotate a first angle, wherein the contact element is configured so that when the contact element moves in an opposite direction toward a second slanting surface, the contact element moves along the slanting surface to rotate a second angle
2400

*FIG. 24A*

Forming a rod having a latchable element at one end and two protruding pins, wherein the rod is surrounded by a ring having two facing away slanting surfaces, wherein the rod is disposed so that the two slanting surfaces is located between the two protruding pins, wherein the slanting surfaces are configured so that the rod rotates when the protruding pins contacts the slanting surfaces
2420

*FIG. 24B*

Forming multiple first slanting surfaces surrounding a rod
Forming multiple second slanting surfaces surrounding the rod and facing away and spaced from the first slanting surfaces
Wherein the rod comprises a latchable element at one end,
Wherein the rod comprises two protruding pins,
Wherein the first and second slanting surfaces are disposed between the protruding pins
2440

*FIG. 24C*

Forming two slanting surfaces facing a same direction, and sandwiching and surrounding a contact element, wherein the contact element is configured so that when a first slanting surface moves toward the contact element, the contact element moves along the first slanting surface to rotate a first angle, wherein the contact element is configured so that when the first slanting surface retracts, the contact element moves along the second slanting surface to rotate a second angle

2600

*FIG. 26A*

Forming a rod having a latchable element at one end and a protruding pin near an opposite end, wherein the rod is surrounded by two rings having slanting surfaces, wherein the rod is disposed facing the slanting surfaces, wherein the slanting surfaces are configured so that the rod rotates when a slanting surface moves forward to contact the protruding pin or retracts so that the protruding element contacts the other slanting surfaces

2620

*FIG. 26B*

Forming multiple first slanting surfaces surrounding a rod
Forming multiple second slanting surfaces surrounding the rod and facing a same direction and spaced from the first slanting surfaces
Wherein the first slanting surfaces are movable relative to the second slanting surfaces
Wherein the rod comprises a latchable element at one end,
Wherein the rod comprises a protruding pin near an opposite end,
Wherein the protruding pin is disposed facing the first and second slanting surfaces

2640

*FIG. 26C*

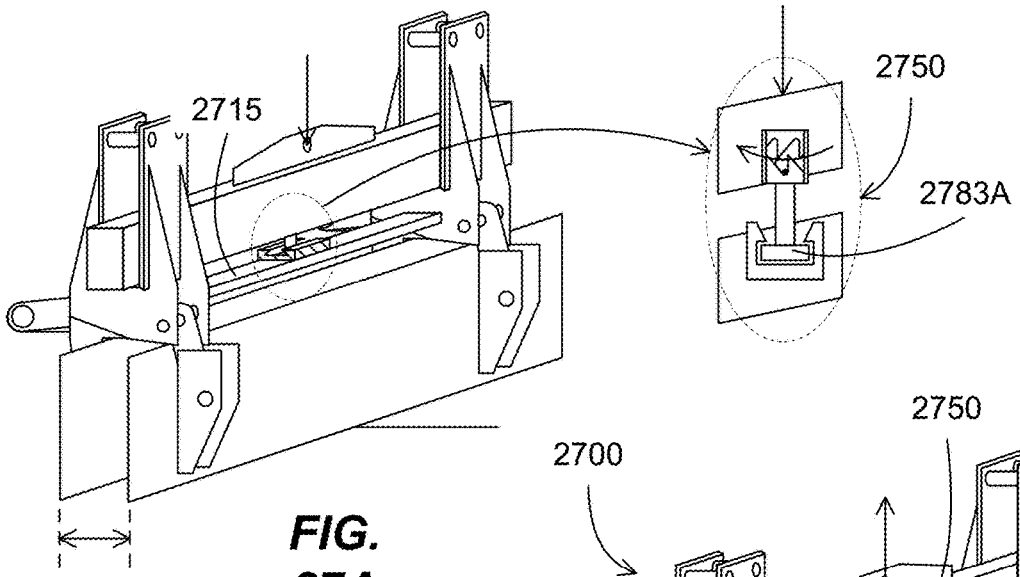
FIG. 27A
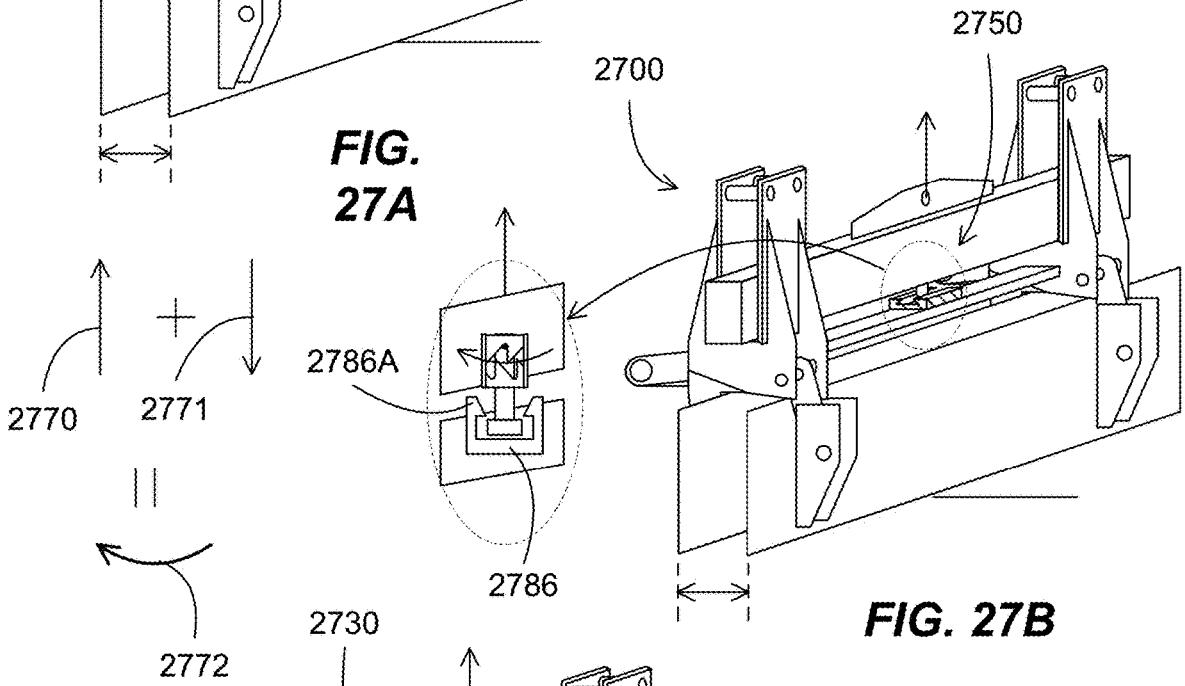
FIG. 27B
FIG. 27D
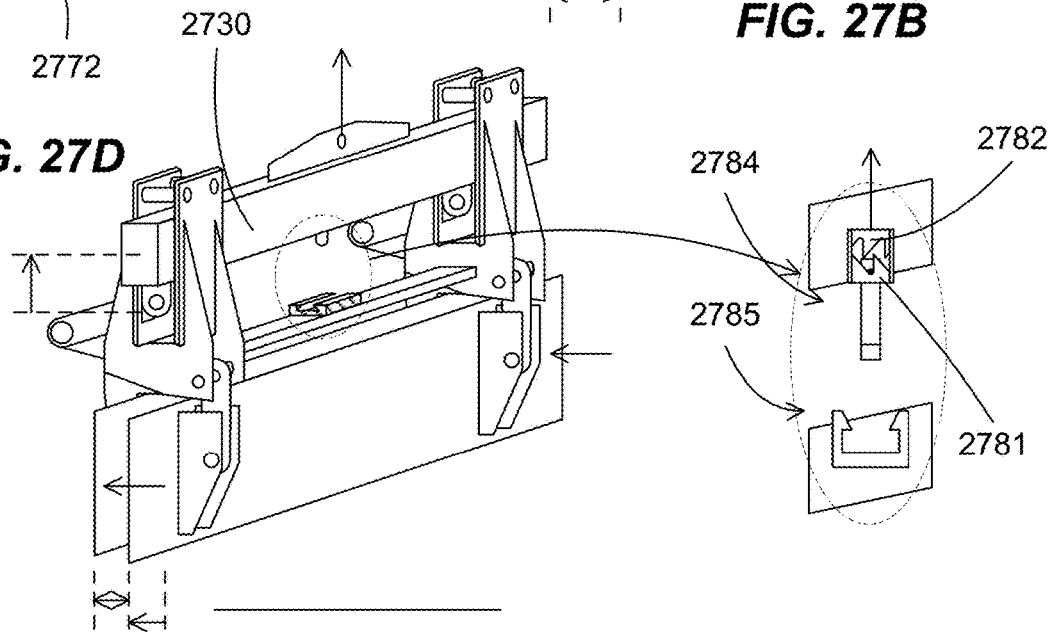
FIG. 27C

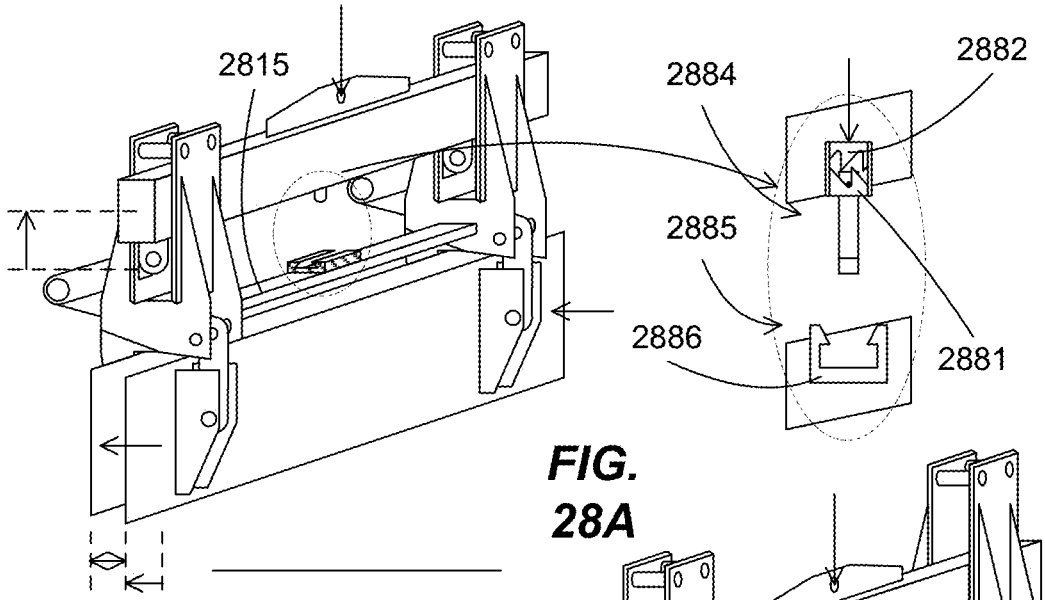
FIG. 28A
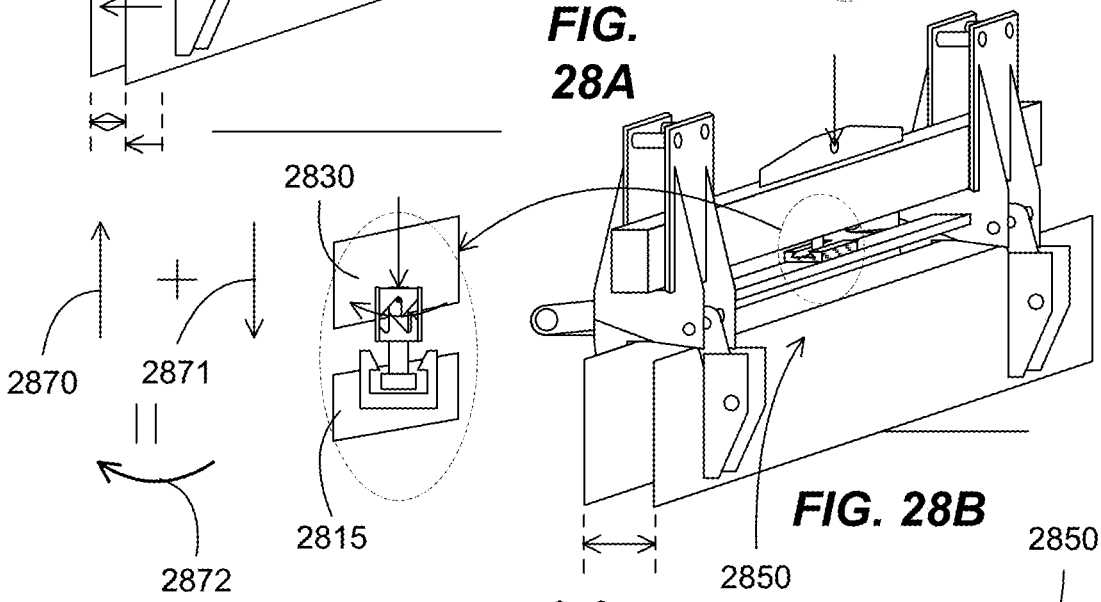
FIG. 28B
FIG. 28D
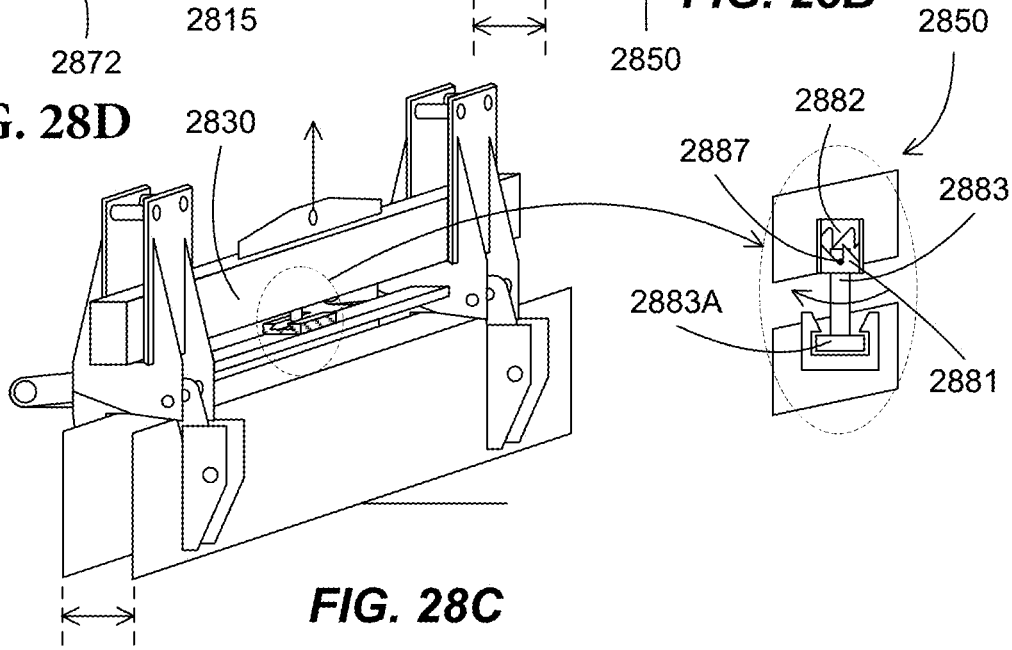
FIG. 28C

CLAMPING DEVICE WITH SINGLE MOVABLE JAW

The present application claims priority from U.S. Provisional Patent Application Ser. No. 62/570,108, filed on Oct. 10, 2017, entitled: "Scissor clamp with single movable jaw", U.S. Provisional Patent Application Ser. No. 62/584,923, filed on Nov. 13, 2017, entitled: "Lifting cart for building construction", U.S. Provisional Patent Application Ser. No. 62/741,555, filed on Oct. 5, 2018, entitled: "Auto lock cable lifter", and U.S. Provisional Patent Application Ser. No. 62/741,557, filed on Oct. 5, 2018, entitled: "Clamping device for joining boards" all of which are incorporated herein by reference.

The present application is related to U.S. Pat. No. 9,902,574 and U.S. application Ser. No. 15/905,010.

The present invention relates to lifting devices. More particularly, it relates to clamping devices for lifting and transferring objects such as metal or ceramic plates.

BACKGROUND

In the heavy industry, large and heavy products can be difficult to handle manually. Thus, a hoist connecting to a clamping device can be used to lift and move heavy objects. An object can be clamped to a clamping device that is coupled to a hoist. The hoist can lift the object to a certain height, and then transfer to a proper location.

The clamping devices can utilize a mechanism that converts the weight of the object into a clamping force, thus the holding force on the object exerted by the clamping devices can be proportional to the weight of the object. A loading and unloading device, such as a crane or a hoist, can be coupled to the clamping device for lifting and transferring the objects.

A prior art clamping device can include a gripping device normally fabricated from structural steel components, that are designed to securely hold and lift construction materials though a scissor movement. The gripping device can use freely rotating pin connections to create a scissor configuration with two scissor arms. A first end of the scissor arms is configured to rotate towards each other in reaction to the opposite second end of the scissor arms being lifted vertically. The first end of the scissor arms rotate inwards and generate a compression force clamping on the object to be lifted. Essentially, the weight of the object is used to generate this clamping action.

Disadvantages of the gripper devices can include large sizes due to the long arms. For example, if the friction coefficient between the holding pads and the object is about 0.2, then a five times the weight of the object is needed to hold the object. In other words, the ratio of the upper arms and the lower arms is also about five to obtain the holding force. Other disadvantages can include multiple moving parts, such as the two arms forming the scissor action, together with operation complexity, especially during the time of loading and loading.

SUMMARY OF THE EMBODIMENTS

In some embodiments, the present invention discloses a clamping device for lifting and moving objects, such as plates like glass plates, or granite plates. The clamping device can have a fixed jaw disposed opposed to a movable jaw caused by a scissor action of the clamping device. The set of clamping jaws with a fixed jaw and a movable jaw can reduce movements of the objects, which can be useful for fragile objects.

The clamping device can include two or more sets of clamping jaws, which can increase a gripping action on the object without increasing clamping pressures on the object. The low clamping pressure can be useful in clamping low friction and fragile objects, such as glass plates.

The clamping device can include a hand-free mechanism for switching between a clamping action and a jaw opening action for inserting the object. The hand-free mechanism can allow a single operator to perform the clamping action for lifting and moving the object.

The clamping device can include a guiding mechanism for moving the jaw sets to the object. The jaw sets can have an opening for the object to enter. The guiding mechanism can assist the object, e.g., guiding the object to enter the openings between the jaws of the jaw sets.

The clamping device can include a contact mechanism to visually detecting the object, for example, when the clamping device moves toward the object for clamping. The contact mechanism can be particular useful for transparent objects, such as glass plates, which can be difficult for the operator to see the edge of the plates. The clamping device can include roller feet for rolling the clamping device, for example, for moving between places on the ground.

BRIEF DESCRIPTION OF THE DRAWINGS

FIGS. 1A-1C illustrate configurations for a clamping device according to some embodiments.

FIGS. 5A-5C illustrate flow charts for clamping device configurations and actions according to some embodiments.

FIGS. 10A-10C illustrate flow charts for forming and operating a clamping device according to some embodiments.

FIGS. 17A-17D illustrate flow charts for a locking mechanism according to some embodiments.

FIGS. 18A-18C illustrate flow charts for operating a locking mechanism according to some embodiments.

FIGS. 22A-22C illustrate flow charts for forming a locking mechanism according to some embodiments.

FIGS. 24A-24C illustrate flow charts for forming a locking mechanism according to some embodiments.

FIGS. 26A-26C illustrate flow charts for forming a locking mechanism according to some embodiments.

FIGS. 27A-27D illustrate a clamping device having a toggling locking mechanism according to some embodiments.

FIGS. 28A-28D illustrate another toggling configuration of the locking mechanism according to some embodiments.

DETAILED DESCRIPTION OF THE EMBODIMENTS

Figure 2A:
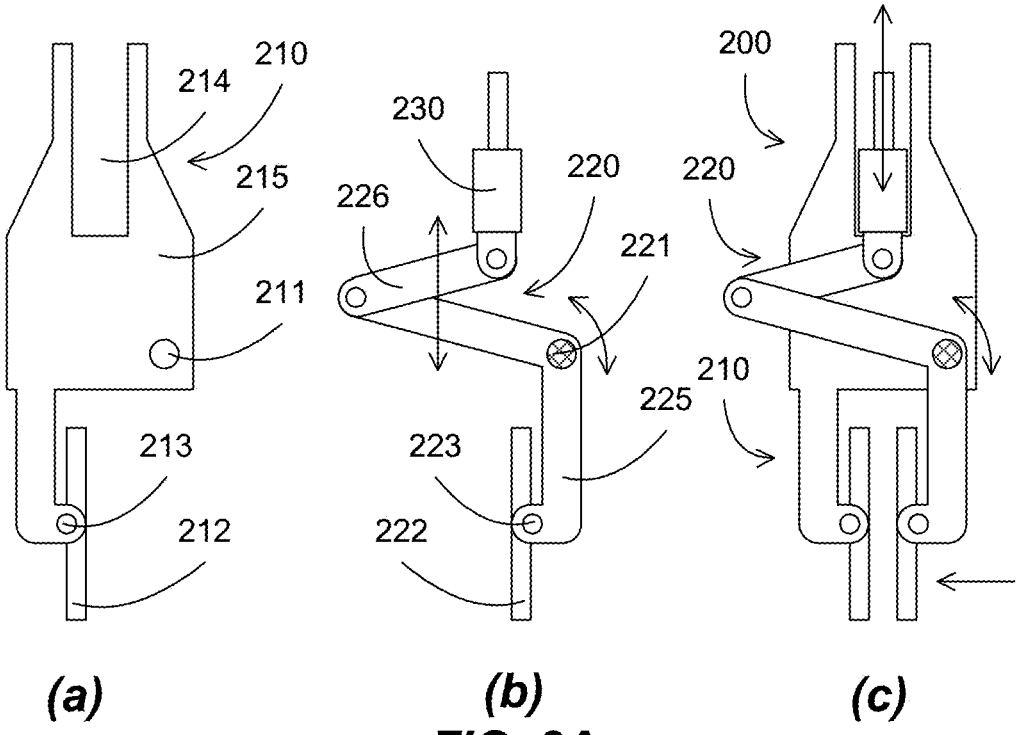
FIGS. 2A-2B illustrate a schematic configuration of a clamping device employing a half clamping mechanism according to some embodiments.

Clamping devices have been used with cables and a hoist to lift and move heavy objects. These clamping devices typically include two shank members which are pivotably coupled in a middle portion of the shank members. When the end portions of the shank members are lifted up, the opposite end portions can press against an object, for example, to lift and move the object.

FIGS. 1A-1C illustrate configurations for a clamping device according to some embodiments. In FIGS. 1A and 1B, a typical clamping device 100 is shown, including a clamping mechanism 130, having two shank members 132 and 133, which are pivotally coupled together at a pivotal axis 134. Thus when the shank members are pulled up 131A, the scissor action can cause the two jaws 110 and 111, which are coupled to the opposite ends of the two shank members, to press onto the object 120.

When the shank members 132 and 133 are released, for example, the shank members are pushed down 131B, the two jaws are open, and also releasing the grip on the object 120. If the object is rested on a support, the object can be disposed at the middle of the two jaws, thus can fall 121 toward either jaw. The fall can cause damage to the object, for example, if the object is thin and fragile, such as a glass plate or a granite plate.

In FIG. 1C, a clamping device 105 can include two scissor arms 175 and 155, which can freely rotate about a pivot point 135. The scissor arms 175 and 155 can include upper arms 171 and 151, together with lower arms 172 and 152, respectively, connected through the freely rotating pivot 135.

The upper arms 171 and 151 can be coupled to pulling elements 141 and 142, respectively. The coupling between the upper arms and the pulling elements can include freely rotating pin connections, e.g., the pulling element 141/142 can be rotated relative to the upper arm 171/151. The pulling elements 141 and 142 can be coupled to a lift 145, such as a hoist. The coupling between the pulling elements and the lift can include freely rotating pin connections, e.g., the pulling elements 141 and 142 can be rotated relative to the lift 145.

The lower arms 172 and 152 can be coupled to holding pads 181 and 182, respectively. The coupling between the lower arms and the holding pads can include freely rotating pin connections, e.g., the holding pads 181/182 can be rotated relative to the lower arm 172/152.

In operation, an object 165 is placed between the holding pads 181 and 182. The lift 145 is pulled up, which pulls on the pulling elements 141 and 142. The pulling elements 141 and 142 can in turn pull on the upper arms 171 and 151. The scissor movement between the upper arms 171/151 and the lower arms 172/152 around the pivot point 135 can turn the pulling action on the upper arm 171/151 into a pressing action of the lower arm 172/152, which presses on the object 165 through the holding pads 181 and 182.

In some embodiments, the present invention discloses a clamping device having a half clamping mechanism, e.g., there can be one scissor arm, configured to clamp on a fixed body. For example, a first jaw can be coupled to a body. A second jaw can be coupled to an end of a scissor arm, with the scissor arm rotatable with respect to the body. Thus when the scissor arm rotates, the second jaw moves toward or away from the first jaw, clamping or releasing an object disposed between the two jaws.

In the half clamping mechanism, the first jaw can be translational stationary, e.g., not participating in the clamping action through a translational movement, but can be rotatable around a fixed axis. The first jaw is coupled to the body, thus the first jaw can move together with the body, e.g., when the body moves. Further, the first jaw can rotate relative to the body, so that the clamping surface of the first jaw can make contact with a surface of an object that the clamping device is operated on. Thus, in some embodiments, the term "fixed jaw" or "stationary jaw", or "translational stationary jaw" is constructed to mean that the jaw does not participate in the clamping action, such as not moving toward the object for clamping on the object, but can rotating around a fixed axis to ensure that the jaw can have a good contact with the object.

In the half clamping mechanism, the second jaw is coupled to an end of an arm assembly that is rotatably coupled to the body of the clamping device. Thus, the second jaw moves toward the first jaw for clamping on the object when the other end of the arm assembly moves, for example, by being pulled up for lifting the clamping device. In contrast to a clamping mechanism in which two jaws are coupled to two rotating arm assemblies, in the half clamping mechanism, one jaw is fixedly coupled to the body while the other jaw is coupled to a rotating arm assembly.

In some embodiments, the term "an end of an arm assembly" can mean a vicinity of the extreme end of the arm assembly, such as anywhere passing the mid point of the arm assembly. For example, a jaw coupled to an end of the arm assembly can mean that the jaw is coupled to the arm assembly at a location near an extreme end of the arm assembly.

In the half clamping mechanism, a first jaw is translational stationary, e.g., rotatable, and a second jaw is movable. Thus the single movable jaw caused by the scissor action of the half clamping device does not disturb the object when the object is released, which can reduce potential damages to thin and fragile plates when being moved to different locations.

Figure 2B:
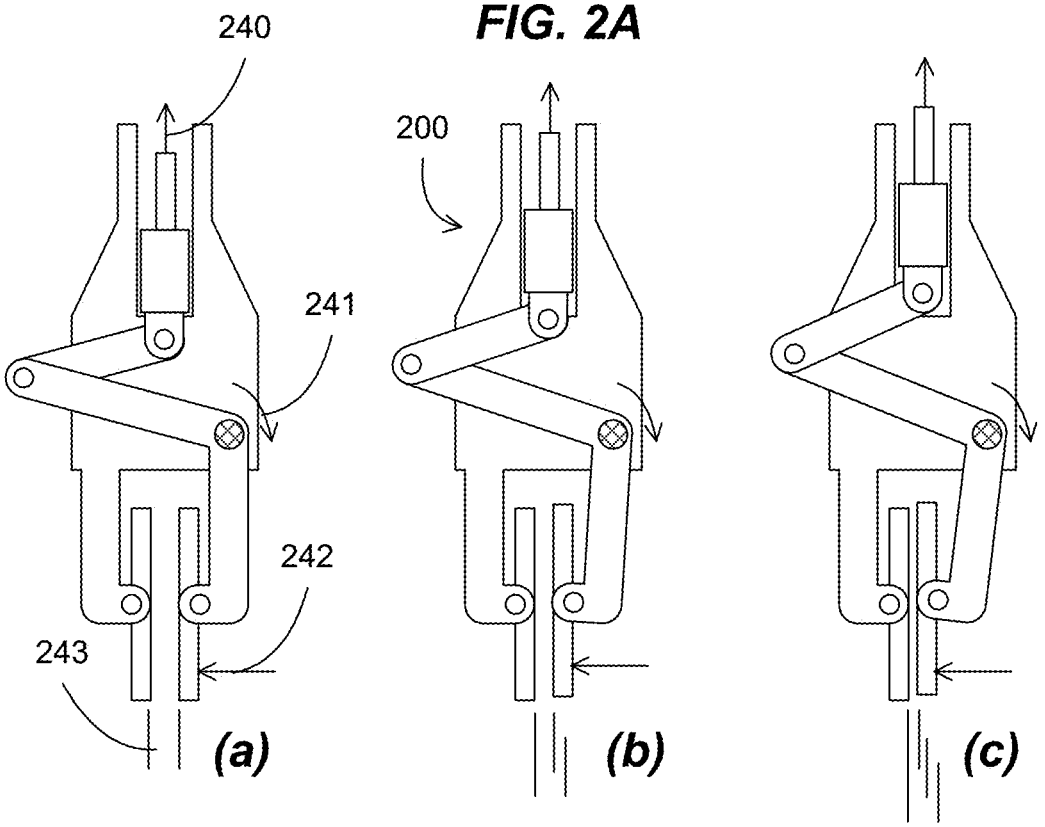

FIGS. 2A-2B illustrate a schematic configuration of a clamping device employing a half clamping mechanism according to some embodiments. FIG. 2A(a) shows a body 210 of a clamping device 200. The body 210 can include a first jaw 212 coupled to a body element 215. The first jaw can be rotatably coupled to the body element, for example, through a rotatable joint 213. The body element can include a pivot axis 211, which can be used to couple to a rotating arm assembly. The body element can include a linear guide 214, which can be used to couple to a moving element of the arm assembly.

FIG. 2A(b) shows a rotating arm assembly 220 of the clamping device 200. The rotating arm assembly can include a pivot joint 221, which can be coupled to the pivot axis 211 of the body, so that the rotating arm assembly can be rotated relative to the body. A second jaw 222 can be coupled to an end of the arm assembly 220. The second jaw can be rotatably coupled to the arm assembly, for example, through a rotatable joint 223.

The arm assembly 220 can include one or more arm rotatably coupled together. For example, the arm assembly 220 can include a first arm segment 225, which can be coupled to the second jaw at one end, and can be rotatably coupled to the pivot axis of the body. The arm assembly 220 can include a second arm segment 226, which can be rotatably coupled to the first arm segment 225 at the opposite end of the first arm segment. The arm assembly 220 can include a third arm segment 230, which can be rotatably coupled to the second arm segment 226. The third arm segment 230 can include a mating element to the linear guide 214 of the body, so that the third arm segment 230 can be constrained to move in one direction, for example, the vertical direction for lifting and lowering the clamping device.

FIG. 2A(c) shows the clamping device 200, including the body 210 and the arm assembly 220, which is rotatably coupled to the body at the pivot point or axis, and which is linearly coupled to the body at the linear guide. The coupling of the arm assembly to the body can be configured so that when the arm assembly moves in the linear guide, the arm assembly rotates around the pivot, which then moves the second jaw toward or away from the first jaw.

FIGS. 2B(a)-(c) show a lifting operation of the clamping device 200. A force 240 can be applied to the arm assembly, for example, to the third segment of the arm assembly that is constrained to move in the linear guide. Due to the applied force, the arm assembly can rotate 241 around the pivot, causing the jaw coupled to the end of the arm assembly to move 242 toward the other jaw. Thus a force acting on the clamping device to pull on the clamping device can cause a distance 243 between the jaws to reduce, which can clamp on an object disposed between the jaws.

Similarly, when the applied force is downward, e.g., the clamping device is resting on a support such as on the ground or on an object, and there is no pulling force on the arm assembly, the third segment can go down, which can rotate the first arm segment to move the jaw coupled to the end of the arm assembly away from the other jaw coupled to the body.

Figure 3A:
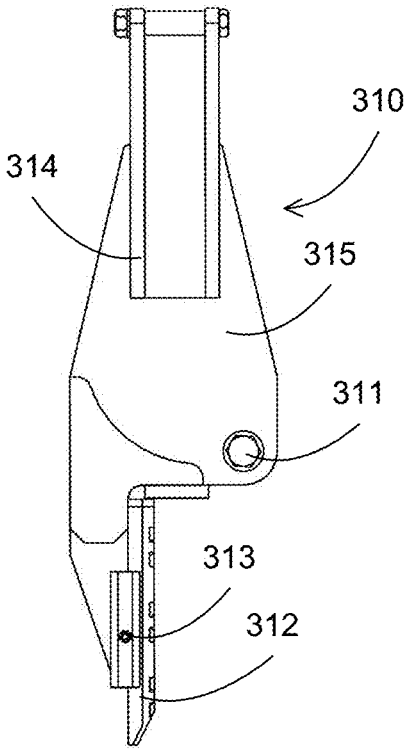
FIGS. 3A-3C illustrate a clamping device according to some embodiments.
Figure 3B:
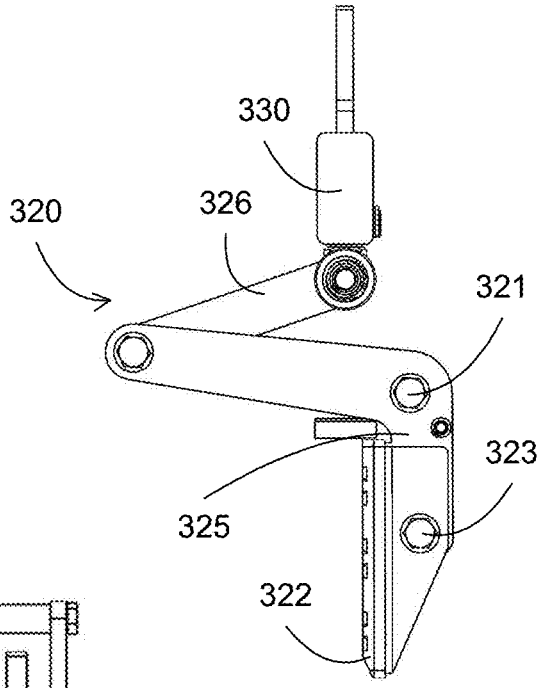
Figure 3C:
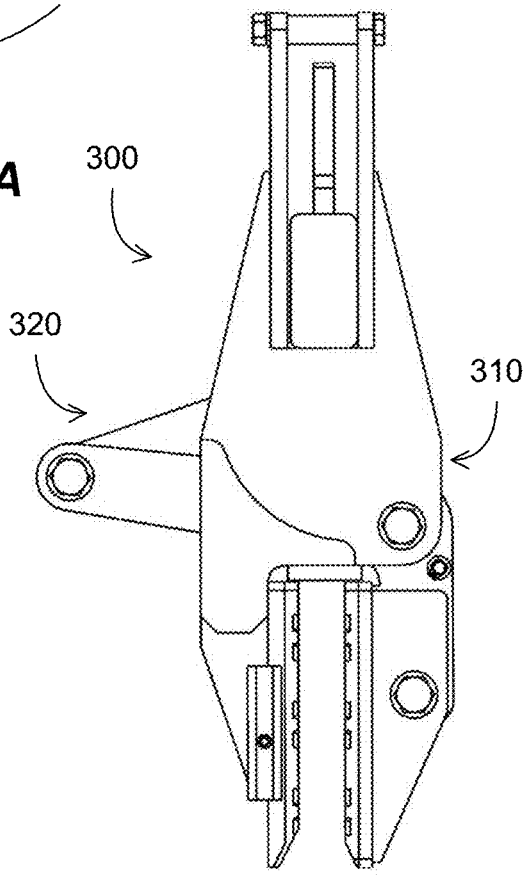

FIGS. 3A-3C illustrate a clamping device according to some embodiments. The clamping device 300 can include a body 310 coupled with an arm assembly 320. The body 310 can include a body element 315. The body 310 can include a first jaw 312, which can be rotatably coupled to the body element 315, for example, through a rotatable joint 313. The body 310 can include a pivot axis 311 on the body element 315, which can be configured to accept a portion of an arm assembly, such as an arm segment 325 of an arm assembly 320. The body 310 can include a linear guide 314 on the body element 315, which can be configured to accept another portion of the arm assembly 320, such as an arm segment 330 of the arm assembly 320. The linear guide can allow a vertical movement, for example, of an arm segment such as arm segment 330, disposed in the linear guide.

The arm assembly 320 can include multiple arm segments, such as arm segments 325, 326, and 330, which can be rotatably coupled to each other. The arm segments can be straight arm segments, such as arm segment 326. The arm segments can be curved arm segments, or arm segments having multiple straight or curved segments, such as arm segment 325.

The arm assembly 320 can include a second jaw 322, which can be rotatably coupled to the arm segment 325, for example, through a rotatable joint 323. The arm assembly 320 can include an arm segment 325, which can include a pivot joint 312, with the pivot joint configured to be mated with the pivot axis 311. Thus the arm segment 315 can rotate relative to the body 310, around the pivot axis 311.

The arm assembly 320 can include an arm segment 330, which can be called a pulling element for its functionality of pulling the clamping device, and which can be configured to be mated with the linear guide on the body 310. Thus, the arm segment 330 can be constrained to move along the linear guide 314. The arm assembly, e.g., the arm segments and their connections, can be configured so that when the arm segment 330 moves within the linear guide, e.g., moving up and down, the arm segment 250 rotates around the pivot axis to move the second jaw toward (when the arm segment 330 moves up the linear guide) or away from (when the arm segment 330 moves down the linear guide) the first jaw.

Thus, when the arm segment 330 moves up, for example, to lift up the clamping device, the second jaw moves toward the first jaw for narrowing a gap with an object disposed between the jaws, and then for clamping on the object. The weight of the object can be converted to the clamping force, thus the clamping device can securely clamp on the object for transferring to different locations.

When the arm segment 330 moves down, for example, when the clamping device reaches the destination and has lowered the object so that the object touches the ground or a support, the second jaw moves away from the first jaw to release the grip on the object. The object then can be removed from the clamping device, and the empty clamping device can be lifted up to pick up another object.

Figure 4A:
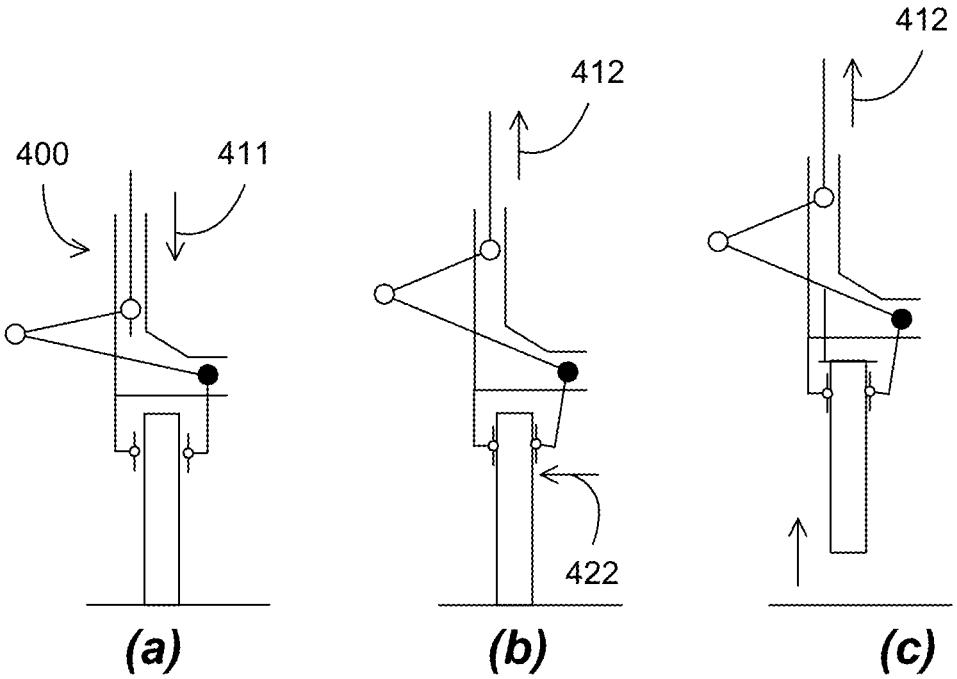
FIGS. 4A-4B illustrate processes for operating a clamping device according to some embodiments.
Figure 4B:
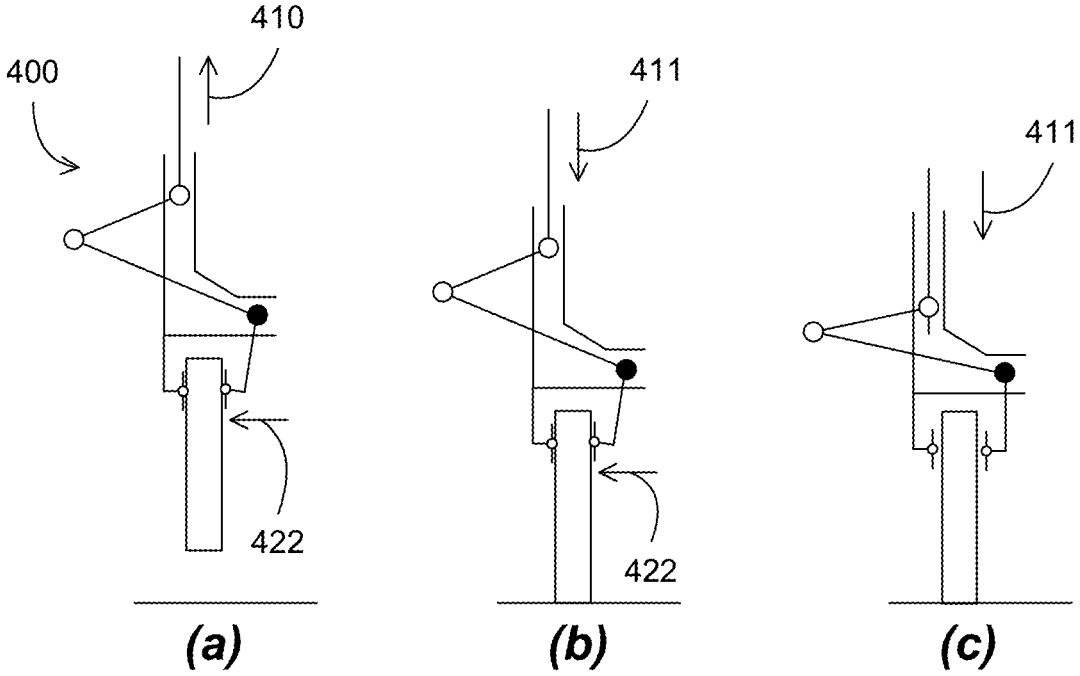

FIGS. 4A-4B illustrate processes for operating a clamping device according to some embodiments. FIGS. 4A(a)-4A(d) show a process for an empty clamping device to pick an object. FIGS. 4B(a)-4B(d) show a process for a clamping device clamping on an object to release the object at a destination.

In FIG. 4A(a), a clamping device 400 is moved to be positioned on the object. The clamping device can be lowered 411 to contact the object. An arm segment of the arm assembly, e.g., the pulling element, can be further lowered, e.g., relative to the body of the clamping device, to enlarge the space between the jaws to accommodate the object. The object can be disposed between the jaws.

In FIG. 4A(b), the pulling element is lifted up 412. The arm assembly can be activated, e.g., the jaws move toward each other for clamping 422 on the object.

In FIG. 4A(c), the lifting of the pulling element will also lift the object after the jaws clamp on the object. The clamping device can lift and move the clamped object to a destination.

In FIG. 4B(a), the clamping device 400 is lifted up 410 and moved with the jaws clamped 422 on the object to secure the object to the clamping device.

In FIG. 4B(b), the clamping device is moved to a destination for dropping the object. The clamping device can be lowered 411 until the object touches the ground.

In FIG. 4B(c), the pulling element can be further lowered relative to the body of the clamping device, since the body of the clamping device is constrained by the object. The lowering of the pulling element can enlarge the distance between the jaws, e.g., increasing the separation between the jaws. The object can be removed from the clamping device.

FIGS. 5A-5C illustrate flow charts for clamping device configurations and actions according to some embodiments.

In FIG. 5A, operation 500 forms a clamping device. The clamping device can include an arm assembly rotatably coupled to a body of the clamping device. The body can include a first jaw. The arm assembly can include a second jaw movable by the rotation of the arm assembly. The rotation of the arm assembly can be configured to provide a clamping action of the first and second jaws on an object. The arm assembly can also be coupled to the body to provide a pulling action on the clamping device. The pulling action can be coupled to the rotation, thus the pulling action, or the release of the pulling action, can cause the arm assembly to rotate, and the second jaw moves relative to the first jaw.

In FIG. 5B, operation 520 lowers an empty half clamping device on an object. The half clamping device can include a first jaw and a second jaw movable by a scissor action of the half clamping device. Operation 530 raises the half clamping device. The half clamping device clamps on the object for lifting the object.

In FIG. 5C, operation 550 lowers a half clamping device carrying an object to a destination, wherein the half clamping device comprises a first jaw and a second jaw movable by a scissor action of the half clamping device. Operation 560 continues lowering the half clamping device to enlarging the distance between the first and second jaws for releasing the object. Operation 570 raises the half clamping device, leaving the object at the destination.

In some embodiments, the clamping device can be extended to include more than one set of clamp jaws, e.g., clamping the object at more than one location. Clamping the object at multiple locations can increase a total gripping force on the object for securing the object during lifting and moving. Clamping the object at multiple locations can maintain a low absolute pressure value, e.g., does not generate a local high pressure point, since the clamping forces are spread into multiple locations. The clamping device can be used for fragile objects, e.g., objects that cannot sustain high pressure gripping such as glass plates.

The clamp jaw set, e.g., two jaws actuated by a clamping mechanism (including a one-shank clamping mechanism), can include a pulling component that can be pulled for gripping the object. A connecting component, such as a bar, can link the pulling components of multiple clamp sets. Thus, by pulling on the connecting element, multiple clamp sets can be actuated together to grip the object at multiple locations.

Figure 6A:
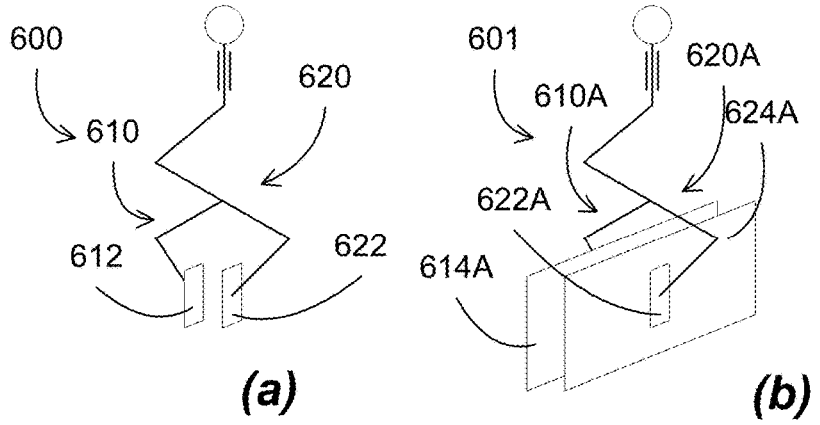
FIGS. 6A-6C illustrate scalability configurations for the clamping device according to some embodiments.
Figure 6B:
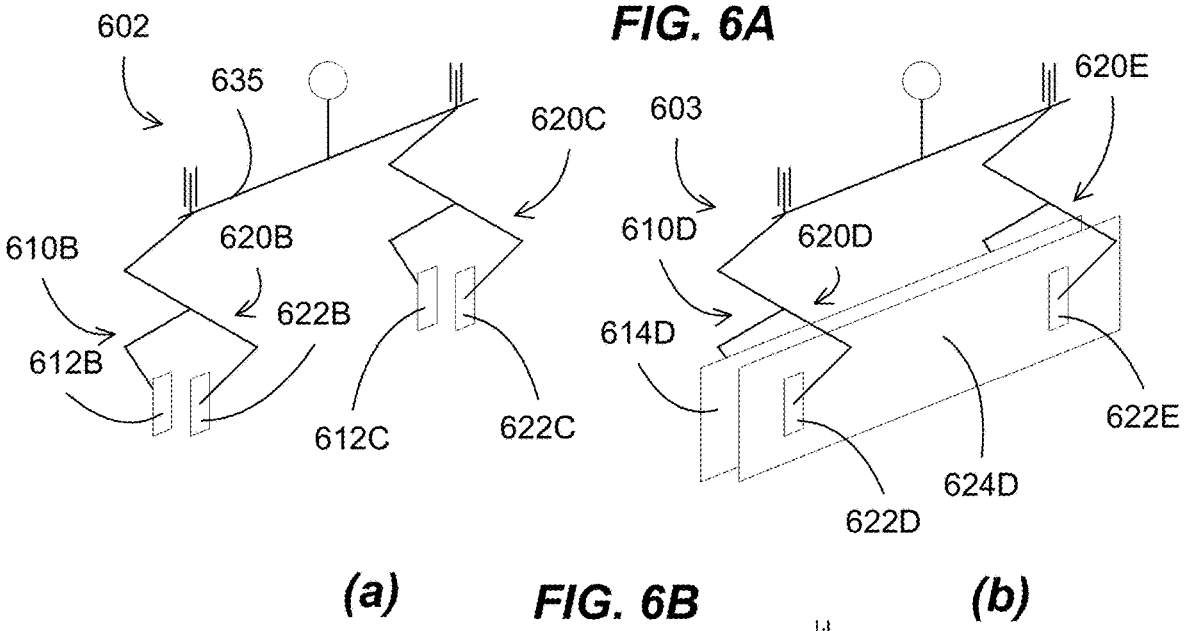
Figure 6C:
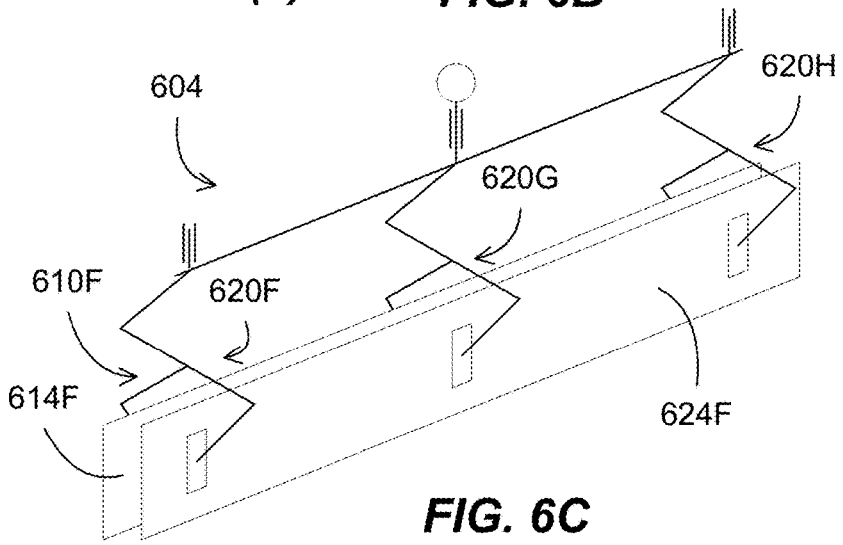

FIGS. 6A-6C illustrate scalability configurations for the clamping device according to some embodiments. In FIG. 6A(a), a clamping device 600 can include a half clamping mechanism, e.g., an arm assembly 620, for actuating a movable jaw 622 while keeping the opposite jaw 612 translational stationary. The stationary jaw 612 can be coupled to a body 610 of the clamping device.

In FIG. 6A(b), a clamping device 601 can include a half clamping mechanism 620A, e.g., an arm assembly, for actuating a movable plate 622A while keeping the opposite plate translational stationary. The stationary plate can be coupled to a body 610A of the clamping device. The plates can be coupled to elongated jaws 612A and 614A, respectively, for example, to increase the gripping area and to reduce the pressure exerted on the object. The elongated jaws are desirable to be large, to generate gripping forces at larger areas while reducing the pressure. The elongated jaws cannot be too large, since the forces exerted on the jaws might not reach the far edges of the plates. Other elements of the clamping device can be included, such as a pulling element for pulling on the clamping mechanism, and a guiding mechanism to guide the movements of the clamping mechanism.

In FIG. 6B(a), a clamping device 602 can include two half clamping mechanisms 620B and 620C for actuating two sets of clamp jaws 612B/622B and 612C/622C. A connecting element, such as a bar 635, can be used to link the pulling elements of the clamping mechanisms, so that when the bar 635 is pulled up, all the clamping mechanisms are actuated to clamp on the object. The jaws 612B and 612C can be coupled to a body 610B, for example, to keep the jaws translational stationary.

In FIG. 6B(b), a clamping device 603 can include two half clamping mechanisms 620D and 620E for actuating two sets of clamp plates 612D/622D and 612E/622E. A connecting element can be used to link the pulling elements of the clamping mechanisms, so that when the connecting element is pulled up, all the clamping mechanisms are actuated to clamp on the object. The plate 612D and 612E can be coupled to a body 610D, for example, to keep the plates translational stationary.

In some embodiments, there can be elongated integrated jaws, e.g., one integrated jaw for all movable plates and one integrated jaw for all fixed plates. For example, a large elongated jaw 614D can be used to couple to the fixed plates in a same side. A large elongated jaw 624D can be used to couple to the movable plates 614D and 624E in a same side. The jaws can be much larger as compared to the individual plates in the clamping device. The arm assemblies 620D and 620E can be separated at a distance to effectively provide a uniform pressure on the elongated jaws. Thus the elongated integrated jaws can increase a gripping action on the object with low pressure gripping actions.

In FIG. 6C, a clamping device 604 can be scaled up for three clamping mechanisms, e.g., three arm assemblies 620F, 620G, and 620H, coupled to a body 610F. Elongated integrated jaws 614F and 624F can link all movable jaws and all fixed jaws.

Figure 7A:
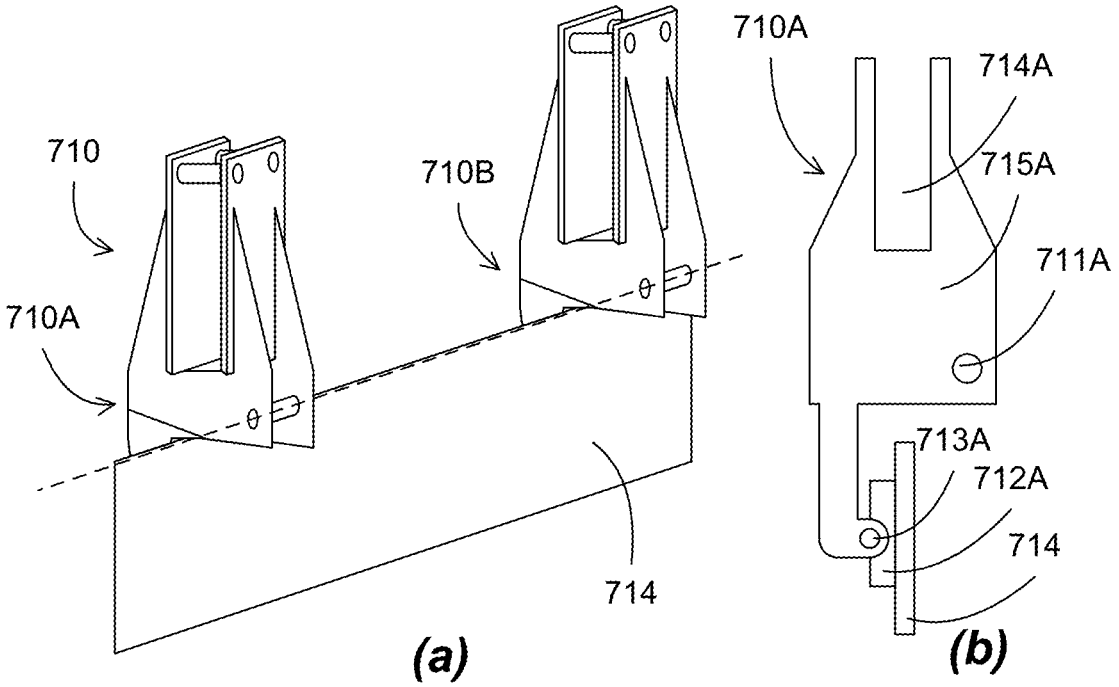
FIGS. 7A-7B illustrate a clamping device having two arm assemblies according to some embodiments.
Figure 7B:
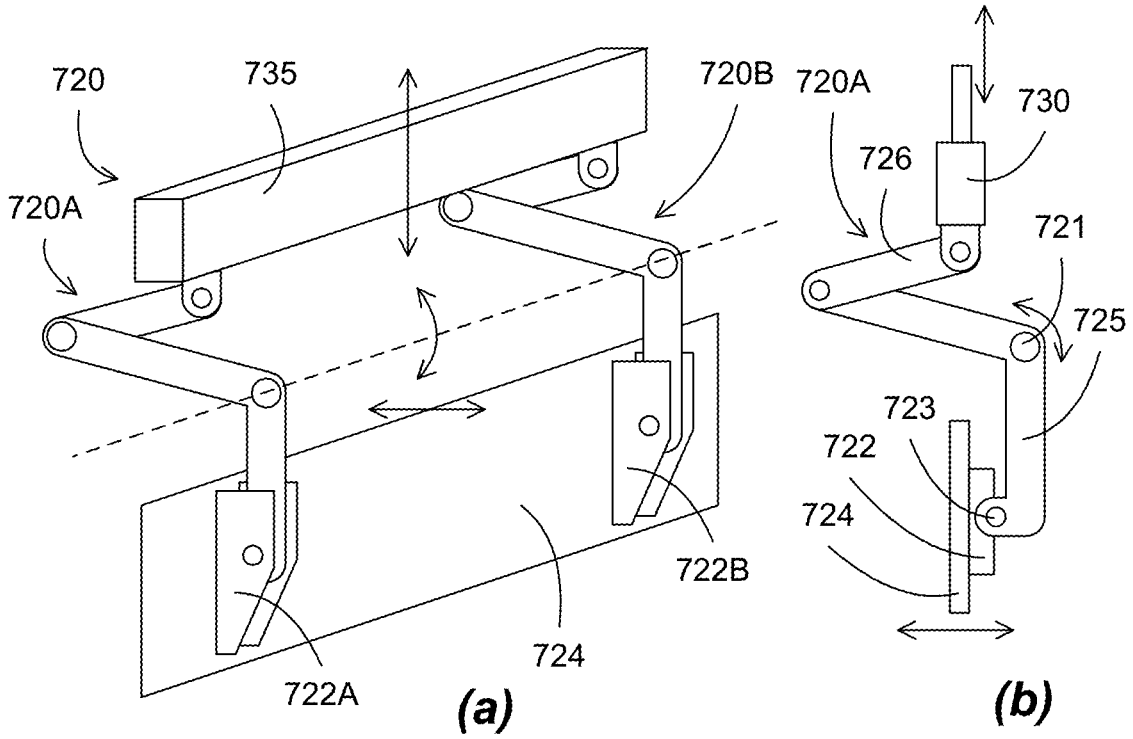

FIGS. 7A-7B illustrate a clamping device having two arm assemblies according to some embodiments. FIG. 7A(a) shows a perspective view of a body 710 of the clamping device. FIG. 7A(b) shows a side view of the body 710. FIG. 7B(a) shows a perspective view of two arm assemblies 720 of the clamping device coupling together. FIG. 7B(b) shows a side view of the two arm assemblies 720.

The body 710 can include two portions 710A and 710B of the clamping mechanisms, which are coupled together to an elongated jaw 714. Each portion can be coupled to an arm assembly, such as portion 710 can be coupled to arm assembly 720A to form a clamping component, e.g., the arm assembly 720A can move to press the jaw 724 on the jaw 714. The multiple portions 710A and 710B can be coupled to arm assemblies 720A and 720B, respectively, to form a clamping mechanism having two clamping components, with both clamping components acting on elongated jaws 714 and 724 for clamping on an object.

A portion 710A can include a plate 715A, which is coupled to a plate 712A and the elongated jaw 714, for example, through a rotatable joint 713A. The portion 710 can include a pivot axis 711A for rotatably coupled to a portion of an arm assembly, such as arm assembly 720A. The portion 710 can include a linear guide 714A for linearly coupled to another portion of the arm assembly 720A.

The arm assemblies 720 can include a first arm assembly 720A and a second arm assembly 720B. One ends 722A and 722B of the arm assemblies 720A and 720B can be coupled to an elongated jaw 724. Opposite ends of the arm assemblies 720A and 720B can be coupled together, such as coupled to a coupler 735A, e.g., a bar adapted to mate with the linear guide 711A of the body.

An arm assembly 720A can include arm segments 725, 726 and 730. The arm segment 725 can be coupled to a plate 722 and the elongated jaw 724, for example, through a rotatable joint 723. The arm segment 725 can be coupled to the body at a rotatable joint 721. The arm segment 730 can be coupled to the linear guide to allow the segment to move up and down.

Figure 8A:
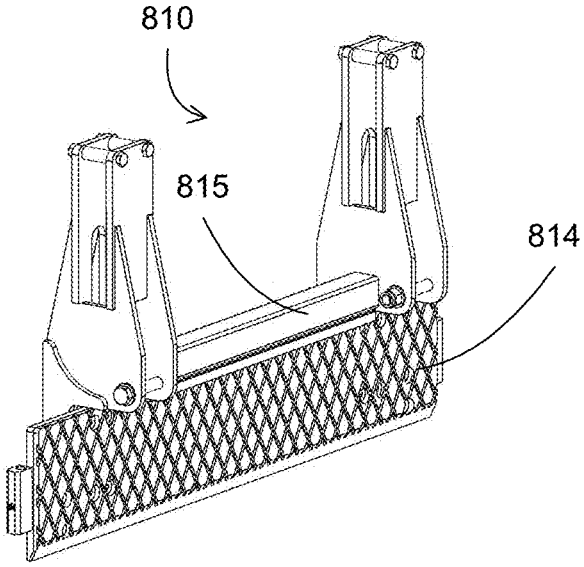
FIGS. 8A-8C illustrate a clamping device configuration according to some embodiments.
Figure 8B:
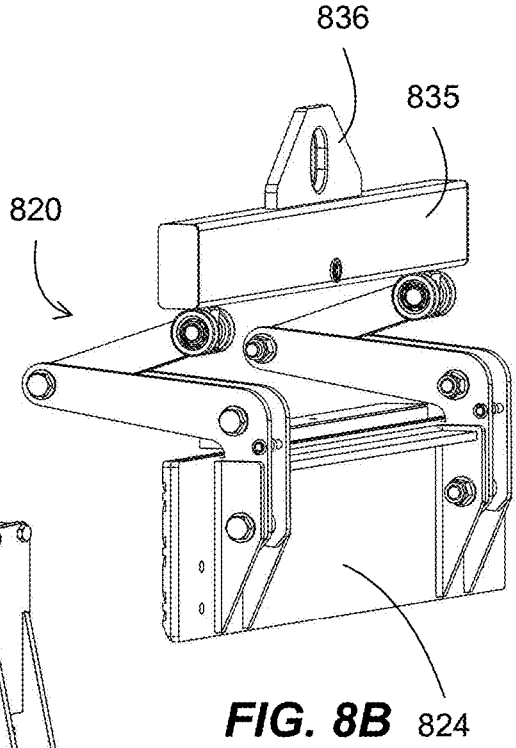
Figure 8C:
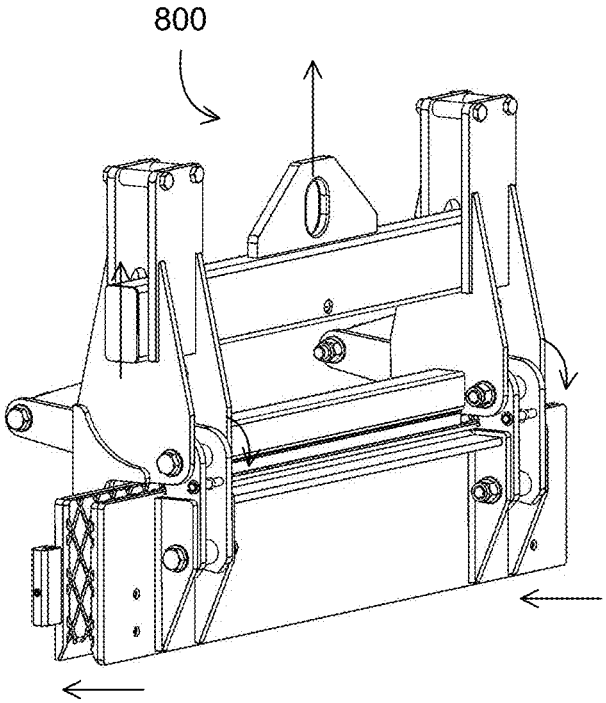

FIGS. 8A-8C illustrate a clamping device configuration according to some embodiments. A clamping device 800 can include a body 810, which can include an elongated jaw 814. A bar 815 can be used to strengthen the body. The clamping device can include arm assemblies 820, which can be coupled to an elongated jaw 824. A coupler 835 can be used to couple the arm assemblies 820, together with a connectable element 836 for moving the arm assemblies. When the coupler is pulled up, the clamping mechanism can be activated to move the elongated jaw 824 toward the translational stationary elongated jaw 814.

Figure 9A:
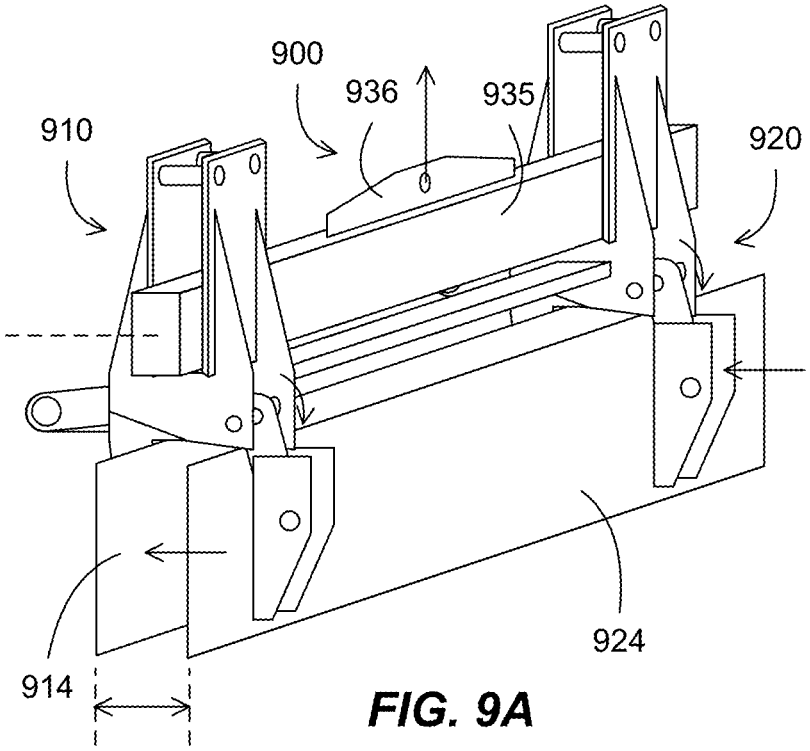
FIGS. 9A-9B illustrate an operation of a clamping device according to some embodiments.
Figure 9B:
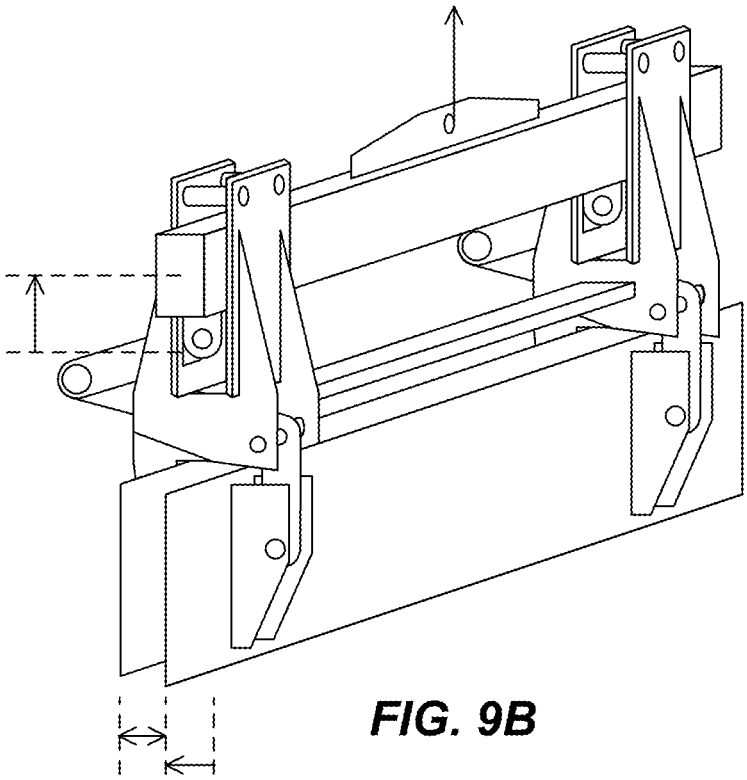

FIGS. 9A-9B illustrate an operation of a clamping device according to some embodiments. A clamping device 900 can include a body 910 and arm assemblies 920, which are coupled to opposite elongated jaws 914 and 924, respectively. The arm assemblies can be rotatably coupled to the body. The arm assemblies can also be linearly coupled to the body.

When the arm assemblies are pulled up, for example, by pulling on a connecting element 936 coupled to a coupler 935 that are coupled to the arm assemblies, the elongated jaw 924 can move toward the opposite elongated jaw 914.

FIGS. 10A-10C illustrate flow charts for forming and operating a clamping device according to some embodiments. In FIG. 10A, operation 1000 forms a clamping device. The clamping device can include two or more half clamping mechanisms acting on two opposite elongated jaws.

In FIG. 10B, operation 1020 forms a clamping device. The clamping device can include a body. The body can be coupled to a first elongated jaw. The clamping device can include two or more arm assemblies. Each of the arm assemblies can be configured to be rotatably coupled to the body. A first end of each arm assemblies can be coupled together. A second end of each arm assemblies can be coupled to a second elongated jaw. The coupled first ends can be movably coupled to body so that when the coupled first ends move, the arm assemblies rotates causing the second elongated to move toward or away from the first elongated jaw.

In FIG. 10C, operation 1040 lowers an empty clamping device on an object. The clamping device can include a first and a second elongated jaws with each elongated jaw operable by two or more clamping actions caused by two or more clamping arm assemblies. Operation 1050 raises the clamping device. The object can be clamped by the elongated jaws with a clamping force distributed over the areas of the elongated jaws.

In some embodiments, the present invention discloses a clamping device having a non-linearly moving jaw and a moving jaw clamping on the non-linearly moving jaw. The jaws can be elongated jaws for force distribution.

The clamping device can include a body, which can be coupled to one first elongated jaw. In some embodiments, the body can be coupled to two or more separate first jaws. The clamping device can include multiple arm assemblies that can operate on one second elongated jaw that are spaced opposite the first elongated jaw on the body. In some embodiments, the multiple arm assemblies can operate on two or more separate second jaws. The multiple arm assemblies and the body can be coupled together to provide a clamping mechanism on an object disposed between the opposite jaws. Each arm assembly can provide a clamping action with a corresponding portion of the body. For example, each arm assembly can be coupled to the body in a way so that the arm assembly can operate on an area of the second elongated jaw. The area of the second elongated jaw can be disposed opposite a corresponding area of the first elongated jaw. The arm assembly can be coupled to the body so that the area and the corresponding area are clamped together when the arm assembly is activated.

Each arm assembly can be coupled to the body at a pivot joint to move an area of the elongated jaw. The arm assemblies can be coupled to a coupler, which can be coupled to a linear guide on the body for linearly moving the coupler. The arm assemblies, together with the linear guide and the pivot points can be configured so that when the coupler moves in the linear guide, the second elongated jaw moves toward or away from the first elongated jaw.

In some embodiments, the present invention discloses a clamping device having an autolock mechanism. The clamping device can include a lock mechanism, that, when engaged or activated, locking the jaws so that the jaws are separated, such as separating a maximum distance between the jaws. The lock mechanism, when disengaged or deactivated or released, can allow the clamping device to function normally, e.g., the jaws can move toward each other when an arm assembly of the clamping device is lift up, and the jaws can move away from each other when there is no force pulling on the arm assembly. The lock mechanism can be an autolock mechanism, meaning the jaws can be separated when desired, such as when the clamping device approaches an object for clamping on the object.

For example, a clamping device can be configured to include a mechanism that can allow the jaws to remain open when needed, even during the lifting and moving of the clamping device. Normally, the clamping mechanism is such that when one ends of the arm assemblies, such as the coupler coupling one ends of the multiple arm assemblies together, are is pulled up, the other ends of the arm assemblies, such as the elongated jaw, will clamp on the object, e.g., against the other elongated jaw which is coupled to the body of the clamping device. Thus when the empty clamping device is lifted up, the jaws are clamped together. This can be detrimental, since the clamped jaws will need to be open to accept the object.

In some embodiments, the clamping device can include a mechanism so that the jaws can be forced open when desired, for example, when there is no object between the jaws. Thus the empty jaws can be lifted up and moved to the location of the object, while the jaws remaining separated so that the empty jaws can accept the object between the open jaws. The mechanism is then released, and the jaws can be clamped together when lifted up to hold the object for moving.

The mechanism can be automatic, e.g., a hand-free mechanism, which can allow the operator who operates a hoist with the clamping device to activate the mechanism without requiring assistance from another person.

In some embodiments, the locking mechanism, e.g., the mechanism that can lock the jaws into the open state until being released, can include a mechanism that couples a component of the arm assemblies of the clamping device, such as a hoist interface component (which is the portion of the clamping device that is coupled to the hoist for pulling the clamping device for moving) with the body of the clamping device, e.g., a non-moving component such as the fixed jaws or a pivot bar connecting the pivot points of the clamping mechanisms. Alternatively, the locking mechanism can couple two moving components of the arm assemblies, such as coupling two arm segments of the arm assemblies.

Thus, the mechanism can be configured so that if being locked, the hoist interface component can move together with the pivot points, so that the clamping mechanisms cannot function. The hoist interface component is then decoupled from the clamping mechanisms, and thus when lifted up, the jaws remain open. If the mechanism is released, the hoist interface component can be separated from the pivot points, so that the clamping mechanisms can function, e.g., clamping on the object. The hoist interface component is then coupled to the clamping mechanisms, and thus when lifted up, the jaws can clamp on the object.

In some embodiments, the mechanism can be activated or released by a pushing action, or a combination of pushing and pulling actions, for example, when the hoist interface component moves down toward the connecting bar, and then moves up to lift the clamping device.

FIGS. 11A-11D illustrate a schematic for a locking mechanism according to some embodiments. A clamping device 1100 can include a clamping mechanism that includes an arm assembly having an arm segment 1125 rotatably coupled to a body 1115 at a pivot point 1111, and an arm segment 1130 linearly coupled to a body 1115 at a linear guide 1114. The arm assembly is rotatably and linearly coupled to the body in such as a way so that when the arm segment 1130 linearly moves in the linear guide, for example, by pulling on a hoist interface component 1131 or by releasing a pulling force on the hoist interface component 1131 to let the hoist interface component moving down, the arm segment 1125 rotates around the pivot point 1111 to move a jaw 1122 coupled to the arm segment 1125 toward or away from the other jaw 1112 coupled to the body.

The clamping device 1100 can include a locking mechanism 1150. The locking mechanism can include two components with a first component coupled to the arm segment 1130 and a second component coupled to the body 1115. The first component can include a pin 1151 activated by an activation mechanism, such as a spring 1152. The second component can include a hole 1153, what can be mated with the pin 1151.

Figure 11A:
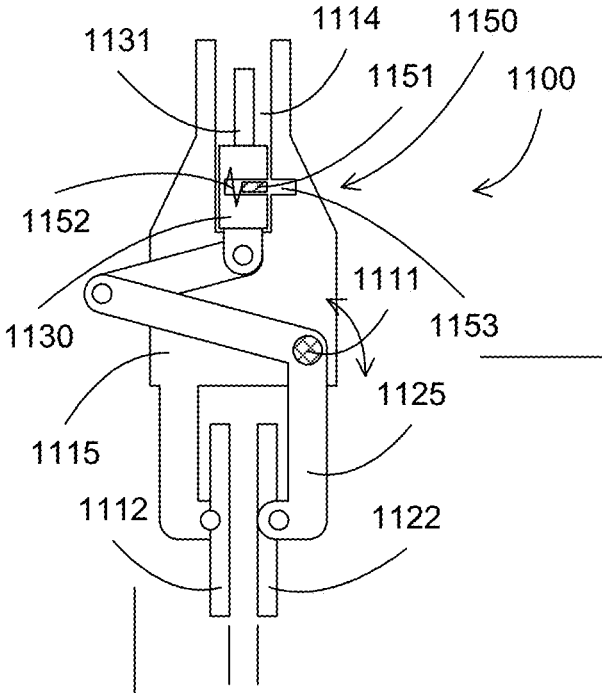
FIGS. 11A-11D illustrate a schematic for a locking mechanism according to some embodiments.

In FIG. 11A, the locking mechanism is in an unlock state, e.g., the locking mechanism is disengaged, e.g., the pin is retracted to the arm segment so that the arm segment can move freely within the linear guide.

Figure 11B:
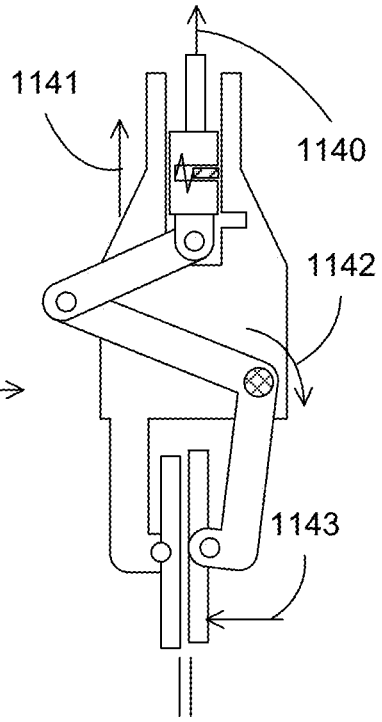

In FIG. 11B, the clamping device can function normally, e.g., the clamping device can operate as there is no locking mechanism. For example, the hoist interface component can be pulled up 1140 to move 1141 the arm segment 1130 up along the linear guide. The moving 1141 of the arm segment 1130 can rotate 1142 the arm segment 1125. The rotation 1142 of the arm segment 1125 can move 1143 the jaw 1122 toward the opposite jaw 1112, for example, to narrow the space between the jaws or to clamp on an object disposed between the jaws.

Figure 11C:
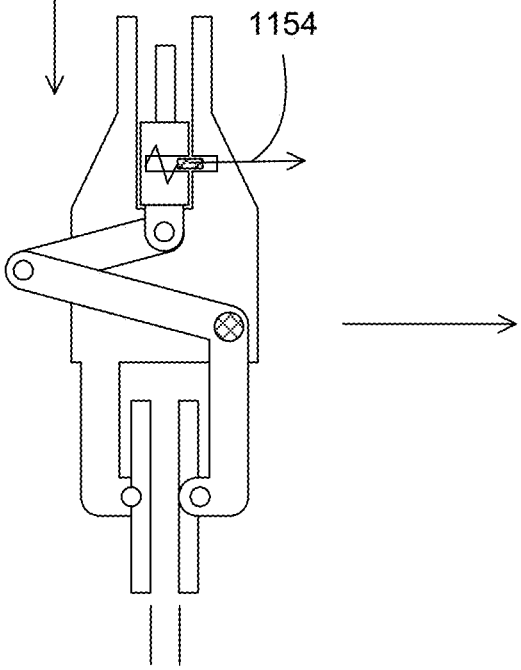

In FIG. 11C, the locking mechanism is in a lock state, e.g., the locking mechanism is engaged, e.g., the pin 1152 is extended 1154 into the corresponded hole 1153. This engagement can lock the arm segment 1130 to the body 1115, e.g., preventing the arm segment 1130 from moving within the linear guide.

Figure 11D:
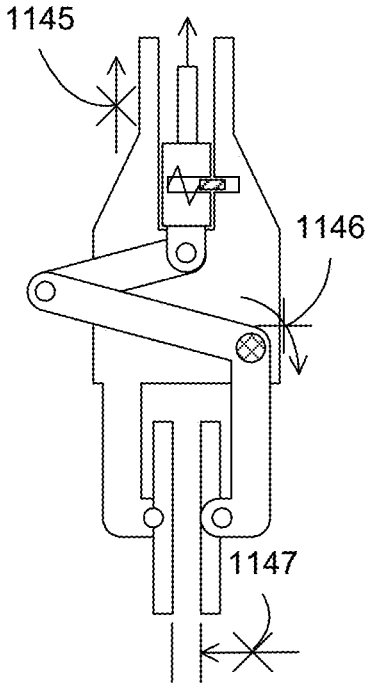

In FIG. 11D, the locking mechanism is engaged to prevent the clamping mechanism of the clamping device from functioning. For example, the hoist interface component can be pulled up 1140. Since the arm segment 1130 is locked to the body, the pulling 1140 of the hoist interface component cannot move 1145 the arm segment 1130 along the linear guide. The stationary 1145 of the arm segment 1130 can also keep the arm segment 1125 stationary, e.g., the arm segment 1125 cannot rotate 1146 around the pivot point. The non-rotation 1146 of the arm segment 1125 can also keep the jaw 1122 stationary, e.g., maintaining a fixed separation with the opposite jaw 1112, e.g., the jaw 1122 cannot move 1147 toward the opposite jaw 1112.

Figure 12A:
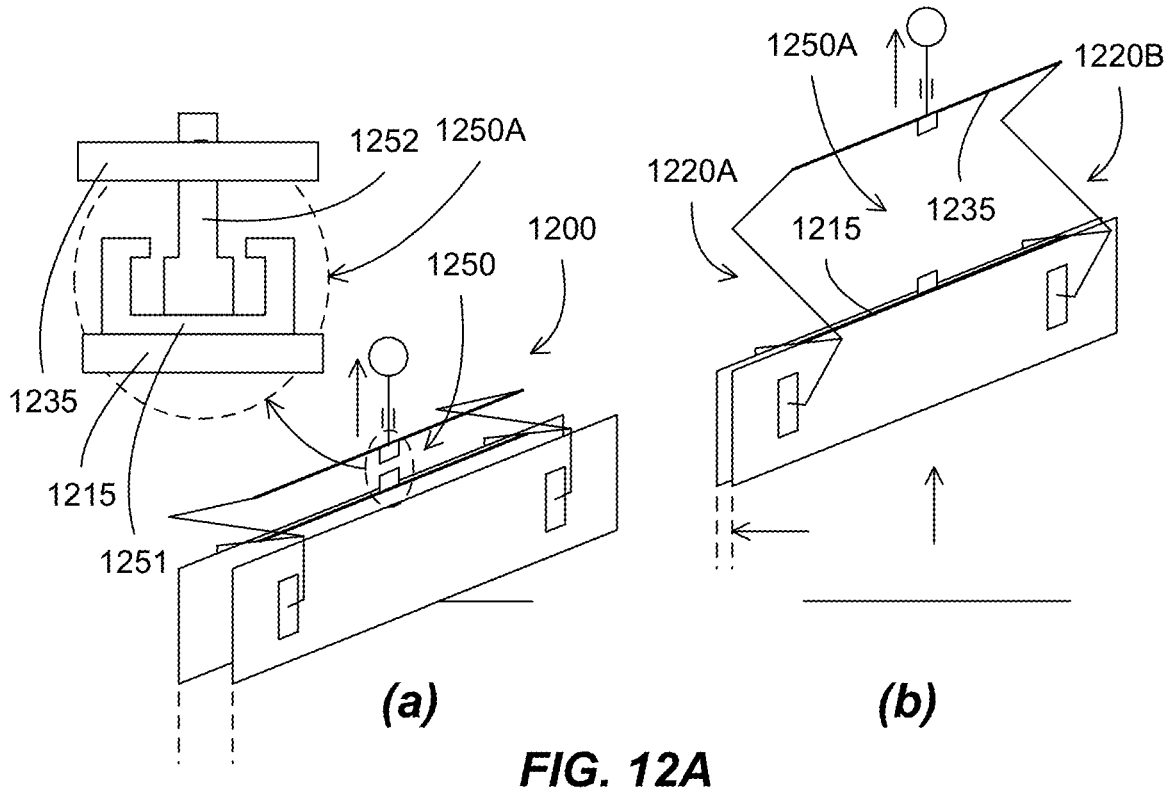
FIGS. 12A-12B illustrate a schematic of a lock mechanism for a clamping device according to some embodiments.
Figure 12B:
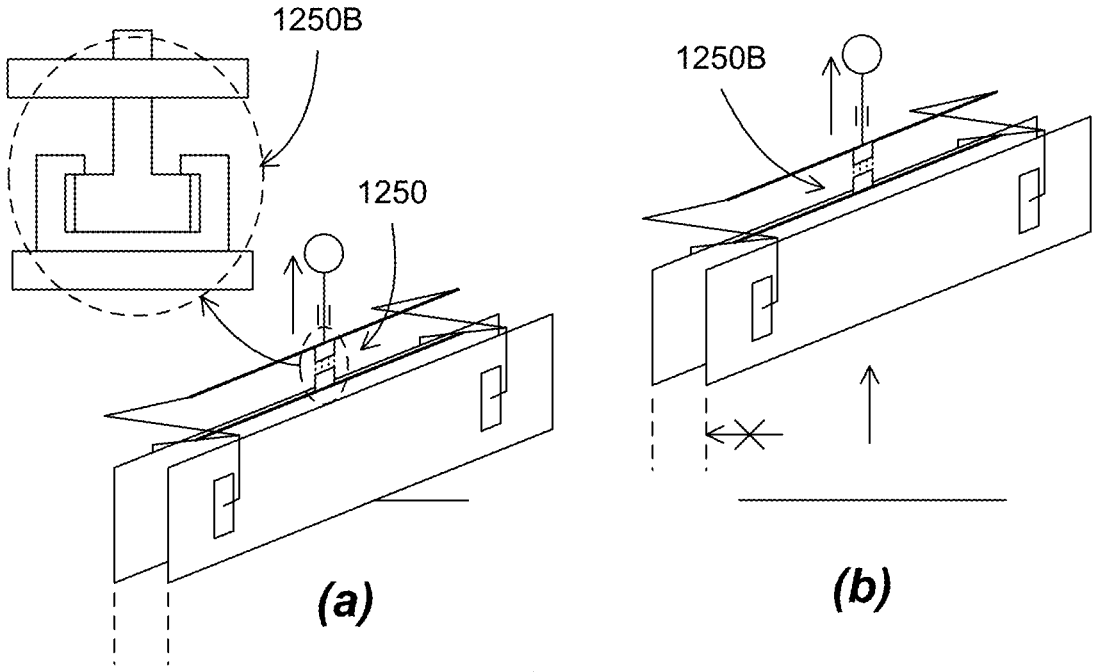

FIGS. 12A-12B illustrate a schematic of a lock mechanism for a clamping device according to some embodiments. A clamping device 1200 can include a connecting bar 1235 coupled to multiple arm assemblies 1220A and 1220B. The arm assemblies can move with respect to a body, which can include a body bar 1215 parallel with the connecting bar 1235 to move a movable elongated jaw against a fixed elongated jaw.

The clamping device can include locking mechanism 1250, which can include a first component coupled to the connecting bar 1235 and a second component connecting to the body bar 1215. The locking mechanism, when disengaged, does not affect the operation of the clamping device, meaning the connecting bar can move relative to the body, allowing the jaws to move to clamp on an object disposed between the jaws. The locking mechanism, when engaged, can couple the connecting bar to the body bar, thus can prevent the arm assemblies from operating, e.g., which can prevent the jaws from clamping on the object.

In FIG. 12A(a), a clamping device is shown, with the locking mechanism 1250 in an unlock state 1250A, meaning the connecting bar 1235 can freely move relative to the body bar 1215. In some embodiments, the locking mechanism can include a flange 1252 that can mate with a hook 1151. The flange can be a partial flange, such as an elongated flange so that when the flange rotates, for example, 90 degrees, the flange can toggle between a mating status and a non-mating status with the hook.

As shown, the flange is configured for not mating with the hook, e.g., a short side of the elongated flange is disposed in the hook, so that the flange can freely move in and out of the hook. Thus the connecting bar can be free to move, relative to the body of the clamping device.

In FIG. 12A(b), the clamping device is lifted up. Since the connecting bar can move relative to the body, the clamping mechanism is activated, for example, by moving the arm assemblies relative to the body. The jaws are thus moved toward each other. If there is an object between the jaws, the jaws can clamp on the object so that the object can be transferred by the clamping device.

In FIG. 12B(a), the locking mechanism 1250 in a lock state 1250B, meaning the connecting bar 1235 is coupled to the body bar 1215. As shown, the flange is configured for mating with the hook, e.g., a long side of the elongated flange is disposed in the hook, so that the flange is fixedly coupled to the hook, e.g., the flange cannot move in and out of the hook. Thus the connecting bar is coupled to the body of the clamping device, e.g., moving the connecting bar also moves the body of the clamping device. Thus, the arm assemblies cannot rotate around the pivot point so that the jaws cannot clamp on an object.

In some embodiments, the connecting bar can have limited movement relative to the flange 1252, such as the coupling between the flange and the connecting bar can allow the flange can move a little relative to the connecting bar. Thus the connecting bar can be coupled to the body but not fixedly coupled to the body. As a result, the arm assembly can rotate a little around the pivot point, but cannot rotate enough to move the movable jaw a significant distance to clamp on the object.

In FIG. 12B(b), the clamping device is lifted up. Since the connecting bar is coupled to the body, the clamping mechanism is deactivated. The jaws are thus locked, e.g., since the jaws are separated, lifting the clamping device keeps the jaws separated.

Figure 13A:
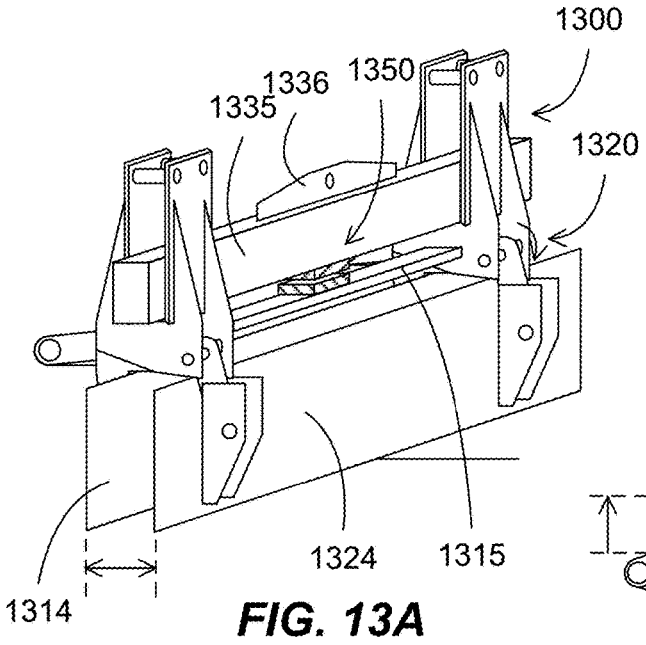
FIGS. 13A-13C illustrate a schematic of a lock mechanism for a clamping device according to some embodiments.
Figure 13B:
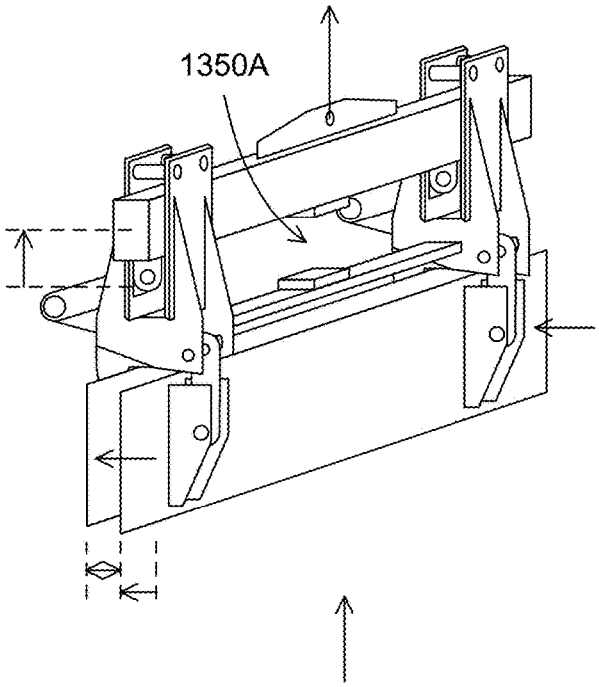
Figure 13C:
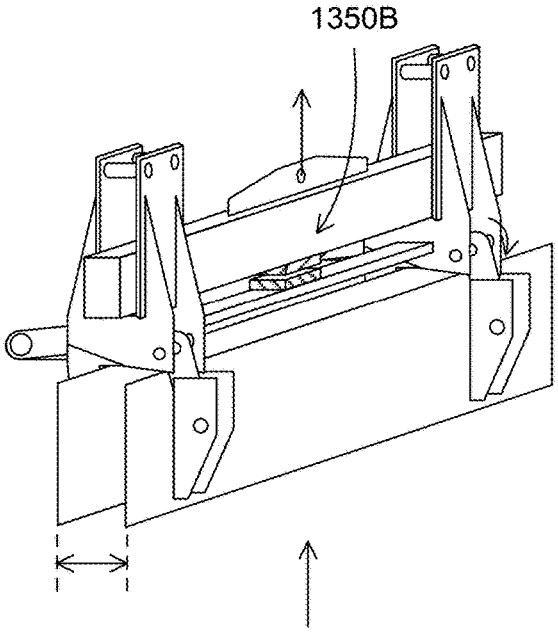

FIGS. 13A-13C illustrate a schematic of a clamping device having a lock mechanism according to some embodiments. A clamping device 1300 can include a connecting bar 1335 coupled to multiple arm assemblies 1320. The arm assemblies can move with respect to a body, which can include a body bar 1315 which can be parallel with the connecting bar 1335 to move a movable elongated jaw 1324 against a fixed elongated jaw 1314. A hoist interface component 1336, which can be a component configured to be coupled to a hoist, such as having a hook or a hole for accepting a hook from the hoist, can be coupled to the connecting bar 1335 for moving the connecting bar, which can move the arm assemblies relative to the body of the clamping device.

The clamping device can include locking mechanism 1350, which can include a first component coupled to the connecting bar 1335 and a second component connecting to the body bar 1315. The locking mechanism, when disengaged, does not affect the operation of the clamping device, meaning the connecting bar can move relative to the body, allowing the jaws to move to clamp on an object disposed between the jaws. The locking mechanism, when engaged, can couple the connecting bar to the body bar, thus can prevent the arm assemblies from operating, e.g., locking the jaws so that the jaws remain separated.

In FIG. 13A, a clamping device is shown, with the locking mechanism 1350.

In FIG. 13B, the locking mechanism 1350 is in an unlock state. The clamping device can be lifted up. Since the connecting bar can move relative to the body, the clamping mechanism is activated, for example, by moving the arm assemblies relative to the body. The jaws are thus moved toward each other. If there is an object between the jaws, the jaws can clamp on the object so that the object can be transferred by the clamping device.

In FIG. 13C, the locking mechanism 1350 in a lock state 1350B, meaning the connecting bar 1335 is coupled to the body bar 1315. The clamping device can be lifted up. Since the connecting bar is locked to the body, e.g., cannot move a large distance relative to the body, the clamping mechanism is deactivated. The jaws remain separated, even when the clamping device is lifted.

The locking mechanism can limit the movements of the top arm portion, e.g., to prevent the top arm portion from moving up/down or sideways a large distance. For example, the top arm portion can be locked (e.g., coupled together with a possible small relative movement) to the pivotal point between the top arm portion and the bottom arm portion, or to any element fixedly coupled to the pivotal point. The top arm portion can be locked to an intermediate pivot within the top arm portion.

In the present specification, the term "locking two elements", or "an element is locked to another element of the lock mechanism" mean that the two elements of the lock mechanism are coupled together with possible limited movements between the two elements. The limited movements can be caused by a tolerance of the lock mechanism, or can be caused by a design of the lock mechanism. The limited movements do not affect the functionality of the lock mechanism. For example, the lock mechanism for preventing the clamping mechanism from operating can allow the jaws to have some movements, such as moving a few millimeters, such as less than 10 mm, less than 8 mm, less than 5 mm, less than 3 mm, or less than 1 mm. The jaw movements of less than a few millimeters are not enough for the jaws to move to clamp on an object, and thus the lock mechanism with the lock element having limited movements can still able to perform the lock function.

In some embodiments, the locking mechanism, e.g., the mechanism that can lock the jaws into the open state until being released, can include a mechanism that couples a hoist portion of the clamping device, e.g., the portion of the clamping device that is coupled to a hoist for pulling the clamping device, with a fixed component such as the fixed jaws or a pivot bar connecting the pivot points of the clamping mechanisms. Thus, the mechanism can be configured so that if being locked, the hoist portion can move together with the pivot points, so that the clamping mechanisms cannot function. In this configuration, the hoist portion is then decoupled from the clamping mechanisms, and thus when lifted up, the jaws remain open. If the mechanism is released, the hoist portion can be separated from the pivot points, so that the clamping mechanisms can function, e.g., clamping on the object. In this configuration, the hoist portion is then coupled to the clamping mechanisms, and thus when lifted up, the jaws can clamp on the object.

The locking mechanism can be automatic, meaning the mechanism can be locked or engaged, e.g., locking the jaws to keep the jaws separated, or unlocked or disengaged, e.g., unlocking the jaws to allow the jaws to move toward each other. The automatic mechanism can be triggered or activated when the clamping device touches the object, and can be toggled between engaging and disengaging the lock. For example, the locking mechanism can be engaged, meaning the jaws can be widely separated and prevented from moving toward each other (except for limited movements as discussed above) when the clamping device is lifted up. The clamping device can be lowered toward the object, and after touching the object, the locking mechanism can be disengaged, meaning the jaws can move toward each other when the clamping device is lifted up. The clamping device can be lifted up, which moves the jaws together to clamp on the object. The clamping device can move to a new location. The clamping device can lower the object. When the object reaches the ground, the clamping device can lower further to touch the object, to trigger or activate the locking mechanism to change the state of the locking mechanism. The locking mechanism then can be engaged, meaning the jaws can be widely separated and prevented from moving toward each other when the clamping device is lifted up. The clamping device can then move up to move another object. Since the locking mechanism is engaged, the clamping device can lift up without moving the jaws.

The locking mechanism can be a hand-free or operator-free mechanism, which can allow switching between a clamping action of the jaws for clamping the object and non-clamping action of the jaws for inserting the object. The hand-free mechanism can allow a single operator to operate the clamping device for lifting and moving the object. For example, the locking mechanism can be activated or released by a pushing action, for example, when the clamping device touches the object.

Figure 14A:
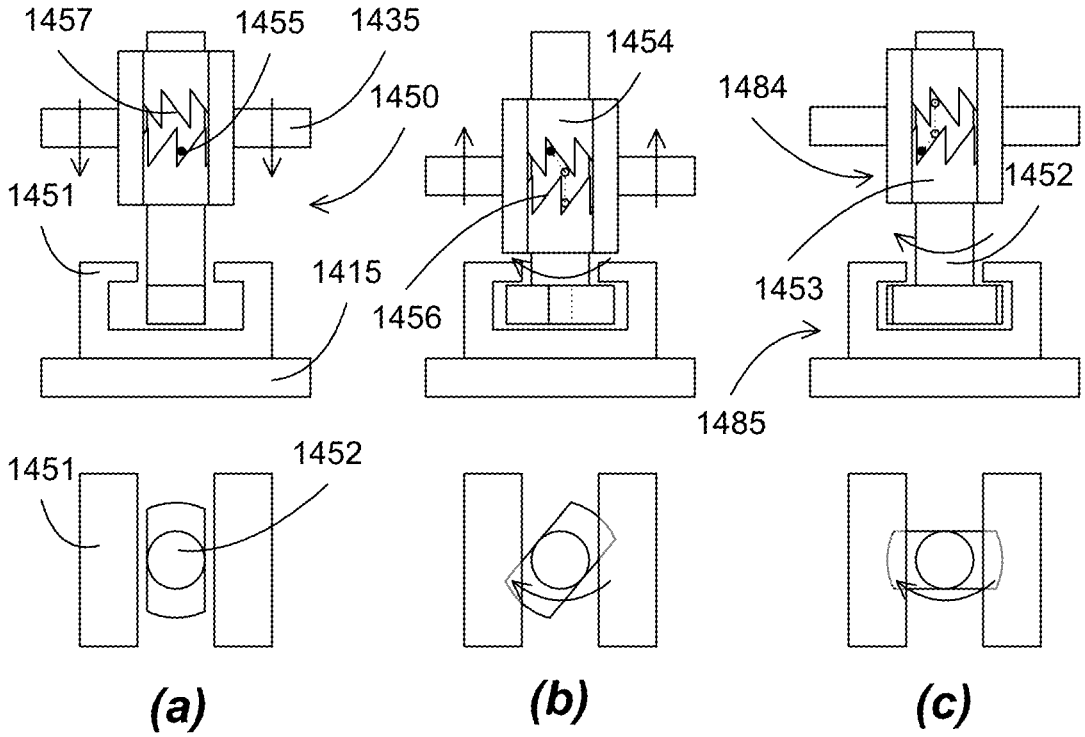
FIGS. 14A-14B illustrate a schematic of a locking mechanism according to some embodiments.
Figure 14B:
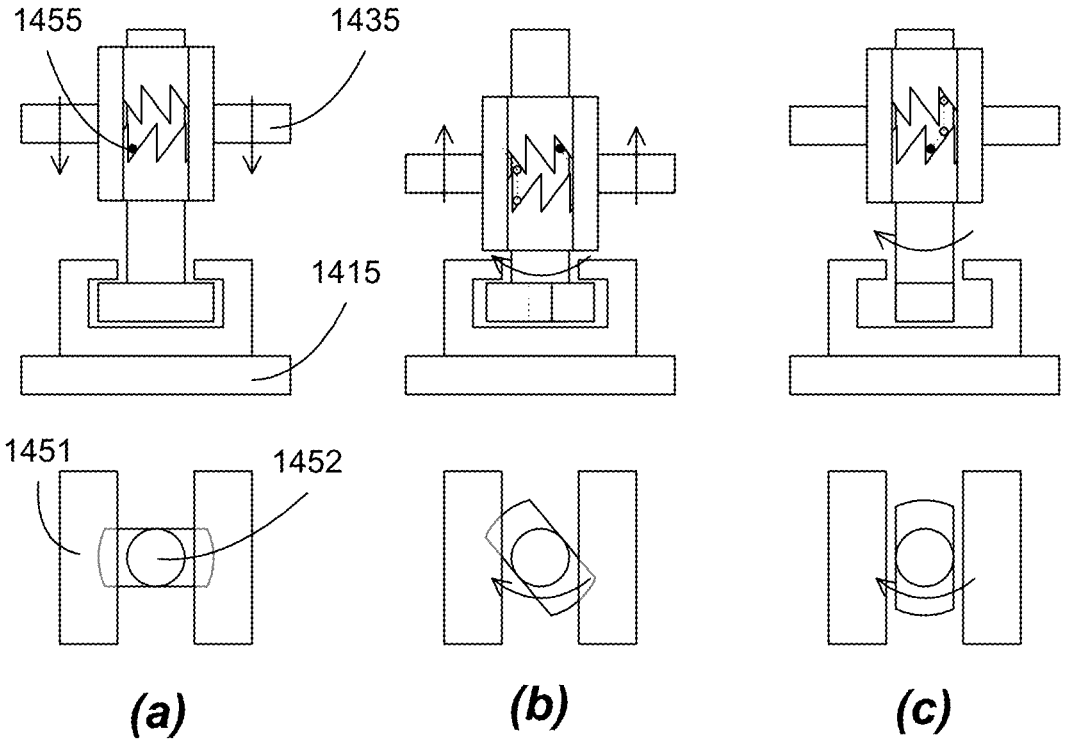

FIGS. 14A-14B illustrate a schematic of a locking mechanism according to some embodiments. FIGS. 14A(a)-14A(c) show a process for the locking mechanism to toggle from an unlock state to a lock state. FIGS. 14B(a)-14B(c) show a process for the locking mechanism to toggle from a lock state to an unlock state. The toggling processes between lock and unlock states are similarly activated, e.g., a same activation can toggle the state of the locking mechanism, regardless of the initial state.

A locking mechanism 1450 can include a first component 1484, which can be coupled to a moving component of the clamping mechanism, such as a connecting bar 1435 connecting the arm assemblies for moving a jaw of the clamping device. The locking mechanism 1450 can include a second component 1485, which can be coupled to another moving component of the clamping mechanism, such as an arm segment. The second component 1485 can also be coupled to a body part of the clamping device, e.g., to a fixed element not movable with respect to the clamping mechanism, such as a body bar 1415 which can be parallel with the connecting bar 1435.

The second component 1485 can include a fastening element, e.g., an element that can be fastened to another element. For example, the fastening element can include a linear hook 1451, which can be fastened to a latch such as another hook. A linear hook can be considered as a hook in one direction, and not a hook in another direction, such as a direction perpendicular to the hook direction. For example, the linear hook can be a hook along one line, or along two parallel lines. Thus, when a latch faces the hookable direction, the latch can be hooked. When the latch faces a non-hookable direction, the latch is can be removed from the hook.

In some embodiments, the fastening element can include a hookable element or a removable hook element, meaning the fastening element can be hooked to a latch and can be removed from the latch. The fastening element can be a rotatable hookable element, meaning a mating latch can rotate to become hooked or to be removable from the fastening element.

The first component 1484 can include a mating fastening element to the second component, such as an asymmetry latch 1452 having a perpendicular elongated end, for example, to mate with a rotatable hookable fastening element. The latch 1452 can be a rod having an oval or rectangular or any similar shape at one end. When the long side of the elongated end of the latch 1452 is parallel to the linear hook (see FIG. 14A(a)), the latch is not fastened to the hook, e.g., the latch can move away from the hook. When the long side of the elongated end of the latch 1452 is perpendicular to the linear hook (see FIG. 14A(c)), the long side is coupled to the hook so that the latch is fastened to the hook, e.g., the latch cannot move away from the hook.

The first component 1484 can include an activation element to rotate the mating fastening element, e.g., to rotate the asymmetry latch having a perpendicular elongated end so that the latch can toggle between latching and non-latching with the hookable element. The activation element and the mating fastening element can include one or more slanting surfaces and one or more contact elements to the slanting surfaces. The activation element can include rings having slanting surfaces along a periphery, such as repeated up and down slanting surfaces to form up slanting surfaces, down slanting surfaces, peaks at the top junction of the up and down slanting surfaces, and valleys at the bottom junction of down and up slanting surfaces. The rings can have hollow center, for example, to accept a latch having the contact element.

A contact element can be a pin, a protruding element, or any element having a surface that can contact a slanting surface. The contact element can be configured to contact the slanting surface. A principle of the slanting activation element is a mating of a contact element to a slanting surface, which can generate a movement having a component in a direction perpendicular to a pushing direction. For example, the contact element can be pushed in a direction making an angle with a slanting surface. After contacting the slanting surface, the pushing force on a contact element can be decomposed to include a force pushing the contact element along the slanting surface. If the contact element has a cylindrical shape, and the slanting surface surrounds the contact element, such as a spiral surface, pushing the contact element along an axis of rotation of the cylindrical shape can cause the contact element to rotate when the contact element slides along the slanting surface.

A first component 1484 can include a rod 1452 disposed between two rings 1453 and 1454 each having a slanting surface 1456 and 1457, respectively, along a periphery of the rings. The rod 1452 can be slidable in the rings 1453 and 1454. There can be multiple slanting surfaces around the ring periphery, forming a cyclic slanting surface, having peaks and valleys. The rod 1452 can include a contact element, such as protruded pin 1455. The pins can protruded on both sides of the rod. The rod 1452 can include a hookable element at one end, such as an elongated end forming a right angle with a rotational axis of the rod. The rod 1452 can be placed within the rings 1453 and 1454, with the protruded pin 1455 disposed between the slanting surfaces 1456 and 1457.

FIG. 14A(a) shows a non-latch configuration of the locking mechanism 1450. The rod 1452 can have the elongated side parallel to the hookable sides of the fastening element 1451, e.g., the rod 1452 is not hooked to the hook 1451. In this configuration, the rod 1452 can be removed from the hook 1451, e.g., the arm assemblies 1435 can move relative to the body 1415, allowing the clamping mechanism of the clamping device to function normally.

The pin 1455 can be positioned at a valley of the slanting surface 1456 of the ring 1453. In some embodiments, the locking mechanism is positioned as shown, with the connecting bar 1435 and the body bar 1415 parallel to a ground surface. The first and second components of the locking mechanism can be perpendicularly coupled to the connecting bar and the body bar, e.g., the rod 1452 is position in a vertical direction, so that gravity can pull the rod down. Thus, the pin 1455 can be down, and rest on a valley of the slanting surface of the bottom ring 1453.

In operation, the connecting bar 1435 can move downward, e.g., toward the body bar 1415.

FIG. 14A(b) shows a status of the locking mechanism after the connecting bar 1435 contacts the body bar 1415. Since the rod 1452 is movable in the rings 1453 and 1454, with the rod 1452 constrained by contacting the hookable element 1451, the rings 1453 and 1454 move down relative to the rod 1452.

The pin 1455 is then pushed up to contact the slanting surface 1457 of the upper ring 1454. Further pushing down of the rings can force the pin to move along the slanting surface, effectively rotating the rod. The pin can move along the slanting surface until reaching a valley of the slanting surface of the upper ring. The rod can rotate an angle corresponded to the angle or the arc formed by the path of traveling of the pin. As shown, the angle can be 45 degrees, partially hooking the rod 1452 to the hook 1451.

The connecting bar 1435 then can move upward, e.g., away from the body bar 1415.

FIG. 14A(c) shows a status of the locking mechanism after the connecting bar 1435 moves away from the body bar 1415. The rod 1452 constrained by the hookable element 1451, so the rings 1453 and 1454 move up, relative to the rod 1452. The pin 1455 then moves from the valley of the upper ring to contact slanting surface 1456 of the lower ring 1453. Further pulling up on the ring assembly, e.g., the assembly of the ring 1453 and the ring 1454, can force the pin to move along the slanting surface, rotating the rod again. The pin can move along the slanting surface until reaching a valley of the slanting surface of the lower ring. The rod can rotate an angle corresponded to the angle or the arc formed by the path of traveling of the pin. As shown, the angle can be an additional 45 degrees, forming a 90 degree rotation, completely hooking the rod 1452 to the hook 1451.

When the lock mechanism is engaged, the rod 1452 is locked with the hookable element 1451, e.g., the rod can rotate in the hookable element, but cannot move out of the hookable element. Depending on the tolerance of the hook end of the rod and the cavity area of the hookable element, the rod can move a little in a vertical direction, e.g., moving less than a few mm. However, the rod is locked to the hookable element, meaning the rod cannot move out of the hookable element.

The ring assembly 1453/1454 can be fixedly coupled to the connecting bar 1435. The rod 1452 can be disposed in the ring assembly, and can move up and down in the ring assembly. The rod movement is limited by the constraint of the protruded pin 1455, e.g., the rod can move up until the pin contact the slanting surface of the upper ring. The rod can move down until the pin contact the slanting surface of the lower ring. Thus the connecting bar can have a movement, when in a locked state with the body bar, which is limited by the movement of the rod in the ring assembly. For example, if the slanting surfaces of the upper and lower rings are separated by a few mm along a vertical direction, e.g., the vertical distance from the valley of the lower ring to the slope of the slanting surface of the upper ring or the vertical distance from the valley of the upper ring to the slope of the slanting surface of the lower ring, the connecting bar can move relative to the body bar also a few mm, determined by the separation between the rings in the ring assembly.

FIGS. 14B(a)-14B(c) show a same sequence, e.g., the connecting bar moves down toward the body bar, followed by the connecting bar moving away from the body bar, which can change from a hooked state, in which the rod 1452 is hooked to the hook 1451, to an unhooked state, in which the rod is released from the hook.

In FIG. 14B(a), the connecting bar can go down, forcing the pin to move up to contact a slanting surface of the upper ring, and then rotating the rod when the pin moves along the slanting surface. In FIG. 14B(b), the connecting bar can then go up, forcing the pin to move down (since the rod is partially constrained in the hook) to contact a slanting surface of the lower ring, and then rotating the rod when the pin moves along the slanting surface. FIG. 14B(c) shows the unhooked state of the rod with the hook. The connecting bar is free from the constraint of the locking mechanism, e.g., the locking mechanism is disengaged, and thus the connecting bar can move away from the body bar, to activate the clamping mechanism for clamping on an object disposed between the jaws of the clamping device.

The locking mechanism 1450 can be activated and deactivated by a sequence of down and up movements, toggling the locking mechanism between locked and unlocked states.

Figure 15A:
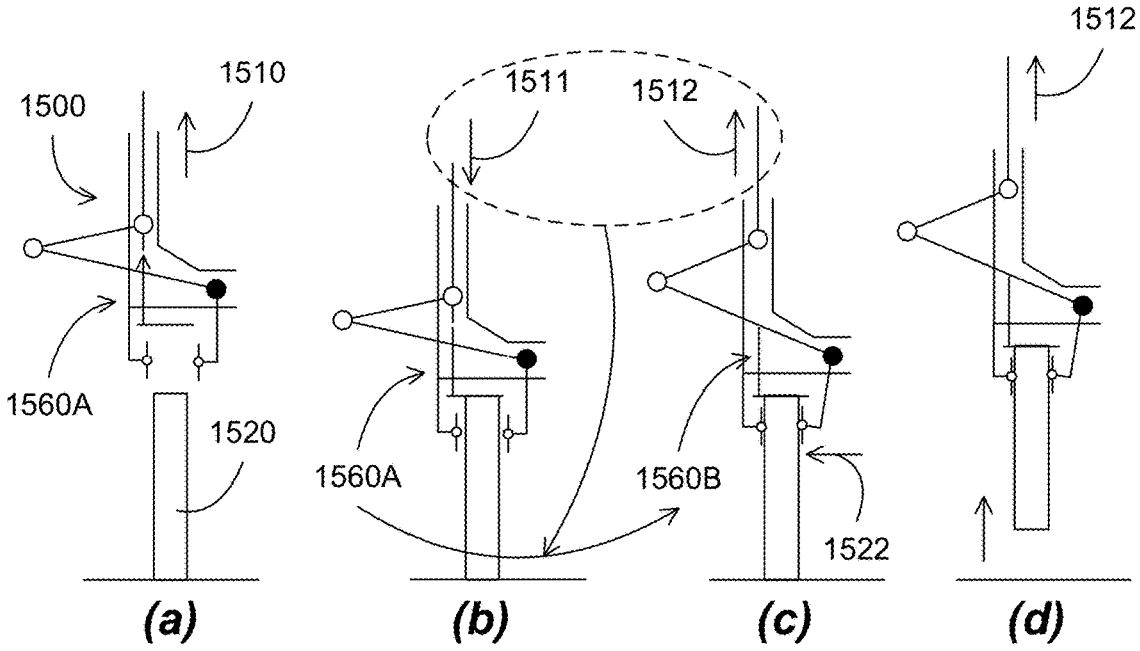
FIGS. 15A-15B illustrate processes for operating a clamping device according to some embodiments.
Figure 15B:
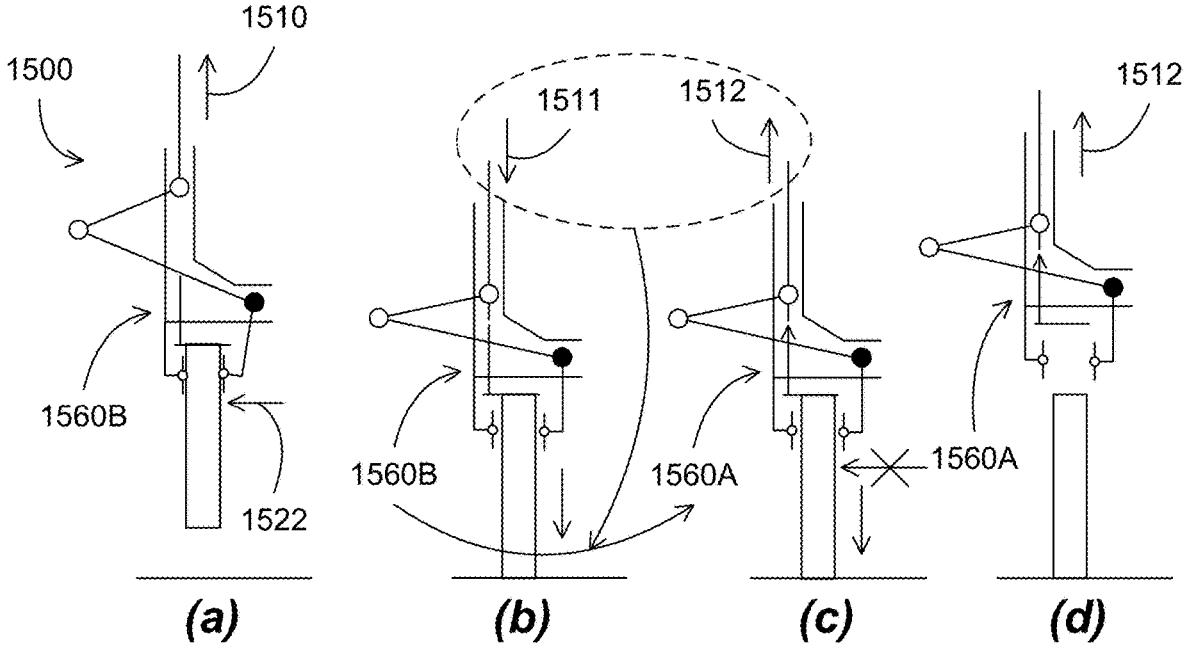

FIGS. 15A-15B illustrate processes for operating a clamping device according to some embodiments. The clamping device 1500 can include a locking mechanism that can automatically lock and release the jaws. The automatic locking mechanism can toggle between a locked state and an unlocked state, using a same activation sequence.

FIGS. 15A(a)-15A(d) show a process for an empty clamping device to pick an object 1520. In FIG. 15A(a), the lock mechanism is engaged 1560A, securing the opening of the jaws, e.g., the jaws are separated at a fixed distance, regardless of movements of the clamping device. Thus, when the clamping device 1500 is lifted up 1510, for example, by pulling on a pulling element, which can be a hoist interface component coupled to a connecting bar that couples to the arm assemblies, and moved to approaching the object 1520, the distance between the jaws is unchanged, e.g., remaining widely separated.

In FIG. 15A(b), the clamping device is moved to be positioned on the object. Since the lock mechanism is engaged, the space between the jaws is large to accommodate the object. The clamping device then can be lowered so that the object is disposed between the jaws.

The clamping device is lowered 1511 enough to touch the object. A pulling element can then be further lowered, with respect to the body of the clamping device, to partially unlock the lock mechanism. For example, a top part of the locking mechanism can move down (since the top part is locked to the pulling element), so that a rod is moved up. Rings with slanting surfaces in the top part can partial rotate the rod, for example, through protruded elements coupled to the rod.

In FIG. 15A(c), the pulling element is lifted up 1512. At the beginning, the top part of the locking mechanism can move up (since the top part is locked to the pulling element), so that the rod is moved down. Rings with slanting surfaces in the top part can partial rotate the rod again through protruded elements coupled to the rod. The complete rotation can be 90 degrees, thus can release the rod from a hook in a bottom part of the locking mechanism.

The pulling element is then further lifted up. Since the locking mechanism is unlocked, the linkage mechanism is activated, and the jaws move toward each other for clamping 1522 on the object.

In FIG. 15A(d), the lifting of the pulling element will also lift the object after the jaws clamp on the object. The clamping device can lift and move the clamped object to a destination.

FIGS. 15B(a)-15B(d) show a process for a clamping device clamping on an object to release the object at a destination.

In FIG. 15B(a), the lock mechanism is disengaged 1560B, allowing the jaws to move when the clamping device is lifted up. Thus, when the clamping device is lifted up 1510 and moved, the jaws clamp on the object to secure the object to the clamping device.

In FIG. 15B(b), the clamping device is moved to a destination for dropping the object. The clamping device can be lowered 1511 until the object touches the ground. The pulling element can be further lowered while the body of the clamping device is stationary by contacting the object. The lowering of the pulling element can enlarge the distance between the jaws, e.g., increasing the separation between the jaws.

When the jaws are separated at a predetermined distance, such as a maximum distance, the top part of the locking mechanism can contact the bottom part of the locking mechanism, such as the elongated head of the rod can contact the hook of the bottom part. Since the locking mechanism is disabled, the shorter side of the elongated head is facing the hook, thus the elongated head can enter the hook without any obstacle.

The lowering of the pulling element can lower the top part, thus moving the rod upward. The contact of the protruded elements with the slanting surfaces of the rings can partially rotate the rod.

In FIG. 15B(c), the pulling element is lifted up 1512. At the beginning, the top part of the locking mechanism can move up (since the top part is locked to the pulling element), so that the rod is moved down. The contact of the protruded elements with the slanting surfaces of the rings can partially rotate the rod again. The complete rotation can be 90 degrees, thus can lock the rod to the hook in a bottom part of the locking mechanism, e.g., the rod is rotated so that the longer side mates with the hook to lock the rod with the hook.

The pulling element is then further lifted up. Since the locking mechanism is locked, the linkage mechanism is deactivated, and the jaws remain in the separated state.

In FIG. 15B(d), the clamping device is lifted up. Since the jaws are separated, the object is left at the destination, and only the empty clamping device is moved. The clamping device is ready to move for approaching a new object for pick up.

The toggling of the locking mechanism can be accomplished by a sequence of moving down 1511 and then moving up 1512, which can rotate a rod in the locking mechanism to lock or unlock with a hook. In some embodiments, the toggling of the locking mechanism can be accomplished by only a moving down action, or only a moving up action.

Figure 16:
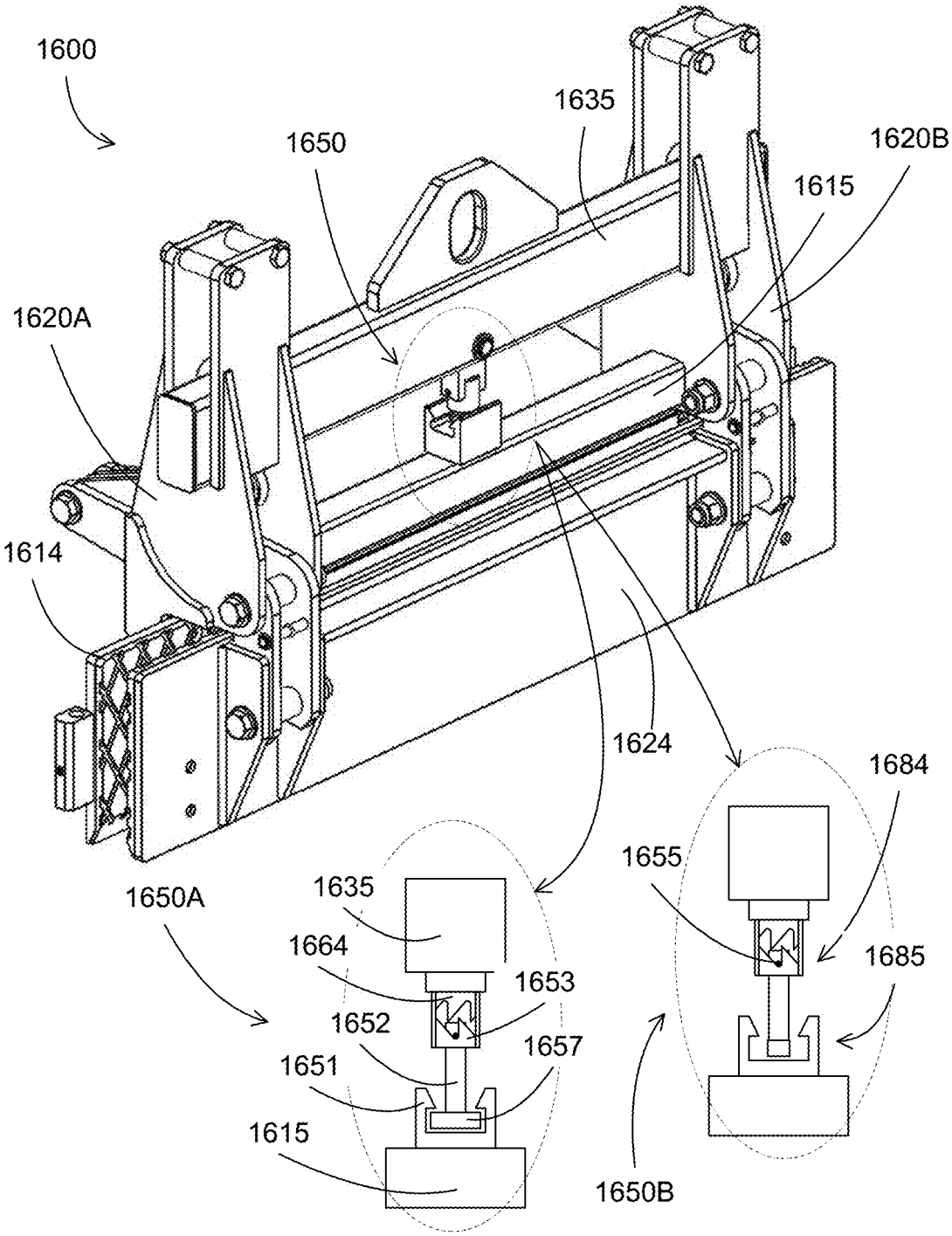
FIG. 16 illustrates a clamping device according to some embodiments.

FIG. 16 illustrates a clamping device according to some embodiments. The clamping device 1600 can use a half scissor mechanism, e.g., one jaw is fixed, and the opposite jaw is coupled by a clamping mechanism to a pulling element. For example, a half scissor mechanism can couple a movable jaw to move against a translational stationary jaw, e.g., a stationary but rotatable jaw.

The clamping device can include multiple half scissor mechanisms 1620A and 1620B, with each half scissor mechanism coupled to a movable jaw opposite a translational stationary jaw. Optional elongated jaw 1614 and 1624 can be coupled to multiple plates of the half scissor mechanisms at a same side, such as jaw 1624 is coupled to two moving arm assemblies of the half scissor mechanisms.

The translational stationary jaw 1614 can be fixed coupled to a body of the clamping device. The half scissor mechanism can include a pivot point, also fixedly coupled to the body. The half scissor mechanism can include a linear guide, also fixedly coupled to the body. Thus, when the half scissor mechanism is pulled up along the linear guide, the arm assembly rotates around the pivot point. Due to the pivot point, the jaw 1624 moves toward the opposite jaw 1614.

A connecting bar 1635 can be connected to ends of the arm assemblies of the half scissor mechanism 1620A and 1620B, for example, to actuating all the half scissor mechanisms together. The connecting bar 1635 can move in a linear guide for proper movements for actuating the half clamping mechanisms. A pulling element 1610 can be coupled to the connecting bar. When the pulling element is pulled up, the connecting bar also moves up, pulling on the activation arms of the half clamping mechanisms. Through the pivot points, the movable jaws move toward the opposite jaws, pressing the movable jaw 1624 toward the translational stationary jaw plate 1614.

Thus the clamping device can have a linkage mechanism, linking the pulling element with the movable jaw. Pulling on the pulling element can move the movable jaw toward the translational stationary opposite jaw. Releasing the pull on the pulling element can move the movable jaw in the opposite direction, for example, due to gravitation. The linkage mechanism can include the connecting bar, coupled to the activation arms, coupled to the pivot points, and coupled to the jaw arms.

A locking mechanism 1650 can be included, for hand-free actuating the clamping device using the multiple half scissor mechanisms. The locking mechanism can allow or prevent the engagement of the half scissor mechanisms, e.g., allowing or prevent the linkage mechanism between the pulling element and the movable jaw. When the locking mechanism is activated or locked 1650A, the linkage mechanism is prevented or disabled, meaning pulling on the pulling element does not move the movable jaw enough to clamp on an object. When the locking mechanism is deactivated or unlocked 1650B, the linkage mechanism is allowed or enabled, meaning pulling on the pulling element move the movable jaw toward the opposite translational stationary jaw.

The locking mechanism can include a top part 1684, which can be locked to or release from the bottom part 1685. The top part 1684 can be coupled to the connecting bar 1635 which is coupled to the pulling element, e.g., the top part can be coupled to the connecting bar, and since the connecting bar is coupled to the pulling element, the top part can move as a unit together with the pulling element. The bottom part 1685 can be coupled to the body 1615 of the clamping device. The top part can include a movable rod having an elongated head, which can be locked to or released from a mated hook in the bottom part.

The top part 1684 can include a rod 1642 having an elongated head 1657. The elongated head can have one side longer than a side perpendicular to it, such as an ellipse shape or a rectangular shape. If the elongated head has the longer side disposed within the hook 1651 of the bottom part 1685, the rod can be locked to the hook, forming a lock status in which the top part is locked to the bottom part. If the elongated head has the shorter side disposed within the hook 1651 of the bottom part 1685, the rod can be movable out of the hook, forming an unlock status in which the top part can be moved from the bottom part.

The top part can include rings 1653 and 1654 having slanting surfaces, which can be mated with protruded elements on the rod. The rings and the protruded elements can be configured so that when the rod is pushed into and released out of the rings, the rod can rotate an angle such as 90 degrees, to toggle between longer side and shorter side, e.g., toggle between a lock status and an unlock status.

When the locking mechanism is engaged, meaning the top part is locked with the bottom part, the pulling element is coupled to the body of the clamping device. Thus the pulling element cannot activate the half clamping mechanisms, and the movable jaw plate is translational stationary, except for possible limited movements, when pulling on or lowering the pulling element.

When the locking mechanism is disengaged, meaning the top part is unlocked from the bottom part, the pulling element is freely to move with respect to the body of the clamping device. Thus the pulling element can move to activate the half clamping mechanisms, and the movable jaw plate can move toward or away from the opposite jaw plate when pulling on or lowering the pulling element, respectively.

In some embodiments, the present invention discloses a clamping device having a toggling mechanism that can automatically lock or unlock a component of a moving arm assembly of a clamping mechanism. The toggling mechanism can be configured to automatically switch between a first status in which the jaws are fixedly separated and a second status in which the jaws are movable to clamp on an object disposed between the jaws.

The toggling mechanism can be configured to switch to a first status in which the jaws are fixedly separated after the clamping device delivers an object, and to switch to a second status in which jaws are movable to clamp on the object when the clamping device approaches the object and places the object between the jaws.

The toggling mechanism can be configured to couple the body with at least one of the arm assemblies, with the toggling mechanism configured to automatically switch between a first status in which the body is fixedly coupled to the at least one of the arm assemblies and a second status in which the body is movable relative to the at least one of the arm assemblies.

The toggling mechanism can be configured to couple two components of at least one of the arm assemblies, with the toggling mechanism configured to automatically switch between a first status in which the two components are fixedly coupled together and a second status in which the two components are movable relative to each other.

In some embodiments, the toggling mechanism can include a first element coupled to at least one of the arm assemblies and a second element coupled to the body. The first element can be configured to toggle between a locked position and a separatable position with the second element. The toggling mechanism can The toggling mechanism can be configured to couple a first component of at least one of the arm assemblies with a second component, with the second component being another component of the at least one of the arm assemblies or a component of the body. The coupling of the first component with the second component is configured so that when the first component moves toward the second component, followed by a retraction of the first component away from the second component, the toggling mechanism toggles between a locked status and an unlocked status. In the locked status, the component is coupled to the other component. In the unlocked status, the component is movable relative to the other component.

In some embodiments, the toggling mechanism can include a first element coupled to at least one of the arm assemblies and a second element coupled to the body. The first element can be configured to toggle between a locked position and a separatable position with the second element. The toggling mechanism can include a first element coupled to the body, with the first element including a hookable element such as a hook. The toggling mechanism can include a second element, with the second element coupled to a coupler coupling the first ends of the arm assemblies, and the second element including two slanting surfaces facing each other or facing away from each other. The toggling mechanism can include a third element, with the third element movably coupled to the second element, and the third element including a rod having one or two pins which are configured to be mated with the slanting surfaces. The pins and the two slanting surfaces can be configured so that when the third element is moved so that one pin of the pins contacts a slanting surface of the two slanting surfaces, the third element rotates an angle. The third element can include an elongated end configured to toggle between securing to the hook and being separatable from the hook by rotating the third element.

In some embodiments, the present invention discloses a clamping device that can include a first jaw, a second jaw facing the first jaw, and a clamping mechanism coupled to the first and second jaws. The clamping mechanism can include multiple components, in which a first component can be movably coupled to a second component. Further, the coupling of the first and second components is configured to convert a movement comprising a vertical component of the first component to a relative movement comprising a horizontal component of the first jaw with respect to the second jaw. The clamping device can include a toggling mechanism coupled to the first and second components for allowing the first component to move relative to the second component, or to fixedly couple the first component to the second component.

FIGS. 17A-17D illustrate flow charts for a locking mechanism according to some embodiments. In FIG. 17A, operation 1700 switches states of a locking mechanism of a clamping device by pushing a movable portion of the clamping device against a fixed portion of the clamping device, followed by moving the movable portion away from the fixed portion.

In FIG. 17B, operation 1720 disengages a locking mechanism for lifting and moving an object.

In FIG. 17C, operation 1740 engages a locking mechanism for lifting and moving an empty clamping device.

In FIG. 17D, operation 1760 engages a locking mechanism for lifting and moving an empty clamping device. Operation 1770 receives an object while disengaging the locking mechanism. Operation 1780 lifts and moves the object.

FIGS. 18A-18C illustrate flow charts for operating a locking mechanism according to some embodiments. In FIG. 18A, operation 1800 toggles between a movable status and an unmovable status for a component of a clamping mechanism of a clamping device. The toggling process is activated when at least one of the jaws of the clamping device is in a vicinity of an opening distance from the other jaw. In the movable status, the component is configured to allow jaws of the clamping device to be movable toward each other to clamp on an object. In the unmovable status, the component is configured to have the jaws remaining opened.

In FIG. 18B, operation 1820 moves a component of a clamping mechanism of a clamping device downward. When the component reaches a position, a toggling mechanism is activated to toggle between a movable status and an unmovable status for at least a jaw of the clamping device. In the movable status, the jaw is configured to be movably reachable toward an object disposed between the jaw and another jaw of the clamping device. In the unmovable status, the jaws are configured to remain opened.

In FIG. 18C, operation 1840 moves a component of a clamping mechanism of a clamping device downward to toggle at least a jaw of the clamping device between movably reachable toward an object disposed between the jaw and another jaw of the clamping device for clamping on the object and remaining opened without clamping on the object.

Figure 19A:
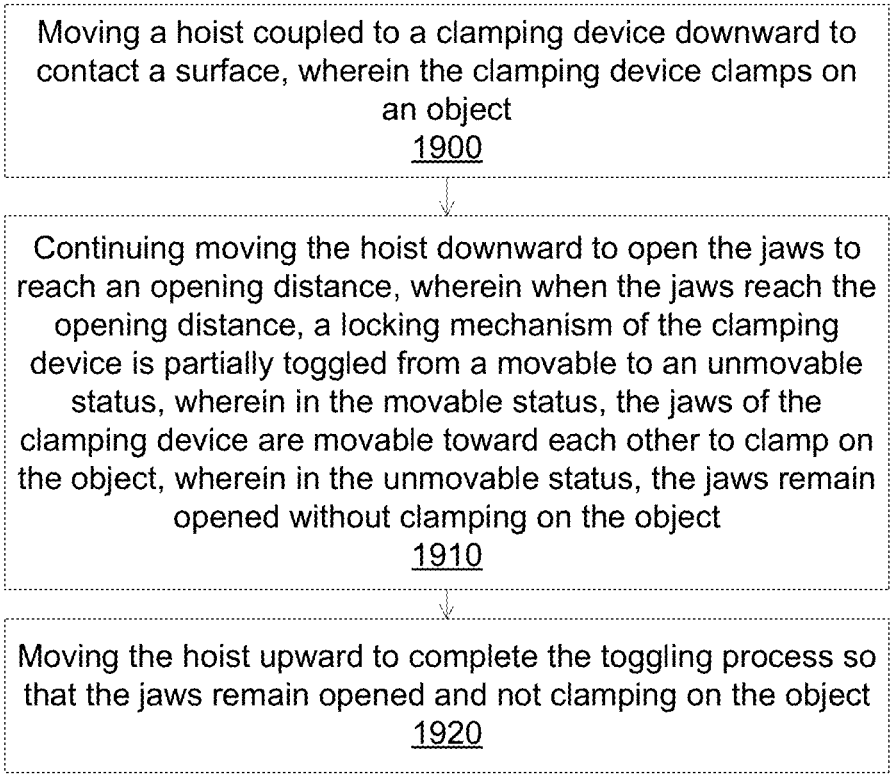
FIGS. 19A-19B illustrate flow charts for operating a locking mechanism according to some embodiments.
Figure 19B:
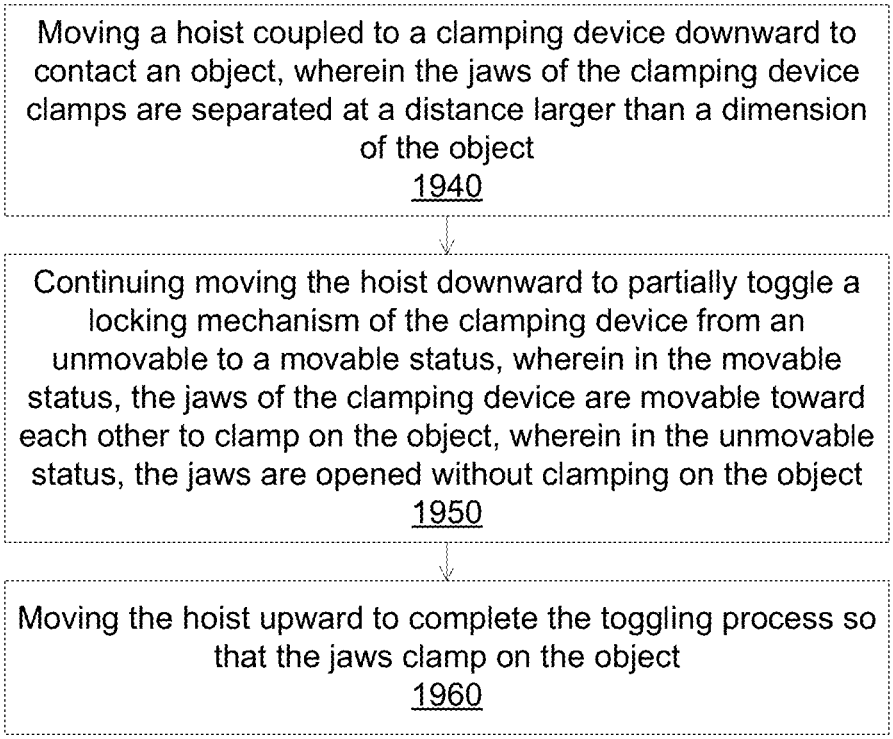

FIGS. 19A-19B illustrate flow charts for operating a locking mechanism according to some embodiments. In FIG. 19A, operation 1900 moves a hoist coupled to a clamping device downward to contact a surface. The clamping device clamps on an object. Operation 1910 continues moving the hoist downward to open the jaws to reach an opening distance. When the jaws reach the opening distance, a locking mechanism of the clamping device is toggled from a movable to an unmovable status. In the movable status, the jaws of the clamping device are movable toward each other to clamp on the object. In the unmovable status, the jaws remain opened without clamping on the object. Operation 1920 moves the hoist upward to complete the toggling process so that the jaws remain opened and not clamping on the object.

In FIG. 19B, operation 1940 moves a hoist coupled to a clamping device downward to contact an object. The jaws of the clamping device clamps are separated at a distance larger than a dimension of the object. Operation 1950 continues moving the hoist downward to toggle a locking mechanism of the clamping device from an unmovable to a movable status. In the movable status, the jaws of the clamping device are movable toward each other to clamp on the object. In the unmovable status, the jaws are opened without clamping on the object. Operation 1920 moves the hoist upward to complete the toggling process so that the jaws clamp on the object.

In some embodiments, the present invention discloses a locking mechanism having a toggling activation process, e.g., a same process sequence can be used to change states of the locking mechanism, such as changing from a locked state to an unlocked state, or changing from an unlocked state to a locked state.

In some embodiments, the present invention discloses a toggling mechanism for coupling to a clamping device, which can enable or disable the clamping mechanism of the clamping device using a same activation sequence.

In some embodiments, the toggling mechanism can use slanting surfaces activate a locking process. For example, a locking process can be activated by a horizontal movement, such as a horizontal sideward movement or a horizontal rotation movement. The toggling process can use vertical movements on slanting surfaces to convert to horizontal movements for activating the locking mechanism. Two slanting surfaces can be used, with a first surface forming a horizontal movement, and a second surface returning the activation mechanism to the original configuration, so that a same sequence can be used again for activating the locking mechanism.

Figure 20A:
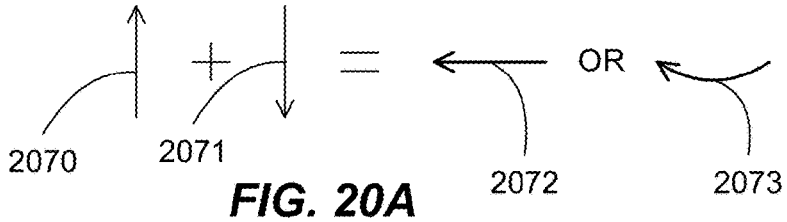
FIGS. 20A-20D illustrate a schematic of a toggling mechanism according to some embodiments.

FIGS. 20A-20D illustrate a schematic of a toggling mechanism according to some embodiments. FIG. 20A shows a movement schematic of the toggling mechanism, which can use a combination of an up movement 2070 and a down movement 2071 to convert to a linear horizontal movement 2072 or a rotational movement 2073 in a horizontal plane.

Figure 20B:
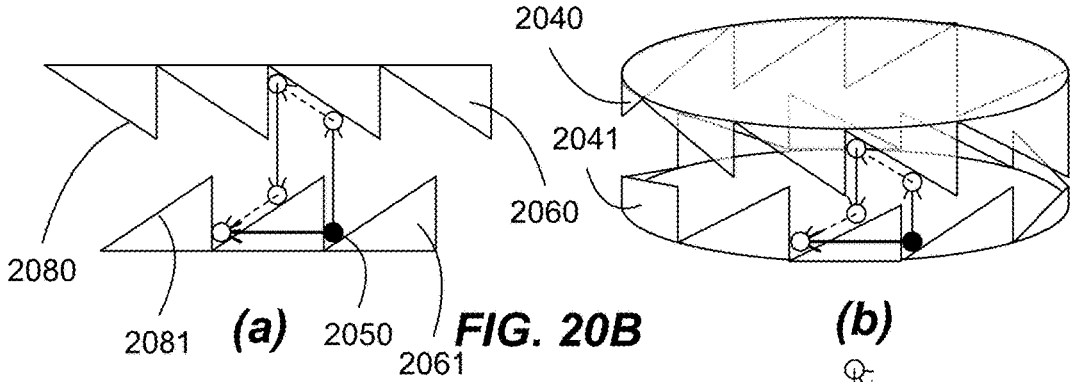

FIG. 20B(a) shows a linear configuration of two facing slanting surfaces configured to convert a combination of an up movement and a down movement to a linear horizontal movement.

Two components 2060 and 2061 having slanting surfaces 2080 and 2081, respectively, can be disposed facing each other, with the slanting directions make an angle, e.g., not parallel. The slanting surfaces in each component can be cyclic, e.g., multiple slanting surfaces can be coupled ends to ends, to form peaks and valleys. The slanting surfaces at two components can be configured so that a contact element can roll from peaks to valleys on the both slanting surfaces toward a same direction. The two components can be coupled together with the slanting surfaces facing each other to form a slanting surface assembly.

A contact element 2050, such as a pin, can originally be disposed at a valley of a slanting surface 2081 of a lower component, within the slanting surface assembly, which is a coupling between the upper and lower components 2050 and 2051. The pin can be relatively pushed up, e.g., the pin can be stationary with the slanting surface assembly moving down.

The relative movement of the pin can cause the pin to contact a slope of a slanting surface 2080 of the upper component 2060, e.g., the slanting surfaces of the upper component are configured so that the slopes of the slanting surfaces face the valleys of the slanting surfaces of the lower component. Further relative pushing up force on the pin can cause the pin to slide along the slanting surface, until the pin rests on a valley of the slanting surface of the upper component. The movement along the slope of the slanting surface can result in the pin making a horizontal movement, e.g., a movement having a horizontal component.

The pin then can be relatively pushed down, e.g., the pin can be stationary with the slanting surface assembly moving up. The relative movement of the pin can cause the pin to contact a slope of a slanting surface 2081 of the lower component 2061, e.g., the slanting surfaces of the lower component are configured so that the slopes of the slanting surfaces face the valleys of the slanting surfaces of the upper component. Further relative pushing down force on the pin can cause the pin to slide along the slanting surface, until the pin rests on a valley of the slanting surface of the lower component. The movement along the slope of the slanting surface can result in the pin making another horizontal movement. Further, after the two movements, the pin rests on a valley of the slanting surface of the lower component, returning the pin to its original configuration.

Thus, a combination of moving up and then down of the pin relative to the slanting surface assembly can cause the pin to move in a horizontal direction, together with returning the pin to its original configuration at a valley of a cyclic slanting surface configuration.

FIG. 20B(b) shows a circular configuration of two facing slanting surfaces configured to convert a combination of an up movement and a down movement to a rotational movement in a horizontal plane. The circular configuration can be formed by curving the linear configuration, together with curving the straight slanting surfaces. For example, the circular configuration can have a ring-like shape, and the slanting surfaces can have spiral surfaces.

In some embodiments, an upper component 2040 and a lower component 2041 can have an outer cylindrical shape with the slanting surfaces disposed periodically along a periphery. The upper and lower components can be hollow, e.g., having a ring shape, to accommodate a rod having a pin protruded in both sides for contacting the slanting surfaces.

Using a movement process similar to a linear configuration above, e.g., a movement process includes a relative up movement followed by a relative down movement of the pin, the rod disposed at the center of the upper and lower components can rotate an angle, such as a 90 degree angle.

Figure 20C:
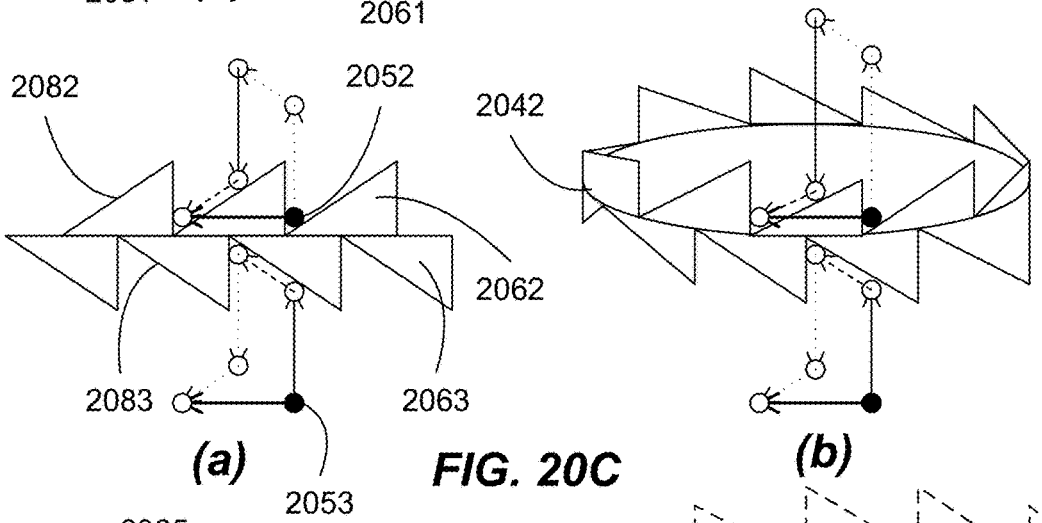

FIG. 20C(a) shows a linear configuration of two opposite facing slanting surfaces configured to convert a combination of an up movement and a down movement to a linear horizontal movement.

Two components 2062 and 2063 having slanting surfaces 2082 and 2083, respectively, can be disposed facing away from each other, with the slanting directions make an angle, e.g., not parallel. The slanting surfaces in each component can be cyclic to form peaks and valleys. Similar to the configuration of two facing slanting surfaces, the slanting surfaces at two components can be configured so that a contact element can roll from peaks to valleys on the both slanting surfaces toward a same direction. The two components can be coupled together with the slanting surfaces facing outward to form a slanting surface assembly. In some embodiments, a single component can be formed with slanting surfaces at both sides, such as at an upper side and a lower side.

A contact element, such as two pins 2052 and 2053 fixedly coupled together, can be positioned so that a lower pin 2053 faces the slanting surfaces of the lower component and an upper pin 2052 faces the slanting surfaces of the upper component. The pins can originally be configured so that one pin, such as the upper pin 2052, is disposed at a valley of a slanting surface 2082 of the upper component. The other pin does not contact the slanting surfaces.

The two pins can be relatively pushed up, e.g., the pins can be stationary with the slanting surface assembly moving down. The relative movement of the pins can cause the lower pin 2053 to contact a slope of a slanting surface 2083 of the lower component 2063. Further relative pushing up force on the pins can cause the lower pin to slide along the slanting surface, until the lower pin rests on a valley of the slanting surface of the lower component. The movement along the slope of the slanting surface can result in the pins making a horizontal movement.

The pins then can be relatively pushed down, e.g., the pins can be stationary with the slanting surface assembly moving up. The relative movement of the pins can cause the upper pin 2052 to contact a slope of a slanting surface 2082 of the upper component 2062. Further relative pushing down force on the pins can cause the upper pin to slide along the slanting surface, until the pin rests on a valley of the slanting surface of the upper component. The movement along the slope of the slanting surface can result in the pins making another horizontal movement. Further, after the two movements, one pin rests on a valley of the slanting surface of the upper component, returning the pins to its original configuration.

Thus, a combination of moving up and then down of the pins relative to the slanting surface assembly can cause the pins to move in a horizontal direction, together with returning the pins to its original configuration at a valley of a cyclic slanting surface configuration.

FIG. 20C(b) shows a circular configuration of two opposite facing slanting surfaces configured to convert a combination of an up movement and a down movement to a rotational movement in a horizontal plane. The circular configuration can be formed by curving the linear configuration, together with curving the straight slanting surfaces. For example, the circular configuration can have a ring-like shape, and the slanting surfaces can have spiral surfaces.

In some embodiments, a component 2042 can have an outer cylindrical shape with the slanting surfaces disposed periodically along a periphery, and facing opposite directions. The component can be hollow, e.g., having a ring shape, to accommodate a rod having two pins protruded in both sides for contacting the slanting surfaces.

Using a movement process similar to a linear configuration above, e.g., a movement process includes a relative up movement followed by a relative down movement of the pins, the rod disposed at the center of the upper and lower components can rotate an angle, such as a 90 degree angle.

Figure 20D:
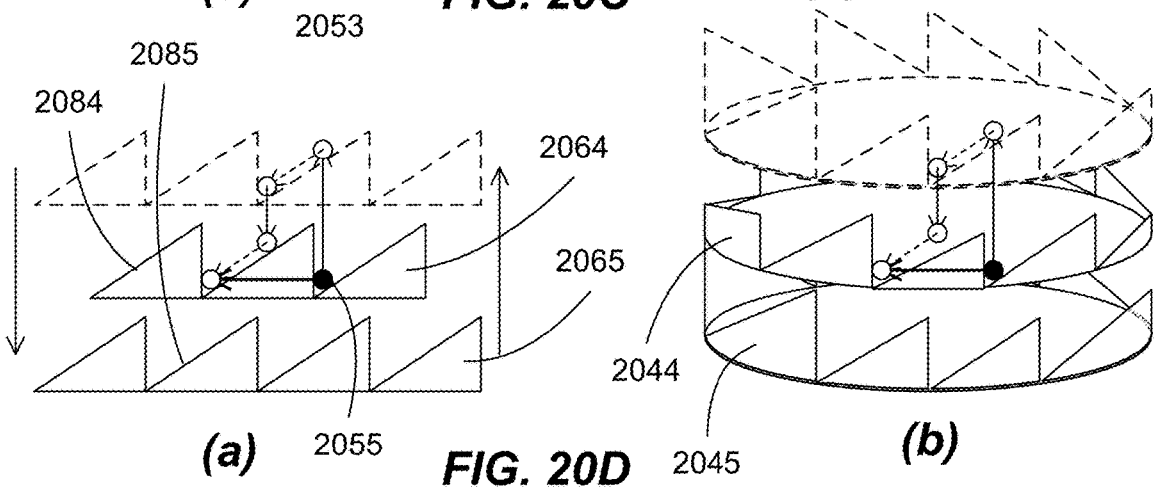

FIG. 20D(a) shows a linear configuration of two slanting surfaces facing a same direction, and configured to convert a combination of an up movement and a down movement to a linear horizontal movement.

Two components 2064 and 2065 having slanting surfaces 2084 and 2085, respectively, can be disposed facing a same direction, with the slanting directions parallel or substantially parallel. An upper component can be stationary, while the lower component can move up past the upper component. The slanting surfaces in each component can be cyclic, e.g., multiple slanting surfaces can be coupled ends to ends, to form peaks and valleys. The slanting surfaces at two components can be configured so that a contact element can roll from peaks to valleys on the both slanting surfaces toward a same direction. The two components can be move relative to each other.

A contact element 2050, such as a pin, can originally be disposed at a valley of a slanting surface 2084 of an upper component 2064. The lower component 2065 can be pushed up to move the pin up, out of the valley, and rest on a slope of a slanting surface 2085 of the lower component 2065. Further pushing up force on the lower component can cause the pin to slide along the slanting surface, until the pin rests on a valley of the slanting surface of the lower component. The movement along the slope of the slanting surface can result in the pin making a horizontal movement, e.g., a movement having a horizontal component.

The lower component then can be pushed down, allowing the pin to move down to contact a slope of a slanting surface 2084 of the upper component 2064. The pin can slide along the slanting surface, until the pin rests on a valley of the slanting surface of the upper component. The movement along the slope of the slanting surface can result in the pin making another horizontal movement. Further, after the two movements, the pin rests on a valley of the slanting surface of the upper component, returning the pin to its original configuration.

Thus, a combination of moving up and then down of the lower component can cause the pin to move in a horizontal direction, together with returning the pin to its original configuration at a valley of a cyclic slanting surface configuration.

FIG. 20D(b) shows a circular configuration of two slanting surfaces facing a same direction, and configured to convert a combination of an up movement and a down movement to a rotational movement in a horizontal plane.

The circular configuration can be formed by curving the linear configuration, together with curving the straight slanting surfaces. For example, the circular configuration can have a ring-like shape, and the slanting surfaces can have spiral surfaces.

In some embodiments, an upper component 2044 and a lower component 2045 can have an outer cylindrical shape with the slanting surfaces disposed periodically along a periphery. The upper and lower components can be hollow, e.g., having a ring shape, to accommodate a rod having a pin protruded in both sides for contacting the slanting surfaces.

Using a movement process similar to a linear configuration above, e.g., a movement process includes an up movement followed by a down movement of the lower component, the rod disposed at the center of the upper and lower components can rotate an angle, such as a 90 degree angle.

As shown, the toggling process uses a combination of an up movement followed by a down movement. Other movement sequences can be used, such as a down movement followed by an up movement, an up movement only, a down movement only, or even sequences using move than two movement combinations.

In some embodiments, the slanting surface can include a planar slanting surface or a spiral slanting surface. The contact element can include a cylindrical element, such as solid pin or a rotatable pin, e.g., a roller. The interface between a slanting surface and a cylindrical element can reduce friction, e.g., the cylindrical can run easier on the slanting surface than a slanting surface runs on the slanting surface, due to the minimum contact area.

In some embodiments, the present invention discloses an automatic locking mechanism, which can be coupled to a clamping device for automatic disabling or enabling a linkage mechanism of the clamping device. The linkage mechanism is configured to transfer a pulling force on the clamping device to a clamping force from the jaws of the clamping device. The linkage mechanism can include linkage arms, joints and/or elements connecting together, and movable with respect to the body of the clamping device.

In some embodiments, the auto locking mechanism can include two lockable elements that can be coupled together, e.g., locked together, and can be movably from each other, e.g., unlocked from each other. The two lockable elements can include a hook and an eye, in which the hook can be coupled to the eye for securing the hook with the eye. The two lockable elements can include a rod and a receptacle, in which the rod can enter the receptacle to prevent the rod or the receptacle from moving sideway. The two lockable elements can include a rod having an elongated end and a parallel hook receptacle, e.g., two hooks running parallel to each other. The rod can be inserted into the parallel hook receptacle, such as the shorter side of the elongated end of the rod can enter the parallel space between the hooks. In this configuration, the rod can enter and leave the receptacle, e.g., the two lockable elements are free to move relative to each other.

After the rod is inserted into the parallel hook receptacle, the rod can be rotated so that the longer side of the elongated end can stay in the parallel space between the hooks. In this configuration, the rod is locked to the hooks, since the hook ends of the hook receptacle can prevent the elongated end of the rod from leaving the hook receptacle.

In some embodiments, the auto lock mechanism can include two facing slanting surfaces together with an element for interacting with the slanting interface. The slanting surface interacting element can include another slanting surface. The slanting surface interacting element can have a curved surface such as a cylindrical or elliptical pin. The curved surface can reduce friction with the slanting surface, for example, due to reduced surface contact area. The slanting surface interacting element can include a roller such as a ball bearing or a bearing. The roller can further reduce friction with the slanting surface, for example, due to the rollable action of the roller.

The slanting surfaces can change a direction of a movement of the interacting element, such as rotating the interacting element when the interacting element is move toward and interacting with the slanting surfaces. The rotation of the interacting element can coupled to a lockable configuration of the auto lock mechanism, such as the rotation of a rod having an elongated end in a parallel hook receptacle.

The auto lock mechanism can be configured so that two slanting surfaces can face each other, and also face the interacting element, such as protruded elements from a rod. The first slanting surface can be configured to accept the protruded elements in a first moving direction of the rod, and then move the protruded elements along the slanting surface. The slanting surface can be a curve slanting surface, such as a spiral surface. The movements of the protruded elements along the slanting surface can rotate the rod, e.g., running along the spiral surface.

The second slanting surface can be configured to accept the protruded elements, e.g., the same protruded elements or new additional protruded elements from the rod, in an opposite moving direction of the rod. The second slanting surface can move the protruded elements along the slanting surface, for example, a spiral surface, such as rotating the rod by the protruded element running along the spiral surface. The second slanting surface can condition configuration of the rod, e.g., the positions of the protruded elements.

For example, the protruded elements can contact a high area of the first slanting surface, and then can move toward a low end of the first slanting surface. The second slanting surface can rotate the rod so that the protruded elements move from the low area to the high area of the first slanting surface. Thus a repeated movement of the rod against the first slanting surface can again face the high area of the first slanting surface, to repeat the rotational action of the rod due to the first slanting surface.

Figure 21A:
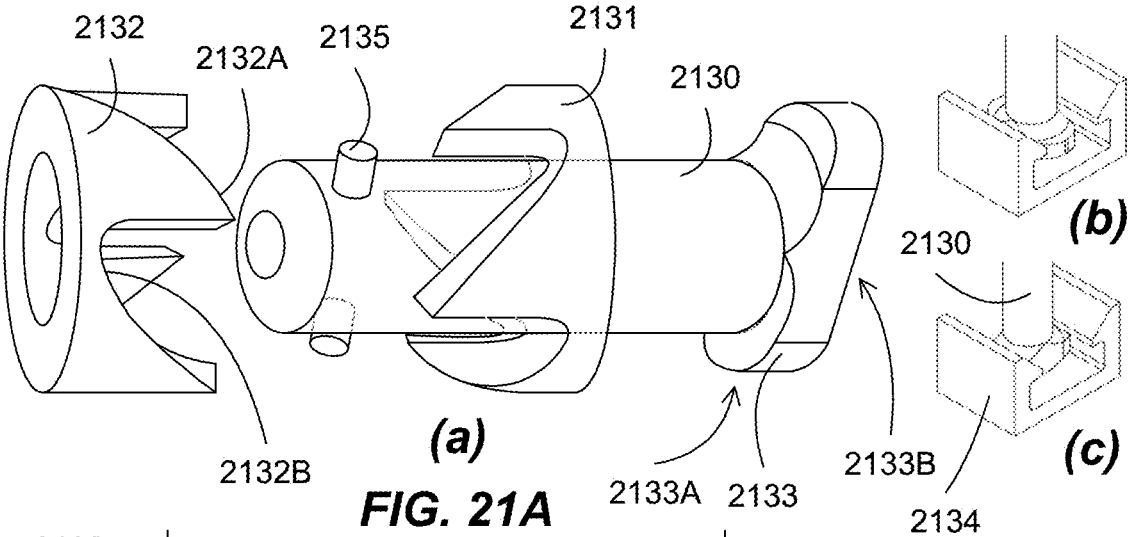
FIGS. 21A-21C illustrate a schematic configuration for a locking mechanism according to some embodiments.
Figure 21B:
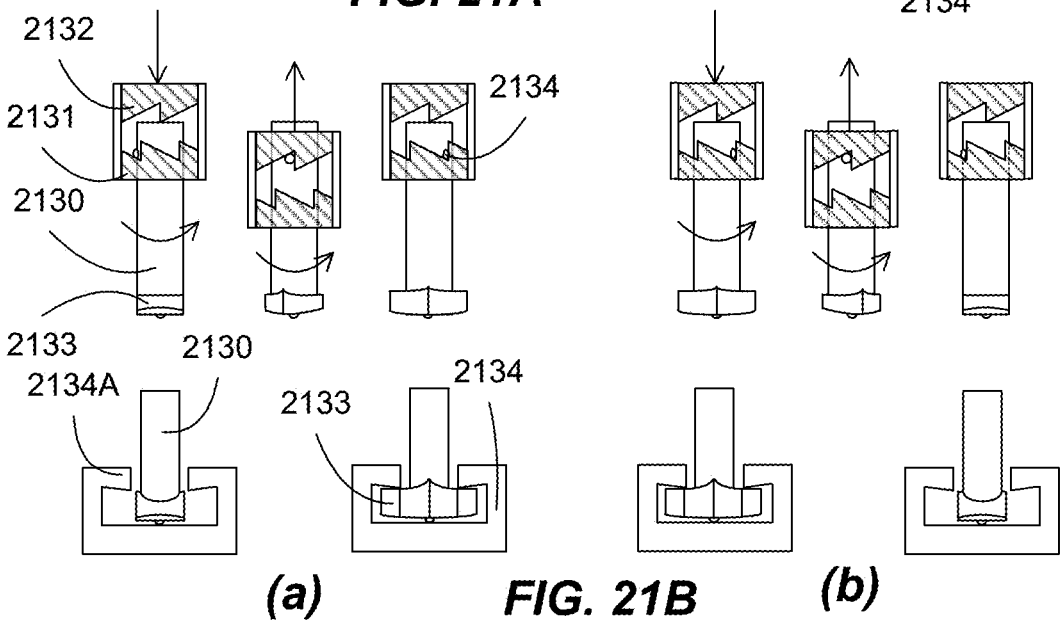
Figure 21C:
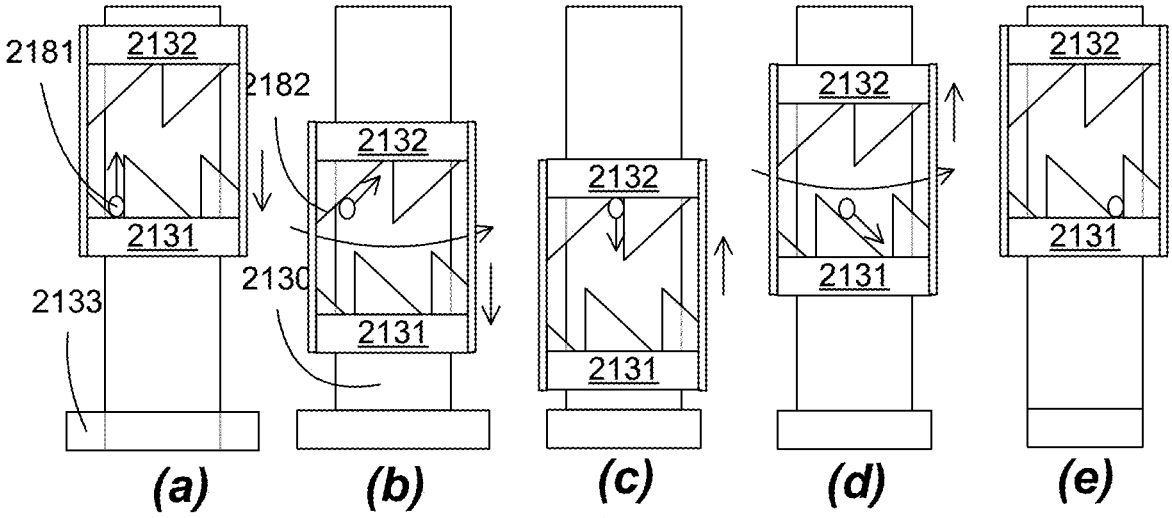

FIGS. 21A-21C illustrate a schematic configuration for a locking mechanism according to some embodiments. The locking mechanism can employ a slanting surface for repeatedly rotating a rod through a repeatedly pressing force. If the rod has a rotational symmetry, e.g., the rod geometry remains the same after rotating a certain angle, a pressing on the rod can rotate the rod half the angle. Two successive pressing will return the rod to its original configuration.

In some embodiments, the locking mechanism can include two lockable elements, such as a rod with a hook end, and a hook receptacle. Depending on the orientation of the hook end, the rod can be locked in the hook receptacle to move as a same unit with the receptacle, or the rod can move independent of the receptacle.

For example, the hook end can have an elongated shape, such as a rectangle or an ellipse. The rod thus can have a perpendicular elongated end, such as a hammer. The perpendicular elongated end can have the shape of a hammer head, coupled to a rod as a handle of the hammer. The longer side of the elongated shape can be locked to a hook of the hook receptacle, while the shorter end can be released or movable from the hook receptacle. A rotation of the rod can toggle between the locked state, e.g., the longer side facing the hook, and the unlocked state, e.g., the shorter side facing the hook of the hook receptacle.

FIG. 21A(a)-21A(c) show a schematic detail of a locking mechanism using slanting surfaces. The locking mechanism can include two lockable elements. A first lockable element can include a hook receptacle 2134, which can include parallel hook ends 2134A. A second lockable element can include a slanting surface interacting element 2130 together with slanting surface elements 2131 and 2132 each having at least a slanting surface.

A lockable element of a locking mechanism can include a slanting surface interacting element, such as a rod 2130. One end of the rod can include a hook end 2133, which can include a perpendicular elongated portion having a longer side 2133A and a shorter side 2133B. The longer side can be latched in the hook receptacle (FIG. 21A(c)), with the longer side mated with the hook ends 2134A of the hook receptacle 2134. When the longer side of the rod end 2133 is mated with the hooks, the rod receptacle 2134 can be locked to the rod, e.g., the locking mechanism is enabled.

The shorter side can be free to move in out of the hook receptacle (FIG. 21A(b)), since the separation between the hook ends 2134A is bigger than the shorter side of the elongated end of the rod. By rotating the rod, such as a 90 degree angle, the status of the lock can be toggle between locked, e.g., the rod is locked to the hook receptacle (FIG. 21A(c)), and unlocked, e.g., the rod is free to move in and out of the hook receptacle (FIG. 21A(b)). When the shorter side of the rod end 2133 is inside the rod receptacle, the hooks do not capture the rod, and thus the rod receptacle 2134 can move relative to the rod, e.g., the locking mechanism is disabled.

The rod 2130 can include a protruded element 2135, which can be a protruded pin passing through the rod, together with optional rollers coupling to the pin ends. The protruded element can interface with the slanting surfaces of the slanting surface elements 2131 and 2132. The slanting surface elements 2131 and 2132 can include rings having slanting surfaces in the form of spiral surfaces. The protruded element can be facing the spiral surfaces, e.g., sandwiching between the spiral surface of the first rings 2131 and the spiral surface of the second rings 2132.

When the protruded element contact the spiral surface at a high end 2132A of the spiral surface of the second ring 2132, the protruded element can run along the spiral surface to the low end 2132B. The movement of the protruded element can cause the rod to rotate an angle corresponded to the length of the movement, The protruded element can be returned to the high end position by contacting the spiral surface of the first ring 2131, and can run along the spiral surface from a high end to the low end of the spiral surface of the first ring 2131.

For example, the spiral surfaces of the first and second rings can be facing each other, and can be configured to provide a torque to rotate the rod through the cylindrical rods. For example, the rod can be pushed into the second ring, with the cylindrical rods then contact the spiral surfaces of the second ring. Due to the spiral surfaces, the cylindrical protruded pins can slide or roll on the spiral surface, effectively rotating the rod an angle corresponded to the amount of the cylindrical pins sliding or rolling on the spiral surface, from the point of contact to the point of rest at the bottom of the spiral surfaces.

The rod can be retracted, e.g., the force pushing on the rod can be released and the rod can be pushed back, for example, by gravitation or by the rod hooked into the hook. The cylindrical pins then can be configured to contact the spiral surfaces of the first ring. Due to the spiral surfaces, the cylindrical pins can slide or roll on the spiral surface, effectively rotating the rod another angle corresponded to the amount of the cylindrical pins sliding or rolling on the spiral surface, from the point of contact to the point of rest at the bottom of the spiral surfaces. Thus, by pushing and releasing, the rod can rotate an angle, such as a 90 degrees angle.

FIGS. 21B(a) and 21B(b) show schematics for the locking mechanism to toggle from an unlocked status to a locked status, and from a locked status to an unlocked status.

In FIG. 21B(a), the locking mechanism can change status from an unlocked status, in which the rod is free to move relative to the hook receptacle, to a locked status, in which the rod is locked in the hook receptacle.

A downward force can be applied to a ring assembly of the first ring 2131 and second ring 2132 having slanting surfaces facing each other. The force is relative, e.g., the force can be equally applied to the rod upward.

The protruded element can be rested on a low end of the spiral surface of the first ring 2131. The force can push the protruded element to be in contact with a high end of a spiral surface of the second ring 2132, and can move from a high end to a low end, partially rotating the rod.

A relatively second upward force can then be applied to the ring assembly, e.g., the force can be a downward force applied to the rod. The force can push the protruded element to be in contact with a high end of a spiral surface of the first ring 2131, and can move from a high end to a low end, partially rotating the rod. The two partial rotations can rotate the rod 90 degrees, changing the rod from an unlock status to a lock status.

In FIG. 21B(b), the locking mechanism can change status from a locked status, in which the rod is locked in the hook receptacle, to an unlocked status, in which the rod is free to move relative to the hook receptacle.

A relatively downward force can be applied to a ring assembly of the first ring 2131 and second ring 2132. The protruded element can be rested on a low end of the spiral surface of the first ring 2131. The force can push the protruded element to be in contact with a high end of a spiral surface of the second ring 2132, and can move from a high end to a low end, partially rotating the rod.

A relatively second upward force can then be applied to the ring assembly. The force can push the protruded element to be in contact with a high end of a spiral surface of the first ring 2131, and can move from a high end to a low end, partially rotating the rod. The two partial rotations can rotate the rod 90 degrees, changing the rod from an unlock status to a lock status.

Thus, the locking mechanism can have a toggle action, in which repeatedly pushing and pulling the ring assembly (or the rod) of the locking mechanism to rotate the rod 90 degrees, e.g., can toggle the rod to be parallel (unlocked status) or to be perpendicular (locked status) to a surface.

FIGS. 21C(a)-21C(e) show a detail process for switching a locking mechanism from a lock status to an unlocked status. The figures show a process to rotate a rod of the locking mechanism 90 degrees. If the rod end has a shorter portion contacting a rod receptacle, the rotation can turn the rod to have a longer portion contacting the rod receptacle, for securing the locking mechanism and disabling the linkage mechanism. If the rod end has a longer portion contacting a rod receptacle, the rotation can turn the rod to have a shorter portion contacting the rod receptacle, for releasing the locking mechanism and enabling the linkage mechanism.

In some embodiments, the rings 2131 and 2132 can each have 4 slanting surfaces disposed around a periphery of the rings. Thus, each slanting surface corresponds to 90 degrees separation, e.g., a low end of the previous slanting surface is separated 90 degrees from a low end of the next slanting surface on a ring. The protruded element thus can start from a low end of the first ring (FIG. 21C(a)), then moving straight from the low end to a high end of the second ring (FIG. 3C(b)), then moving along the slanting surface to a low end of the second ring (FIG. 3C(c)), then returning straight to a high end of the first ring (FIG. 21C(d)), and moving along the slanting surface to a low end of the first ring (FIG. 21C(a)).

In FIG. 21C(a), the rod 3530 is disposed between the slanting surfaces of first ring 3531 and the slanting surfaces of the second ring 3532. For example, the first and second rings can have a hollow cylindrical shape, with the rod disposed in the hollow area so that the rod can travel and interact with the first and second rings. The rod can include protruded elements 3535, such as two protruded elements at opposite sides of the rod. The protruded elements can include cylindrical pins, rollers, elliptical pins, or any shape protrusions that can slide along the slanting surfaces of the first and second rings.

The protruded element 3535 can be disposed at a bottom of a slanting surface 3581 of the first ring, e.g., at a valley formed by two adjacent slanting surfaces of the first ring, for example, by applying a downward force to the rod or an upward force to the ring assembly. The rod cannot retract any further, since the protruded element stops the rod from going further.

The rod can be pushed up relative to the ring assembly, e.g., in a direction so that the protruded element moves toward the slanting surfaces of the second ring 3532.

In FIG. 21C(b), the rod can reach a high end of a slanting surface of the second ring 2132, as a result of the force pushing the rod relatively upward. The rod can slide in the hollow of the first and second rings, until the protruded element contacts a slanting surface of the second ring, such as slanting surface 3582. The rod can be further pushed up. Due to the slanting surface, the protruded elements can run, such as slide or roll, along the slanting surface to reach the bottom of the slanting surface, e.g., the valley between two adjacent slanting surfaces of the second ring.

In FIG. 21C(c), the protruded elements can rest at the valley of two adjacent slanting surfaces of the second ring. The rod has been rotating an angle, such as 45 degrees as shown, due to the movements of the protruded elements along the slanting surfaces.

Thus the slanting surfaces of the second ring can be configured to face the valleys of the first ring, so that when the rod is pushed toward the second ring, the protruded elements can move straight up from the valleys, and then run along the slanting surfaces to reach the valleys of the second ring. The rod is then rotated due to the running of the protruded elements along the slanting surfaces.

The rod can be retracted, for example, by pulling the rod downward or by pushing the ring assembly upward. The rod can go straight down.

In FIG. 21C(d), the protruded element can go directly from the top valleys onto a high end of a slanting surface of the first ring. Due to the slanting surface, the protruded element can run, such as slide or roll, along the slanting surface to reach the bottom of the slanting surface, e.g., the valleys between two adjacent slanting surfaces of the first ring.

In FIG. 21C(e), the protruded elements can rest at the valley of two adjacent slanting surfaces of the first ring. The rod has been rotating an additional angle, such as 45 degrees as shown, due to the movements of the protruded elements along the slanting surfaces.

Thus the slanting surfaces of the first ring can be configured to face the valleys of the second ring, so that when the rod is pushed toward the first ring, the protruded elements can move straight down from the valleys, and then run along the slanting surfaces to reach the valleys of the first ring. The rod is then rotated due to the running of the protruded elements along the slanting surfaces.

Thus, by pushing and then releasing the rod, the rod can rotate, such as 90 degrees by two increments of 45 degrees through a set of slanting surfaces on the first and second rings. The 90 degrees rotation can present the shorter portion of the rod as shown, from the longer portion earlier. The shorter portion can be configured to disable the lock mechanism, e.g., the rod is free to move out of the rod receptacle.

Repeating the pushing and then releasing the pusher can repeat the action of rotating the rod another 90 degrees, thus can return the rod to its original configuration, e.g., presenting the longer portion.

In some embodiments, the ring in the first and second rings can include any object having a hollow center for accommodating a rod, such as a ring, a hollow cylinder, or a donut shape.

FIGS. 22A-22C illustrate flow charts for forming a locking mechanism according to some embodiments. In FIG. 22A, operation 2200 forms two slanting surfaces facing each other, and sandwiching and surrounding a contact element, wherein the contact element is configured so that when the contact element moves toward a first slanting surface, the contact element moves along the slanting surface to rotate a first angle, wherein the contact element is configured so that when the contact element moves in an opposite direction toward a second slanting surface, the contact element moves along the slanting surface to rotate a second angle.

In FIG. 22B operation 2220 forms a rod having a latchable element at one end and a protruding pin near an opposite end, wherein the rod is surrounded by two rings having slanting surfaces, wherein the rod is disposed so that the protruding pin is located between the slanting surfaces, wherein the slanting surfaces are configured so that the rod rotates when the protruding pin contacts the slanting surfaces.

In FIG. 22C, operation 2240 forms multiple first slanting surfaces surrounding a rod, and forms multiple second slanting surfaces surrounding the rod and facing and spaced from the first slanting surfaces, wherein the rod comprises a latchable element at one end, wherein the rod comprises a protruding pin near an opposite end, wherein the protruding pin is disposed between the first and second slanting surfaces.

Figure 23A:
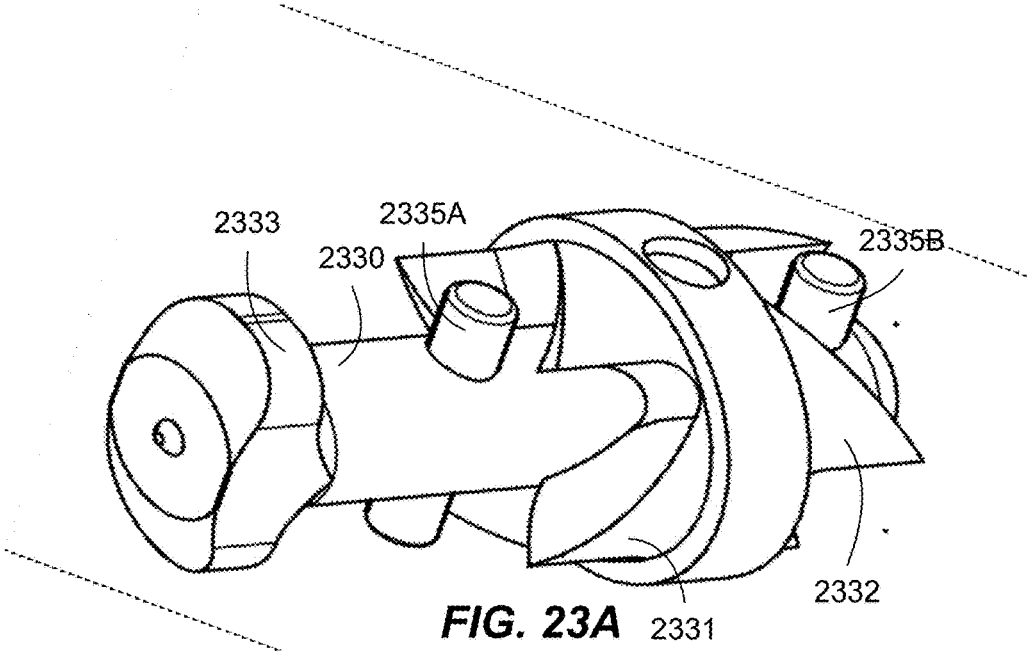
FIGS. 23A-23C illustrate a schematic configuration for another locking mechanism according to some embodiments.
Figure 23B:
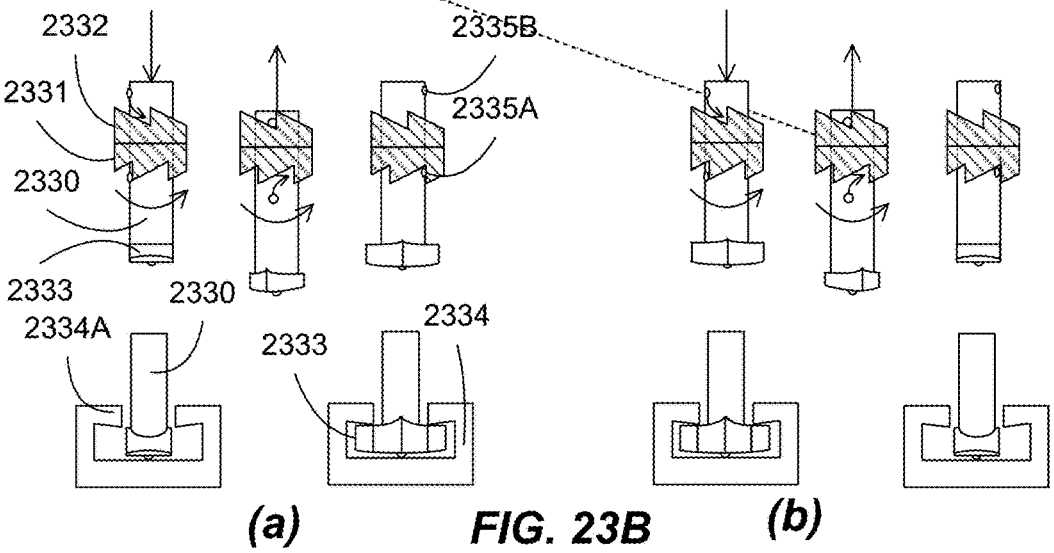
Figure 23C:
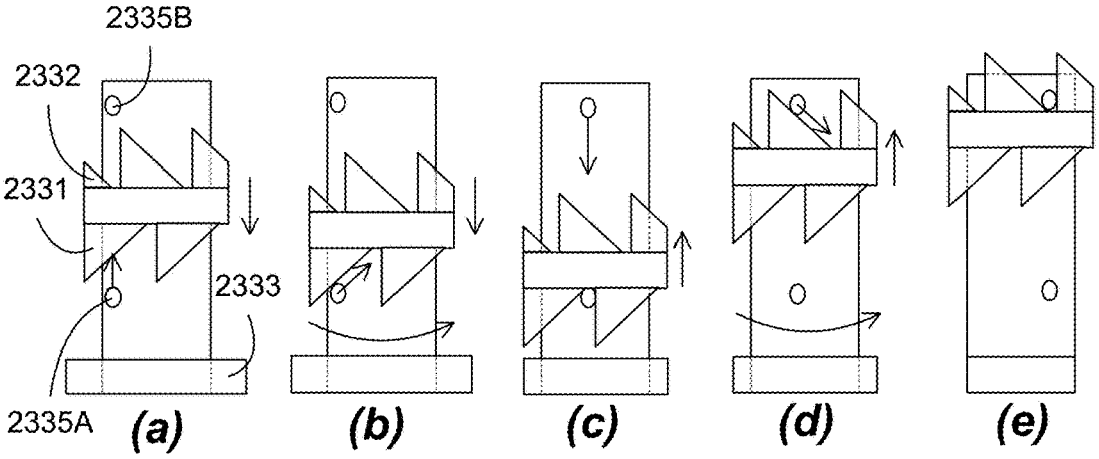

FIGS. 23A-23C illustrate a schematic configuration for another locking mechanism according to some embodiments. The locking mechanism can include two lockable elements, such as a rod with a hook end, and a hook receptacle. Two slanting surface elements with slanting surfaces facing away from each other can interact with two sets of protruded elements for rotating the rod.

FIG. 23A shows a schematic detail of a locking mechanism using slanting interfaces. The locking mechanism can include a hook receptacle 2334, a slanting surface interacting element 2330, e.g., a rod 2330, together with slanting surface elements 2331 and 2332, e.g., rings each having at least a slanting surface.

One end of the rod can include a hook end 2333 for mating with a hook receptacle. The rod 2330 can include two sets of protruded elements 2335A and 2335B, which can be a rod passing through the rod, together with optional rollers coupling to the rod ends. The protruded element can interface with the slanting surfaces of the slanting surface elements 2331 and 2332.

The slanting surfaces, such as the spiral surfaces of the first and second rings, can be facing away from each other. The slanting surface of each ring can be configured to interface with a set of protruded element, to provide a torque to rotate the rod through the cylindrical pins.

FIGS. 23B(a) and 23B(b) show schematics for the locking mechanism to toggle from an unlocked status to a locked status, and from a locked status to an unlocked status.

In FIG. 23B(a), the locking mechanism can change status from an unlocked status, in which the rod is free to move relative to the hook receptacle, to a locked status, in which the rod is locked in the hook receptacle.

A relatively downward force can be applied to the rod toward the ring assembly of the first ring 2331 and second ring 2332 having slanting surfaces facing away from each other.

The first set of the protruded element can be away from the slanting surface of the second ring 2332. The force can push the first set of the protruded element to be in contact with a high end of a spiral surface of the second ring 2332, and can move from a high end to a low end, partially rotating the rod.

A relatively second upward force can then be applied to the rod. The force can push the second set of the protruded element to be in contact with a high end of a spiral surface of the first ring 2331, and can move from a high end to a low end, partially rotating the rod. The two partial rotations can rotate the rod 90 degrees, changing the rod from an unlock status to a lock status.

In FIG. 23B(b), the locking mechanism can change status from a locked status, in which the rod is locked in the hook receptacle, to an unlocked status, in which the rod is free to move relative to the hook receptacle.

A relatively downward force can be applied to the rod. The first set of the protruded element can be away from the spiral surface of the second ring 2332. The force can push the second set of the protruded element to be in contact with a high end of a spiral surface of the second ring 2332, and can move from a high end to a low end, partially rotating the rod.

A relatively second upward force can then be applied to the rod. The force can push the second set of the protruded element to be in contact with a high end of a spiral surface of the first ring 2331, and can move from a high end to a low end, partially rotating the rod. The two partial rotations can rotate the rod 90 degrees, changing the rod from an unlock status to a lock status.

Thus, the locking mechanism can have a toggle action, in which repeatedly pushing and pulling the ring assembly (or the rod) of the locking mechanism to rotate the rod 90 degrees, e.g., can toggle the rod to be parallel (unlocked status) or to be perpendicular (locked status) to a surface.

FIGS. 23C(a)-23C(e) show a detail process for switching a locking mechanism from a lock status to an unlocked status. The figures show a process to rotate a rod of the locking mechanism 90 degrees. The rod can have two sets of protruded elements, with each set facing the slanting surface of the each ring. For example, a first set of protruded element can be below the slanting surface of the first ring 2331. A second set of protruded element can be above the slanting surface of the second ring 2331. The two sets of protruded elements can be disposed far enough from each other so that one set does not interfere with the interaction of the other set with the slanting surface.

In FIG. 23C(a), the rod 3530 is disposed between the slanting surfaces of first ring 3531 and the slanting surfaces of the second ring 3532.

A first set of protruded element 3535A can be disposed below a slanting surface of the first ring 2331. A second set of protruded element 3535B can be disposed above a slanting surface of the second ring 2332.

A force can be applied to push the rod upward, e.g., so that the first set of protruded element 2335A can move in a straight line to contact a high end of a slanting surface of the first ring 2331. The second set of protruded element is disposed far above the slanting surface of the second ring.

In FIG. 23C(b), the first set of protruded element can reach a high end of a slanting surface of the first ring 2331, as a result of the force pushing the rod relatively upward. The rod can be further pushed up. Due to the slanting surface, the first set of protruded element can run, such as slide or roll, along the slanting surface to reach the bottom of the slanting surface, e.g., the valley between two adjacent slanting surfaces of the first ring.

In FIG. 23C(c), the first set of protruded element can rest at the valley of two adjacent slanting surfaces of the second ring. The rod has been rotating an angle, such as 45 degrees as shown, due to the movements of the first set of protruded element along the slanting surfaces.

The rod can be retracted, for example, by pulling the rod downward or by pushing the ring assembly upward. The rod can go straight down.

In FIG. 23C(d), the second set of protruded element can go directly from above the slanting surface onto a high end of a slanting surface of the second ring. Due to the slanting surface, the protruded element can run, such as slide or roll, along the slanting surface to reach the bottom of the slanting surface, e.g., the valleys between two adjacent slanting surfaces of the second ring.

In FIG. 23C(e), the second set of protruded element can rest at the valley of two adjacent slanting surfaces of the second ring. The rod has been rotating an additional angle, such as 45 degrees as shown, due to the movements of the second set of protruded element along the slanting surfaces.

Repeating the pushing and then releasing the pusher can repeat the action of rotating the rod another 90 degrees, thus can return the rod to its original configuration, e.g., presenting the longer portion.

FIGS. 24A-24C illustrate flow charts for forming a locking mechanism according to some embodiments. In FIG. 24A, operation 2400 forms two slanting surfaces facing away from each other, and surrounding a contact element, wherein the contact element is configured to sandwich the two slanting surfaces, wherein the contact element is configured so that when the contact element moves toward a first slanting surface, the contact element moves along the slanting surface to rotate a first angle, wherein the contact element is configured so that when the contact element moves in an opposite direction toward a second slanting surface, the contact element moves along the slanting surface to rotate a second angle.

In FIG. 24B operation 2420 forms a rod having a latchable element at one end and two protruding pins, wherein the rod is surrounded by a ring having two facing away slanting surfaces, wherein the rod is disposed so that the two slanting surfaces is located between the two protruding pins, wherein the slanting surfaces are configured so that the rod rotates when the protruding pins contacts the slanting surfaces.

In FIG. 24C, operation 2440 forms multiple first slanting surfaces surrounding a rod, and forms multiple second slanting surfaces surrounding the rod and facing away and spaced from the first slanting surfaces, wherein the rod comprises a latchable element at one end, wherein the rod comprises two protruding pins, wherein the first and second slanting surfaces are disposed between the protruding pins.

In some embodiments, the slanting interfaces can be configured to provide a locking mechanism with rotational movements of a locking element, such as the rod coupled to the mover, without the linear movements such as the extension of retraction of the locking element.

Figure 25A:
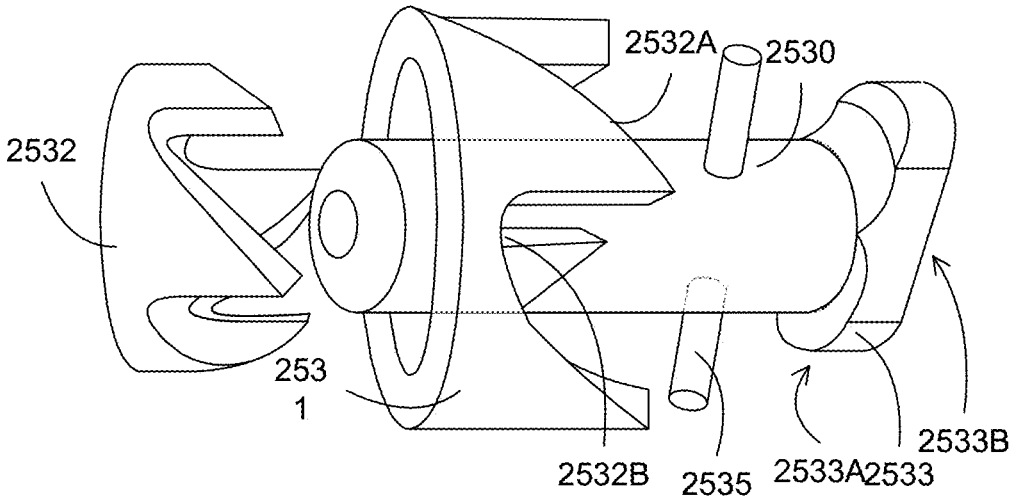
FIGS. 25A-25C show a schematic detail of a locking mechanism using slanting surfaces.
Figure 25B:
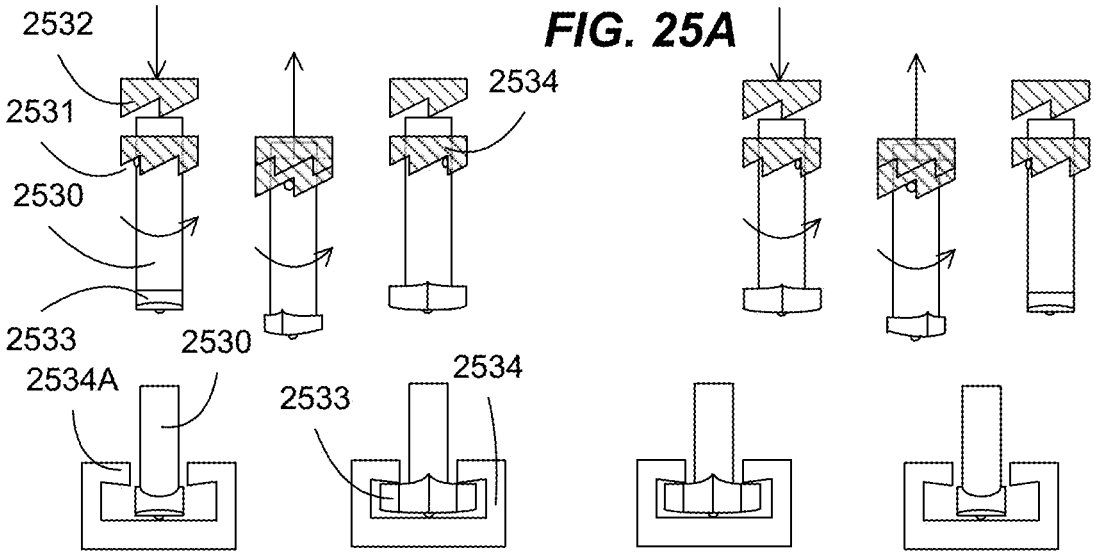
Figure 25C:
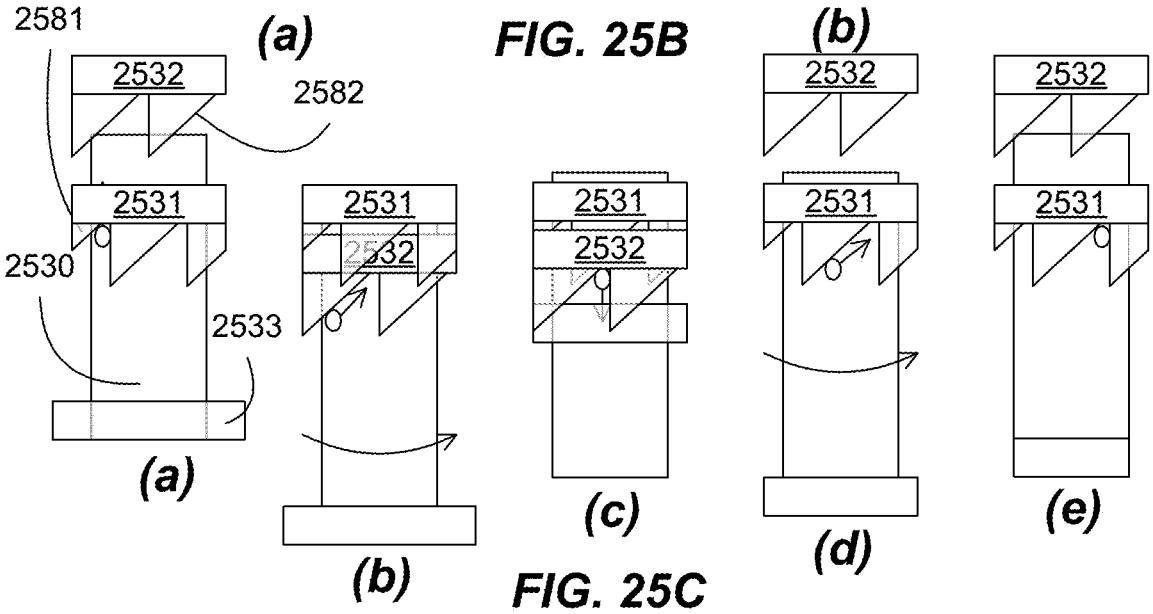

FIGS. 25A-25C show a schematic detail of a locking mechanism using slanting surfaces. The locking mechanism can include two lockable elements. A first lockable element can include a hook receptacle, which can include parallel hook ends. A second lockable element can include a slanting surface interacting element 2530 together with slanting surface elements 2531 and 2532 each having at least a slanting surface.

A lockable element of a locking mechanism can include a slanting surface interacting element, such as a rod 2530. One end of the rod can include a hook end 2533, which can include a perpendicular elongated portion having a longer side 2533A and a shorter side 2533B. The longer side can be latched in the hook receptacle, with the longer side mated with the hook ends 2534A of the hook receptacle 2534. When the longer side of the rod end 2533 is mated with the hooks, the rod receptacle 2534 can be locked to the rod, e.g., the locking mechanism is enabled (FIG. 25A).

The shorter side can be free to move in out of the hook receptacle, since the separation between the hook ends 2534A is bigger than the shorter side of the elongated end of the rod. By rotating the rod, such as a 90 degree angle, the status of the lock can be toggle between locked and unlocked, e.g., the rod is locked to the hook receptacle, and the rod is free to move in and out of the hook receptacle. When the shorter side of the rod end 2533 is inside the rod receptacle, the hooks do not capture the rod, and thus the rod receptacle 2534 can move relative to the rod, e.g., the locking mechanism is disabled.

The rod 2530 can include a protruded element 2535, which can be a protruded pin passing through the rod, together with optional rollers coupling to the pin ends. The protruded element can interface with the slanting surfaces of the slanting surface elements 2531 and 2532. The slanting surface elements 2531 and 2532 can include rings having slanting surfaces in the form of spiral surfaces. The protruded element can be facing the spiral surfaces, e.g., sandwiching between the spiral surface of the first rings 2531 and the spiral surface of the second rings 2532.

The spiral surfaces of the first and second rings can be facing in a same direction, and can be configured to provide a torque to rotate the rod through the cylindrical rods. For example, the second ring can be pushed toward the rod, with the cylindrical pins then contact the spiral surfaces of the second ring. Due to the spiral surfaces, the cylindrical protruded pins can slide or roll on the spiral surface, effectively rotating the rod an angle corresponded to the amount of the cylindrical pins sliding or rolling on the spiral surface, from the point of contact to the point of rest at the bottom of the spiral surfaces.

The second ring can be retracted, e.g., the force pushing on the second ring can be released and the second ring can be pushed back, for example, by gravitation or by the rod hooked into the hook or by a spring mechanism. The cylindrical pins then can be configured to contact the spiral surfaces of the first ring. Due to the spiral surfaces, the cylindrical pins can slide or roll on the spiral surface, effectively rotating the rod another angle corresponded to the amount of the cylindrical pins sliding or rolling on the spiral surface, from the point of contact to the point of rest at the bottom of the spiral surfaces. Thus, by pushing and releasing, the rod can rotate an angle, such as a 90 degrees angle.

FIGS. 25B(a) and 25B(b) show schematics for the locking mechanism to toggle from an unlocked status to a locked status, and from a locked status to an unlocked status.

In FIG. 25B(a), the locking mechanism can change status from an unlocked status, in which the rod is free to move relative to the hook receptacle, to a locked status, in which the rod is locked in the hook receptacle.

A force can be applied to a second ring 2532. The protruded element can be rested on a low end of the spiral surface of the first ring 2531. The force can push the protruded element to be in contact with a high end of a spiral surface of the second ring 2532, and can move from a high end to a low end, partially rotating the rod.

A second force can then be applied to the second ring to retract the second ring. The protruded element to be in contact with a high end of a spiral surface of the first ring 2531, and can move from a high end to a low end, partially rotating the rod. The two partial rotations can rotate the rod 90 degrees, changing the rod from an unlock status to a lock status.

In FIG. 25B(b), the locking mechanism can change status from a locked status, in which the rod is locked in the hook receptacle, to an unlocked status, in which the rod is free to move relative to the hook receptacle.

A force can be applied to the second ring 2532. The protruded element can be rested on a low end of the spiral surface of the first ring 2531. The force can push the protruded element to be in contact with a high end of a spiral surface of the second ring 2532, and can move from a high end to a low end, partially rotating the rod.

A second force can then be applied to the second ring to retract the second ring. The protruded element can be in contact with a high end of a spiral surface of the first ring 2531, and can move from a high end to a low end, partially rotating the rod. The two partial rotations can rotate the rod 90 degrees, changing the rod from an unlock status to a lock status.

Thus, the locking mechanism can have a toggle action, in which repeatedly pushing and pulling the ring assembly (or the rod) of the locking mechanism to rotate the rod 90 degrees, e.g., can toggle the rod to be parallel (unlocked status) or to be perpendicular (locked status) to a surface.

FIGS. 25C(a)-25C(e) show a detail process for switching a locking mechanism from a lock status to an unlocked status. The figures show a process to rotate a rod of the locking mechanism 90 degrees. If the rod end has a shorter portion contacting a rod receptacle, the rotation can turn the rod to have a longer portion contacting the rod receptacle, for securing the locking mechanism and disabling the linkage mechanism. If the rod end has a longer portion contacting a rod receptacle, the rotation can turn the rod to have a shorter portion contacting the rod receptacle, for releasing the locking mechanism and enabling the linkage mechanism.

In some embodiments, the rings 2531 and 2532 can each have 4 slanting surfaces disposed around a periphery of the rings. Thus, each slanting surface corresponds to 90 degrees separation, e.g., a low end of the previous slanting surface is separated 90 degrees from a low end of the next slanting surface on a ring. The protruded element thus can start from a low end of the first ring (FIG. 25C(a)), then moving straight from the low end to a high end of the second ring (FIG. 25C(b)), then moving along the slanting surface to a low end of the second ring (FIG. 25C(c)), then returning straight to a high end of the first ring (FIG. 25C(d)), and moving along the slanting surface to a low end of the first ring (FIG. 25C(a)).

In FIG. 25C(a), the rod 3530 is disposed outside the slanting surfaces of first ring 3531 and the slanting surfaces of the second ring 3532. For example, the first and second rings can have a hollow cylindrical shape, with the rod disposed in the hollow area so that the rod can travel and interact with the first and second rings. The rod can include protruded elements 3535, such as two protruded elements at opposite sides of the rod. The protruded elements can include cylindrical pins, rollers, elliptical pins, or any shape protrusions that can slide along the slanting surfaces of the first and second rings.

The protruded element 3535 can be disposed at a bottom of a slanting surface 3581 of the first ring, e.g., at a valley formed by two adjacent slanting surfaces of the first ring, for example, by applying a downward force to the rod or an upward force to the ring assembly. The rod cannot retract any further, since the protruded element stops the rod from going further.

The second ring can be pushed down.

In FIG. 25C(b), due to the slanting surface, the protruded elements can run, such as slide or roll, along the slanting surface to reach the bottom of the slanting surface, e.g., the valley between two adjacent slanting surfaces of the second ring.

In FIG. 25C(c), the protruded elements can rest at the valley of two adjacent slanting surfaces of the second ring. The rod has been rotating an angle, such as 45 degrees as shown, due to the movements of the protruded elements along the slanting surfaces.

Thus the slanting surfaces of the second ring can be configured to face the valleys of the first ring, so that when the second ring is pushed toward the rod, the protruded elements can move straight up from the valleys, and then run along the slanting surfaces to reach the valleys of the second ring. The rod is then rotated due to the running of the protruded elements along the slanting surfaces.

The second ring can be retracted, for example, by pulling the second ring upward.

In FIG. 25C(d), the protruded element can go directly from the top valleys onto a high end of a slanting surface of the first ring. Due to the slanting surface, the protruded element can run, such as slide or roll, along the slanting surface to reach the bottom of the slanting surface, e.g., the valleys between two adjacent slanting surfaces of the first ring.

In FIG. 25C(e), the protruded elements can rest at the valley of two adjacent slanting surfaces of the first ring. The rod has been rotating an additional angle, such as 45 degrees as shown, due to the movements of the protruded elements along the slanting surfaces.

Thus the slanting surfaces of the first ring can be configured to face the valleys of the second ring, so that when the rod is pushed toward the first ring, the protruded elements can move straight down from the valleys, and then run along the slanting surfaces to reach the valleys of the first ring. The rod is then rotated due to the running of the protruded elements along the slanting surfaces.

Thus, by pushing and then releasing the second ring, the rod can rotate, such as 90 degrees by two increments of 45 degrees through a set of slanting surfaces on the first and second rings. The 90 degrees rotation can present the shorter portion of the rod as shown, from the longer portion earlier. The shorter portion can be configured to disable the lock mechanism, e.g., the rod is free to move out of the rod receptacle.

Repeating the pushing and then releasing the pusher can repeat the action of rotating the rod another 90 degrees, thus can return the rod to its original configuration, e.g., presenting the longer portion.

FIGS. 26A-26C illustrate flow charts for forming a locking mechanism according to some embodiments. In FIG. 26A, operation 2600 forms two slanting surfaces facing a same direction, and sandwiching and surrounding a contact element, wherein the contact element is configured so that when a first slanting surface moves toward the contact element, the contact element moves along the first slanting surface to rotate a first angle, wherein the contact element is configured so that when the first slanting surface retracts, the contact element moves along the second slanting surface to rotate a second angle.

In FIG. 26B operation 2620 forms a rod having a latchable element at one end and a protruding pin near an opposite end, wherein the rod is surrounded by two rings having slanting surfaces, wherein the rod is disposed facing the slanting surfaces, wherein the slanting surfaces are configured so that the rod rotates when a slanting surface moves forward to contact the protruding pin or retracts so that the protruding element contacts the other slanting surfaces.

In FIG. 26C, operation 2640 forms multiple first slanting surfaces surrounding a rod, and forms multiple second slanting surfaces surrounding the rod and facing a same direction and spaced from the first slanting surfaces, wherein the first slanting surfaces are movable relative to the second slanting surfaces, wherein the rod comprises a latchable element at one end, wherein the rod comprises a protruding pin near an opposite end, wherein the protruding pin is disposed facing the first and second slanting surfaces.

FIGS. 27A-27D illustrate a clamping device having a toggling locking mechanism according to some embodiments. A clamping device 2700 can be used for lifting and transferring objects, using a half scissor linkage mechanism in which an arm assembly is configured to move a movable jaw against a translational stationary jaw for clamping on an object. The linkage mechanism can include a clamping mechanism in which an arm assembly having two scissor arms, each can pivot around a pivot point on a body of the clamping device. One ends of the scissor arms can be coupled together to a pulling element 2730, e.g., a connecting bar coupled the ends of the scissor arms and can be configured as a hoist interface element for coupling to a hoist. The other ends of the scissor arms can be coupled to a movable jaw. When the pulling element is pulled up with respect to the pivot point, the pulling force on the ends of the scissor arms can move the movable jaw toward a fixed jaw for clamping on an object disposed between the jaws. When the pulling element is lowered down with respect to the pivot point, the scissor arms can rotate around the pivot points to move the movable jaw away from the translational stationary jaw to separate the distance between the jaws, effectively releasing the object.

An automatic locking mechanism can be installed in the clamping device. The automatic locking mechanism can be configured to enable and disable the linkage mechanism, such as the clamping mechanism in the clamping device. For example, the locking mechanism can lock a component of the linkage mechanism to a body of the clamping device, thus can effectively prevent the linkage mechanism from moving. In this state, the clamping device cannot actuate the jaws by pulling or lowering the pulling device.

A clamping device can have an automatic locking mechanism 2750, which can include 2 portions 2784 and 2785, which can be mated together (in locked or engaged stated), or can be separated from each other (in unlocked or disengaged state). The locking mechanism can be a toggle mechanism, which can change between locked and unlocked states after being triggered or activated. The trigger or activation can be a force acting on one or both portions 2784 and 2785 of the locking mechanism. With the locking mechanism incorporated into the clamping device, a force on the pulling element can activate the toggling process between the locked and unlocked states.

The locking mechanism can include a hook rod 2783 and a mating hook receptacle 2786. The hook rod can have a hook end 2783A, such as an asymmetric shape, e.g., a shape having an elongated portion and a shortened portion, such as an oval or a rectangular shape. The hook receptacle can have a mating hook end 2786A that is configured to hook/lock or unhook/unlock on the hook end of the hook rod. Thus, when the rod rotates, the locking (hooked) and unlocking (released) states can be toggled. For example, the rod can be positioned so that the elongated portion of the hook end engaged with the mating hook end of the hook receptacle, locking the rod with the hook receptacle. When the rod rotates 90 degrees, the elongated portion is now parallel with the hook receptacle, and the shortened portion does not engage with the hook end of the hook receptacle. This releases the rod from the hook receptacle. Rotating the bolt 90 degrees again, in either rotation direction, can re-engage the lock by mating the elongated portion with the hook.

The automatic locking mechanism can include two slanting surface elements, such as rings 2781 and 2782 each having one or more slanting surface in the form of spiral surfaces. The hook rod can be disposed between the rings and can travel along an axis of the rings. One or more slanting surface interacting element, such as protruded element 2787, can be disposed facing the slanting surfaces of the rings. Other configurations of the slanting surface rings and rod can be used, such as a ring having two slanting surfaces facing outward, or two rings moving relative to each other with slanting surfaces facing a same direction.

As shown, the rings can be configured so that the slanting surfaces are facing each other, with the protruded element disposed between the slanting surfaces. The protruded element can move toward the first ring, in a first direction, for interacting with the slanting surfaces of the first ring. The protruded element can move toward the second ring, in an opposite direction with the first direction, for interacting with the slanting surfaces of the second ring.

Alternatively, the rings can be configured so that the slanting surfaces are facing away from each other. There can be two protruded elements, with a first protruded element disposed facing the slanting surfaces of the first ring, and a second protruded element disposed facing the slanting surfaces of the second ring. The first protruded element can move toward the first ring, in a first direction, for interacting with the slanting surfaces of the first ring. The second protruded element can move toward the second ring, in an opposite direction with the first direction, for interacting with the slanting surfaces of the second ring.

FIG. 27A shows a clamping device having an automatic locking mechanism 2750. The top portion 2784 of the locking mechanism is coupled to a pulling element 2730 of the clamping device. The bottom portion 2785 of the locking mechanism is coupled to a body 2715 of the clamping device. As shown, the locking mechanism is in an engaged state, e.g., the top portion 2784 is locked to the bottom portion 2785. Thus, the pulling element is coupled to the body of the clamping device, with only limited movements as configured by the locking mechanism. For example, the pulling element is fixedly coupled to the rings, and the body can be fixedly coupled to the mating hook receptacle. The rod 2783 is coupled to the rings, but can move between the slanting surfaces of the first and second rings 3581 and 2782, for toggling the locking status of the locking mechanism. Since the rod can be coupled to the mating hook receptacle, the pulling element can move with respect to the body of the clamping device as much as the rod can move within the rings for activating or deactivating the locking mechanism.

Due to the locked status of the locking mechanism, the pulling element is coupled to the clamping device body, e.g., having limited movements provided by the rod moving between the rings. The coupling of the pulling element to the clamping device body can keep the jaws immobilized at a large separation, in order to accept an object between the jaws.

The clamping device can be brought down, for example, by lowering a hoist coupled to the pulling element. An object can be positioned between the open jaws of the clamping device.

The hoist can lower further, after the clamping device has contacted the object. Since the clamping device has contacted the object, lowering the hoist does not move down the body of the clamping device. Instead, lowering the hoist can move the pulling element down. The pulling element 2730 can move down with respect to the body 2715. The movement of the pulling element can move the ring assembly down, until the protruded element in the rod contact the slanting surface of the top (or second) ring. The rod can rotate an angle such as 45 degrees.

In FIG. 27B, the hoist can lift up. The pulling element can move up with respect to the body. The movement of the pulling element can move the ring assembly up. The rod is still partially hooked in the hook receptacle (since the rod rotates less than 90 degrees), thus the rod moves with respect to the ring assembly, until the protruded elements in the rod contact the slanting surface of the bottom (or first) ring. The rod can rotate another angle such as 45 degrees. The rod can thus rotate a complete angle of 90 degrees, which can switch the locked status to the unlocked status, since the hook end of the rod is no longer be constrained by the hook end of the hook receptacle after a 90 degree rotation.

In FIG. 27C, the hoist can further lift up. Since the locking mechanism is now disabled, pulling on the pulling element can activate the jaws for clamping on the object. The hoist can move to a destination at which the object can be released.

Thus, by bring down and then bring up the pulling element, the locking mechanism rotates to change state from a locked state to an unlock state (FIG. 27D). There can be pauses between the steps.

FIGS. 28A-28D illustrate another toggling configuration of the locking mechanism according to some embodiments. A clamping device 2800 can have scissor arms pivotable each around a pivot point, linking a pulling element 2830 to two opposite jaws, similar to the clamping device described above.

The clamping device can have an automatic locking mechanism 2850, which can include a first portion 2884 and a second portion 2885. The locking mechanism can include a hook rod 2883 having a hook end 2883A and a mating hook receptacle 2886 having a hook end 2886A. The locking mechanism can include two slanting surface elements, such as rings 2881 and 2882. One or more slanting surface interacting element, such as protruded element 2887 in the hook rod, can be disposed facing the slanting surfaces of the rings.

FIG. 28A shows a clamping device having an automatic locking mechanism 2850. The top portion 2884 of the locking mechanism is coupled to a pulling element 2830 of the clamping device. The bottom portion 2884 of the locking mechanism is coupled to the body 2815 of the clamping device. As shown, the locking mechanism is in a disengaged state, e.g., the top portion 2884 is loose from the bottom portion 2885. Thus, the pulling element is free to move with respect to the pivot point 2831, e.g., to the body of the clamping device.

Due to the unlocked status of the locking mechanism, a hoist coupled to the pulling element can lift the clamping device with the jaws clamped on an object. The clamping device can be brought down, for example, by lowering the hoist. Without touching the ground, the clamping device and the object move as a unit, through the action of the hoist.

In FIG. 28B, the hoist can bring the clamping device, together with the clamped object, to a destination. The hoist can be lowered to place the object on the ground.

The hoist can lower further, after the object has contacted the ground. Since the object has contacted the ground, lowering the hoist does not move down the body of the clamping device. Instead, lowering the hoist can move the pulling element down. The pulling element can move down with respect to the body. The movement of the pulling element can move the first portion 2884 of the locking mechanism down, until the rod contact the mating hook receptacle. Since the locking mechanism is in unlocked state, lowering the pulling element can separate the jaws to release the clamping action on the object. Further, the hook end of the hook rod can enter the hook end of the hook receptacle (without being hooked).

The hoist can lower further, after the hook end of the hook rod has contacted the bottom surface of the hook receptacle. The pulling element is further lowering down, bringing the ring assembly (the first ring 2831 and the second ring 2832, which is coupled as a unit) down with respect to the hook rod, until the protruded element in the rod contact the slanting surface of the top (or second) ring 3632. The rod can rotate 45 degrees, partially securing the hook end of the hook rod with the hook end of the hook receptacle.

In FIG. 28C, the hoist can lift up. The pulling element can move up with respect to the body. The movement of the pulling element can move the ring assembly up. The rod is hooked in the hook receptacle (by a partial rotation of the hook end), thus the ring assembly can move up relative to the rod, until the protruded element in the rod contact the slanting surface of the bottom (or first) ring 2831. The rod can rotate another angle such as 45 degrees. The rod can thus rotate a complete angle of 90 degrees, which can switch the unlocked status to the locked status, since the hook end of the rod is now fully constrained by the hook end of the hook receptacle after a 90 degree rotation.

The hoist can further lift up and move to a new object for pick up. Since the locking mechanism is locked, the jaws remain separated for ease of accepting the object.

Thus, by bring down and then bring up the pulling element, the locking mechanism rotates to change state from an unlocked state to a lock state (FIG. 28D). In combination with the process of changing the state from a locked state to an unlock state, an operator can toggle the locking mechanism between locked and unlocked states by bringing down followed by bringing up the pulling element or by the hoist coupled to the pulling element. There can be pauses between the step of bringing down and the step of bringing up.

FIGS. 29A-29D illustrate a clamping device having a toggling locking mechanism according to some embodiments. A clamping device 2900 can be used for lifting and transferring objects, using a half scissor linkage mechanism in which an arm assembly is configured to move a movable jaw against a translational stationary jaw for clamping on an object. The clamping device can be similar to the clamping devices described above.

An automatic locking mechanism can be installed in the clamping device. The locking mechanism can lock components of the linkage mechanism, such as securing two portions 2926 and 2925 of a scissor arm. When the portion 2926 is fixed with portion 2925, one end of the scissor arms cannot move when the pulling element is pulled up or lowered down, effectively disabling the linkage mechanism.

As shown, the rings can be configured so that the slanting surfaces are facing each other, with the protruded element disposed between the slanting surfaces. Alternatively, the rings can be configured so that the slanting surfaces are facing away from each other. There can be two protruded elements, with a first protruded element disposed facing the slanting surfaces of the first ring, and a second protruded element disposed facing the slanting surfaces of the second ring.

Figure 29A:
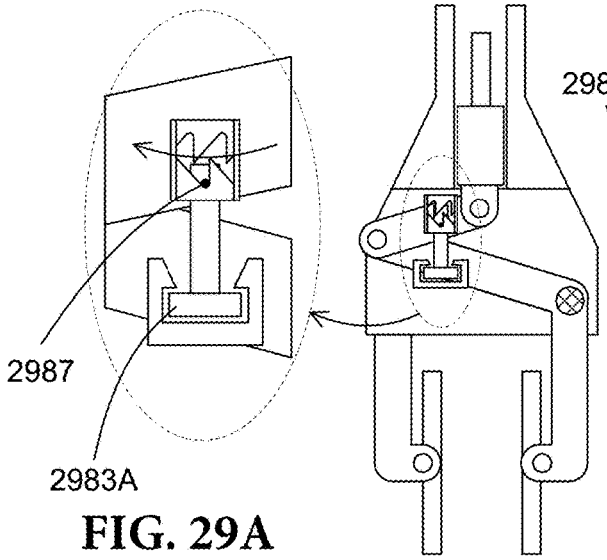
FIGS. 29A-29D illustrate a clamping device having a toggling locking mechanism according to some embodiments.

FIG. 29A shows a clamping device having an automatic locking mechanism 2980. The top portion 2984 of the locking mechanism is coupled to an arm segment 2926 of a scissor arm assembly of the clamping device. The bottom portion 2984 of the locking mechanism is coupled to another arm segment 2925 of the scissor arm assembly. As shown, the locking mechanism is in an engaged state, e.g., the top portion 2984 is locked to the bottom portion 2985. Thus, the pulling element is coupled to the pivot point 2931, e.g., to the body of the clamping device, with only limited movements as configured by the locking mechanism. For example, since the rod 2983 can move between the slanting surfaces of the first and second rings 3581 and 2982, for toggling the locking status of the locking mechanism, the pulling element can move with respect to the body of the clamping device for activating or deactivating the locking mechanism. Thus, in the present specification, components are locked together does not mean that the components are rigidly and fixedly attached to each other. The term "components are locked together" can mean that a component of the components cannot move freely relative to another component of the components, and can mean that the components can have limited movements relative to each other, as long as the lock functionality remains.

Due to the locked status of the locking mechanism, the pulling element is locked to the clamping device body. The coupling of the pulling element to the clamping device body can keep the jaws immobilized, except for limited movements as discussed before, at a large separation, in order to accept an object between the jaws.

The clamping device can be brought down, for example, by lowering a hoist coupled to the pulling element. The object 2920 can be positioned between the open jaws of the clamping device.

The hoist can lower further, after the clamping device has contacted the object. Since the clamping device has contacted the object, lowering the hoist does not move down the body of the clamping device. Instead, lowering the hoist can move the pulling element down. The first portion 2930A of the scissor arm can move down with respect to the second portion 2930B of the scissor arm. The movement of the first portion 2930A can move the ring assembly down, until the protruded element in the rod contact the slanting surface of the top (or second) ring 2932. The rod can rotate an angle such as 45 degrees.

Figure 29B:
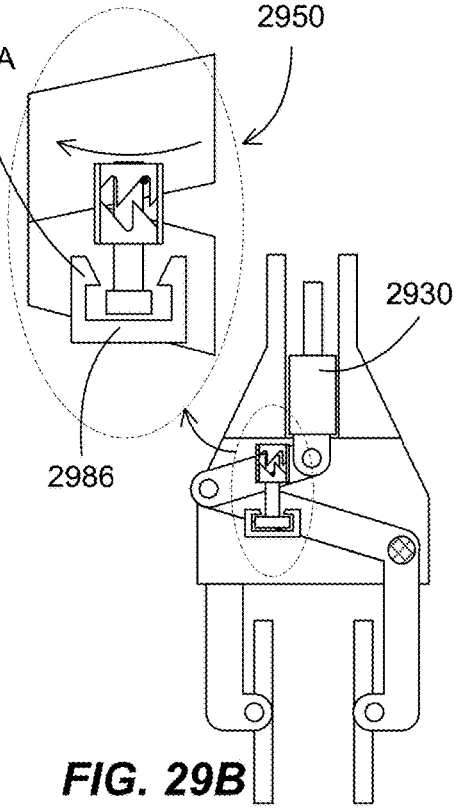

In FIG. 29B, the hoist can lift up. The first portion 2930A of the scissor arm can move up with respect to the second portion 2930B of the scissor arm. The movement of the first portion 2930A can move the ring assembly up, until the protruded element in the rod contact the slanting surface of the bottom (or first) ring 2931. The rod can rotate another angle such as 45 degrees. The rod can thus rotate a complete angle of 90 degrees, which can switch the locked status to the unlocked status, since the hook end of the rod is no longer be constrained by the hook end of the hook receptacle after a 90 degree rotation.

Figure 29C:
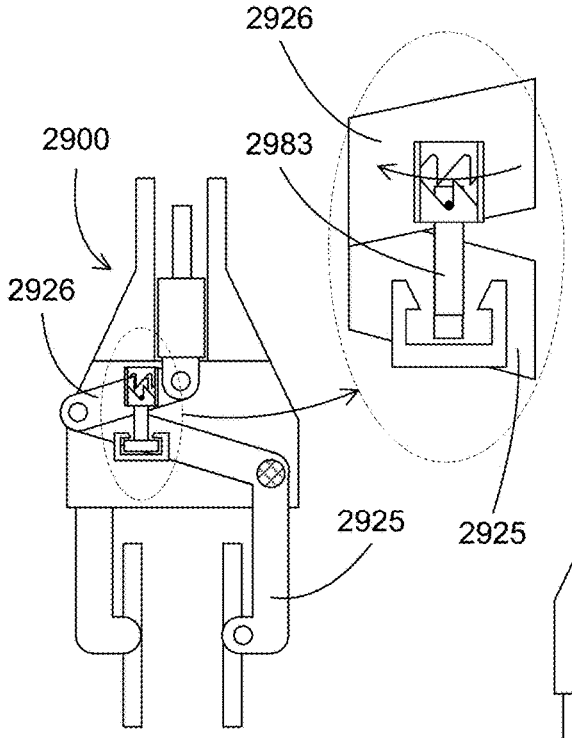

In FIG. 29C, the hoist can further lift up. Since the locking mechanism is now disabled, pulling on the pulling element can activate the jaws for clamping on the object.

Figure 29D:
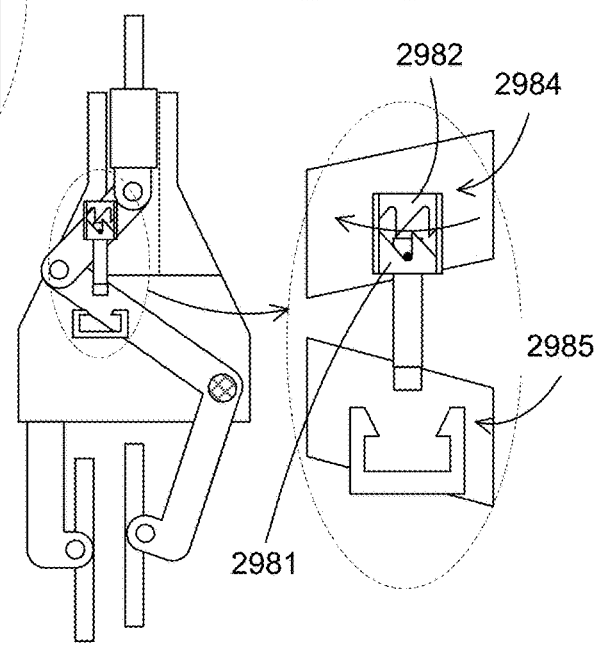

In FIG. 29D, after the jaws clamp on the object, the hoist can further lift up and move to a destination at which the object can be released.

Thus, by bring down and then bring up the pulling element, the locking mechanism rotates to change state from a locked state to an unlock state. There can be pauses between the steps.

FIGS. 30A-30D illustrate another toggling configuration of the locking mechanism according to some embodiments. A clamping device 3000 can have scissor arms each pivotable around a pivot point, linking a pulling element 3030 to two opposite jaws, similar to the clamping device described above.

The clamping device can have an automatic locking mechanism 3050, which can include a first portion 3084 and a second portion 3085. The locking mechanism can include a hook rod 3083 having a hook end 3083A and a mating hook receptacle 3086 having a hook end 3086A. The locking mechanism can include two slanting surface elements, such as rings 3081 and 3082. One or more slanting surface interacting element, such as protruded element 3087 in the hook rod, can be disposed facing the slanting surfaces of the rings.

Figures 30A, 30B, 30C, 30D:
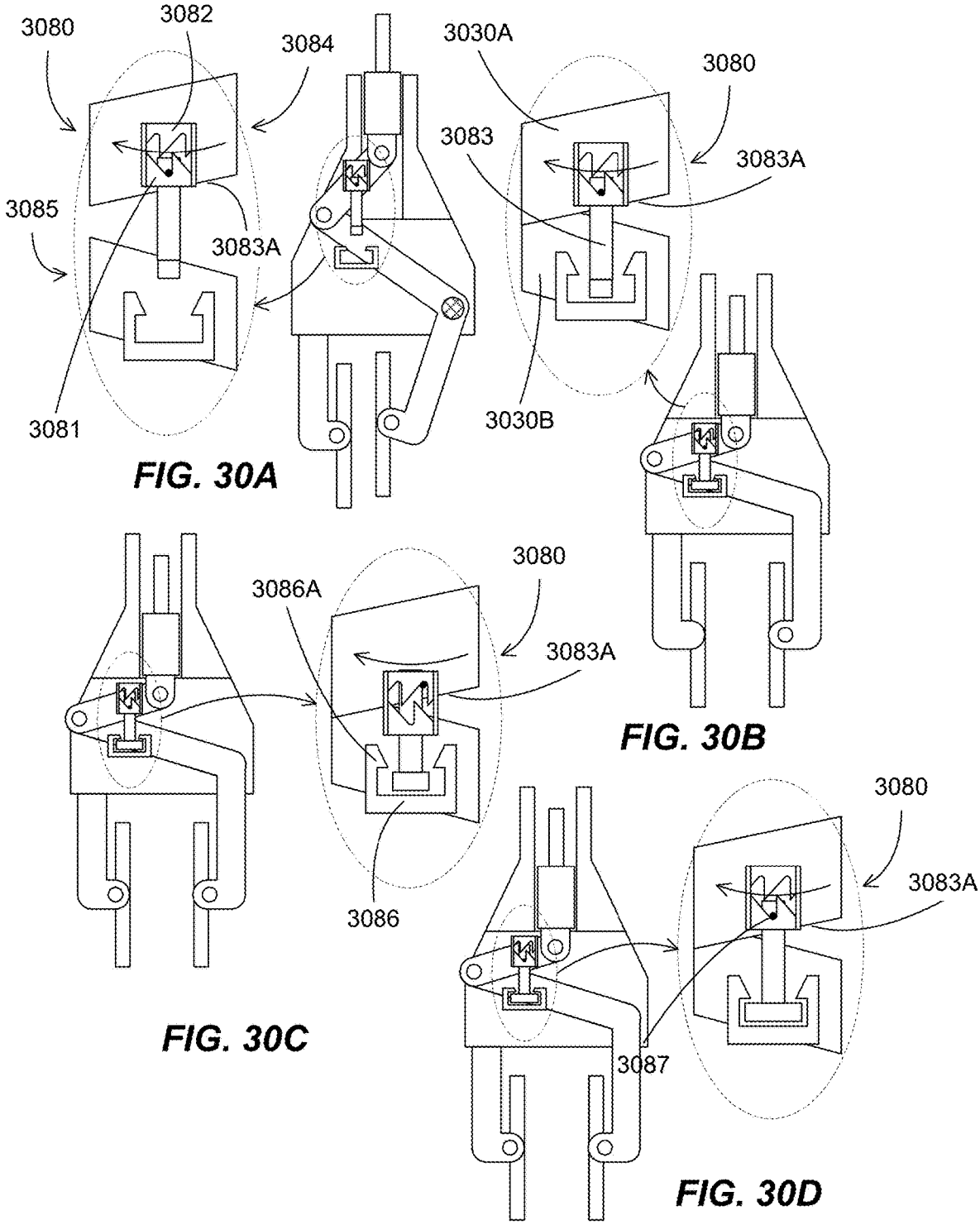
FIGS. 30A-30D illustrate another toggling configuration of the locking mechanism according to some embodiments.

FIG. 30A shows a clamping device having an automatic locking mechanism 3050. The top portion 3084 of the locking mechanism is coupled to an arm segment 3026 of the scissor arm assembly of the clamping device. The bottom portion 3084 of the locking mechanism is coupled to another arm segment 3025 of the scissor arm. As shown, the locking mechanism is in a disengaged state, e.g., the top portion 3084 can move freely from the bottom portion 3085. Thus, the pulling element is free to move with respect to the pivot point 3031, e.g., to the body of the clamping device.

Due to the unlocked status of the locking mechanism, a hoist coupled to the pulling element can lift the clamping device with the jaws clamped on object 3020. The clamping device can be brought down, for example, by lowering the hoist. Without touching the ground, the clamping device and the object move as a unit, through the action of the hoist.

In FIG. 30B, the hoist can bring the clamping device, together with the clamped object, to a destination. The hoist can be lowered to place the object on the ground.

The hoist can lower further, after the object has contacted the ground. Since the object has contacted the ground, lowering the hoist does not move down the body of the clamping device. Instead, lowering the hoist can move the pulling element down. The first portion 3030A of the scissor arm can move down with respect to the second portion 3030B of the scissor arm. The movement of the first portion 3030A can move the first portion 3084 of the locking mechanism down, until the rod contact the mating hook receptacle. Since the locking mechanism is in unlocked state, lowering the pulling element can separate the jaws to release the clamping action on the object. Further, the hook end of the hook rod can enter the hook end of the hook receptacle.

In FIG. 30C, the hoist can lower further, after the hook end of the hook rod has contacted the bottom surface of the hook receptacle. The pulling element is further lowering down, bringing the ring assembly (the first ring 3031 and the second ring 3032, which is coupled as a unit) down with respect to the hook rod, until the protruded element in the rod contact the slanting surface of the top (or second) ring 3632. The rod can rotate 45 degrees, partially securing the hook end of the hook rod with the hook end of the hook receptacle.

In FIG. 30D, the hoist can lift up. The first portion 3030A of the scissor arm can move up with respect to the second portion 3030B of the scissor arm. The movement of the first portion 3030A can move the ring assembly up, until the protruded element in the rod contact the slanting surface of the bottom (or first) ring 3031. The rod can rotate another angle such as 45 degrees. The rod can thus rotate a complete angle of 90 degrees, which can switch the unlocked status to the locked status, since the hook end of the rod is now fully constrained by the hook end of the hook receptacle after a 90 degree rotation.

The hoist can further lift up and move to a new object for pick up. Since the locking mechanism is locked, the jaws remain separated for ease of accepting the object.

Thus, by bring down and then bring up the pulling element, the locking mechanism changes state from an unlocked state to a lock state. In combination with the process of changing the state from a locked state to an unlock state, an operator can toggle the locking mechanism between locked and unlocked states by bringing down followed by bringing up the pulling element or by the hoist coupled to the pulling element. There can be pauses between the step of bringing down and the step of bringing up.

In some embodiments, the clamping device can include a guiding mechanism at the opening of the jaws. The guiding mechanism can be configured to guide an object to the space between the two jaws. For example, the object can be placed a little offset from the jaw opening, such as at the jaw or even further away from the jaw opening, thus might not be able to move into position. The guiding mechanism can assist the misplaced object, e.g., guiding the object to enter the space between the jaws. The guiding mechanism can be particularly useful when the object is large, e.g., a little less than the space between the jaws. Thus, without the guiding mechanism, it could be difficult to align the clamping device with the object.

In some embodiments, the guiding mechanism can include opposite rollers touching or separating a distance smaller than the space between the jaws. The guiding plates can be configured so that the exit of the guiding plates leads to the jaw space.

In some embodiments, the guiding mechanism can include opposite guiding plates with an opening larger than the space between the jaws. The rollers can be configured so that the separation between the rollers coincides with the separation of the jaws. When the object is in contact with the rollers, even if the object is offset from the jaws, the rollers can roll to guide the object to the center location. The amount of offset that the rollers can handle can depend on the diameter of the rollers, e.g., the larger the rollers are, the more offset the object can be and still be able to roll to the jaw space.

In some embodiments, a roller can be coupled to a jaw so that the edge of the roller is offset from the jaw toward the jaw opening.

In some embodiments, the guiding mechanism can include a limiter element, which can be used to limit a movement of the clamping device relative to an object, as to put the object into a proper position for entering the space between the jaws. The limiter element can be one directional, e.g., limiting the movement of the clamping device in one direction. For example, the limiter element can be coupled to a jaw nearest to an operator. The operator can guide the clamping device forward toward the object, with the jaw not having the limiter element leading the movement. When the limiter element is stopped by the object, the object can be at a position that can be received by the clamping device.

Figure 31A:
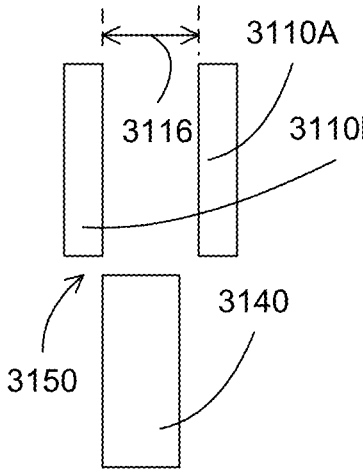
FIGS. 31A-31H illustrate configurations for guiding mechanisms according to some embodiments.

FIGS. 31A-31H illustrate configurations for guiding mechanisms according to some embodiments. In FIG. 31A, a clamping device can have two jaws 3110A and 3110B disposed facing each other, with a space 3116 between the jaws. The clamping device can be brought to an object 3140 for clamping on the object. The clamping device will need to be aligned with the object, e.g., the space between the jaws will need to cover the thickness of the object, e.g., the object is aligned to the space between the jaws. If the object is offset from the space between the jaws, such as one edge 3150 of the object is at a jaw, the clamping device might not be able to capture the object between the jaws. Operator assistance might be required.

Figure 31B:
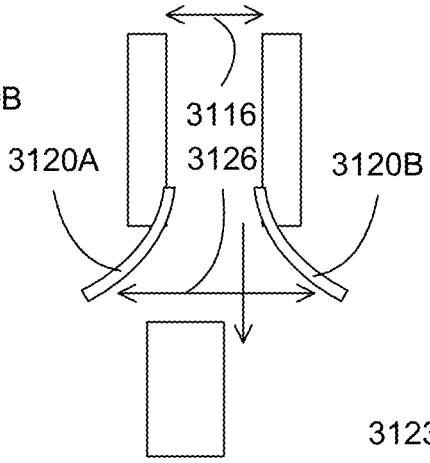

FIG. 31B shows a configuration for a guiding mechanism for guiding a clamping device onto the object. Two plates 3120A and 3120B can be coupled to the jaws of the clamping device. The plates can be configured to provide an opening 3126 larger than a separation 3116 of the jaws, and an exit leading to the space between the jaws. The plates can also be configured to provide a smooth transition from the opening to the exit. Thus an object disposed at the opening of the plates can be guided to the space between the jaws when the clamping device is lowered on the object.

Figure 31C:
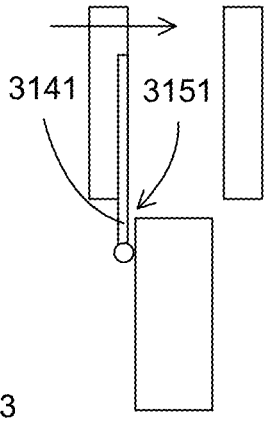

FIG. 31C shows a configuration for a guiding mechanism in the form of a limiter element. A limiter element 3141 can be coupled to a jaw of the clamping device, such as the fixed jaw. The limiter element can be configured to be positioned a little 3151 toward the space between the jaws. Thus, when the clamping device moves toward the object, the limiter element can be used to stop the movement of the clamping device, for example, when the object makes contact with the limiter element. Since the limiter element stops the object at a position before the edge of the jaw, the object can be located at the opening of the jaws, e.g., aligned to the space between the jaws. The clamping device can be lowered to accept the object.

Figure 31D:
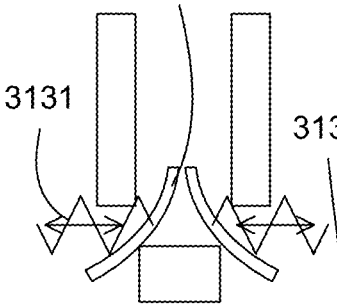

FIG. 31D shows a configuration for a guiding mechanism for guiding a clamping device onto the object. Two plates 3121 can be coupled to the jaws of the clamping device. Spring mechanism 3131 can be used to push the plates 3121 toward each other. An object disposed at the opening of the plates can be guided to the space between the jaws, after pushing apart the plates, when the clamping device is lowered on the object. The closeness of the plates 3121 can allow the plates to contact the object during the lowering of the clamping device, which can prevent the object from falling in the process of being guided by the plates into the space between the jaws.

Figure 31E:
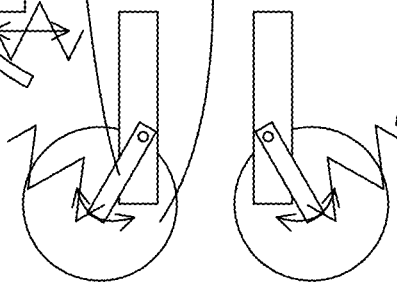

FIG. 31E shows a configuration for a guiding mechanism for guiding a clamping device onto the object. Two rollers 3122 can be coupled to the jaws of the clamping device. Spring mechanism 3132 can be used to rotate the rollers 3122 toward each other. An object disposed at the opening of the rollers can be rolled to the space between the jaws, after pushing apart the rollers, when the clamping device is lowered on the object. The closeness of the rollers 3122 can allow the rollers to contact the object during the lowering of the clamping device, which can prevent the object from falling in the process of being guided by the rollers into the space between the jaws.

Figure 31F:
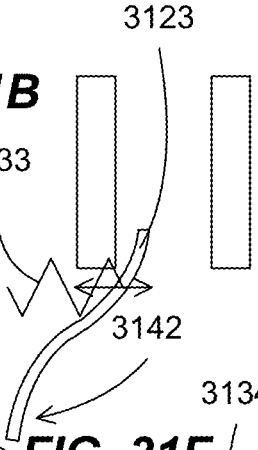

FIG. 31F shows a configuration for a guiding mechanism for guiding a clamping device onto the object. A plate 3123 can be coupled to a jaw of the clamping device. Optional spring mechanism 3133 can be used to push the plate 3123 toward the opposite jaw. The plate 3123 can include a limiter configuration 3142, which can stop an object so that the object is at the opening of the guiding plates. A second plate can be optionally added to the opposite jaw.

Figure 31G:
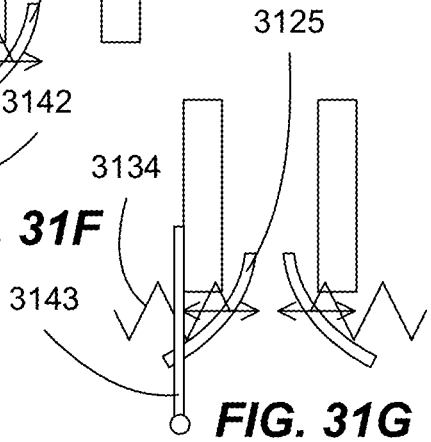

FIG. 31G shows a configuration for a guiding mechanism for guiding a clamping device onto the object. Two plates 3125 can be coupled to the jaws of the clamping device. Spring mechanism 3134 can be used to push the plates 3123 and 3124 toward each other. A limiter element 3143 can be coupled to one of the jaws. The limiter element 3143 can stop an object so that the object is at the opening of the guiding plates.

Figure 31H:
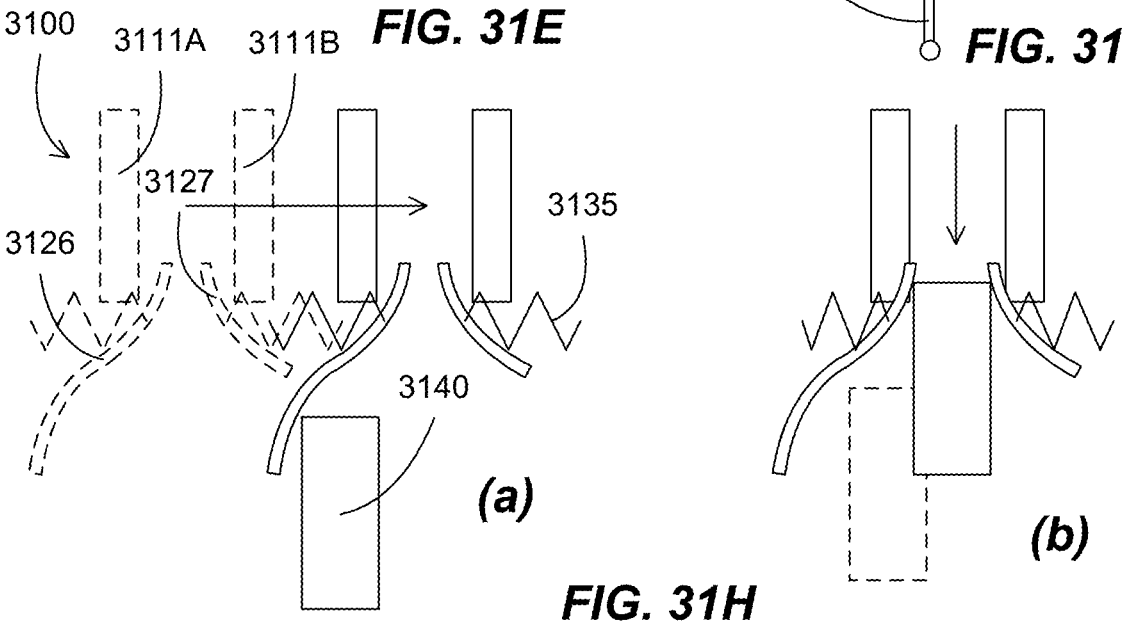

FIGS. 31H(a) and 31H(b) show a process for guiding a clamping device to align with an object. A clamping device 3100 can include two jaws 3111A and 3111B, and guiding plates 3126 and 3127, activated by spring mechanism 3135, with the guiding plate 3126 including a limiter configuration.

In FIG. 31H(a), the clamping device is moved, horizontally, to approach an object 3140. The clamping device can be stopped when the limiter configuration in guiding plate 3126 contacts the object.

In FIG. 31H(b), the clamping device is lowered to capture the object 3140 between the jaws. The object can be guided by the guiding plates to come to the space between the jaws.

Figure 32A:
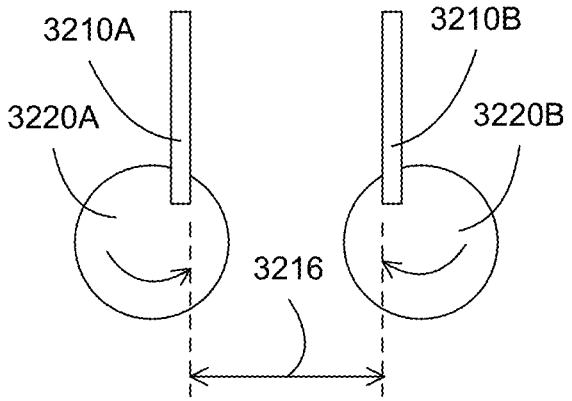
FIGS. 32A-32D illustrate configurations for guiding mechanisms according to some embodiments.

FIGS. 32A-32D illustrate configurations for guiding mechanisms according to some embodiments. In FIG. 32A, a clamping device can have two jaws 3210A and 3210B disposed facing each other, with a space 3216 between the jaws. Rollers 3220A and 3220B can be coupled to the jaws for guiding an object to the space between the jaws. The rollers can be configured so that a space between the rollers is smaller than the space between the jaws.

Figure 32B:
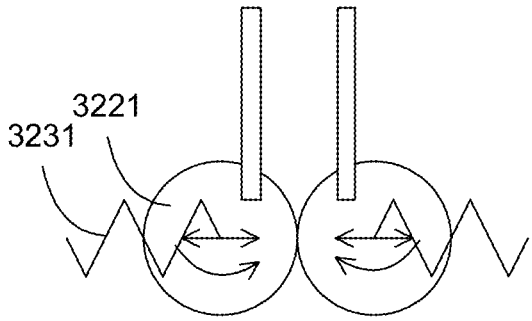

In FIG. 32B, a clamping device can have rollers 3221 coupled to the jaws for guiding an object to the space between the jaws. Spring mechanism 3231 can be coupled to the rollers to linearly move the rollers together. The rollers can be configured to touch each other, and can be separated by pushing on the rollers.

Figure 32C:
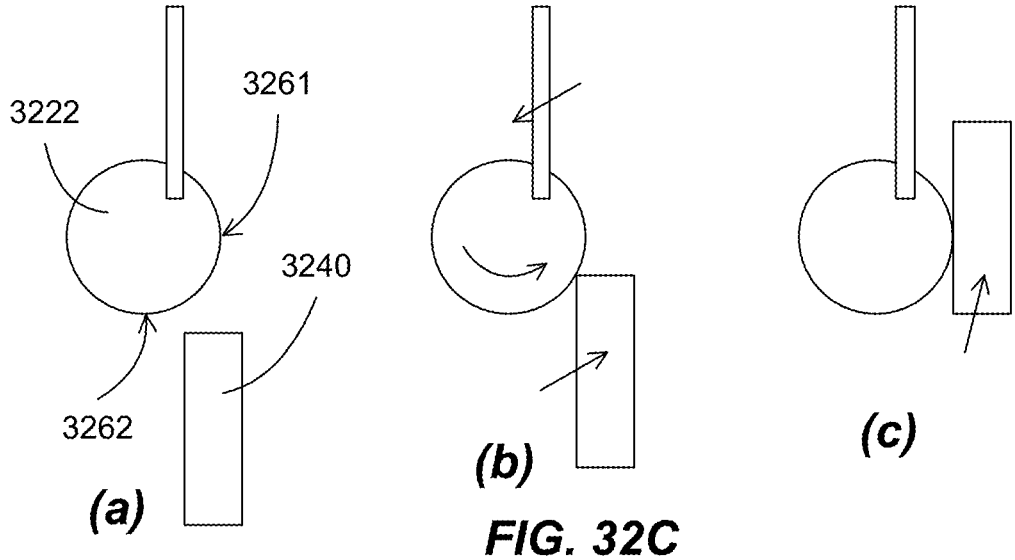

FIGS. 32C(a)-32C(c) show a process for bringing an object to the space between the jaws. An object can be disposed offsetting from the jaw opening. The object 3240 can be positioned between a bottom location 3262 and an edge 3261 of a roller 3222. When the clamping device is lowered on the object, the roller can roll to bring the object to nearer the edge 3261, leading to the jaw opening.

Figure 32D:
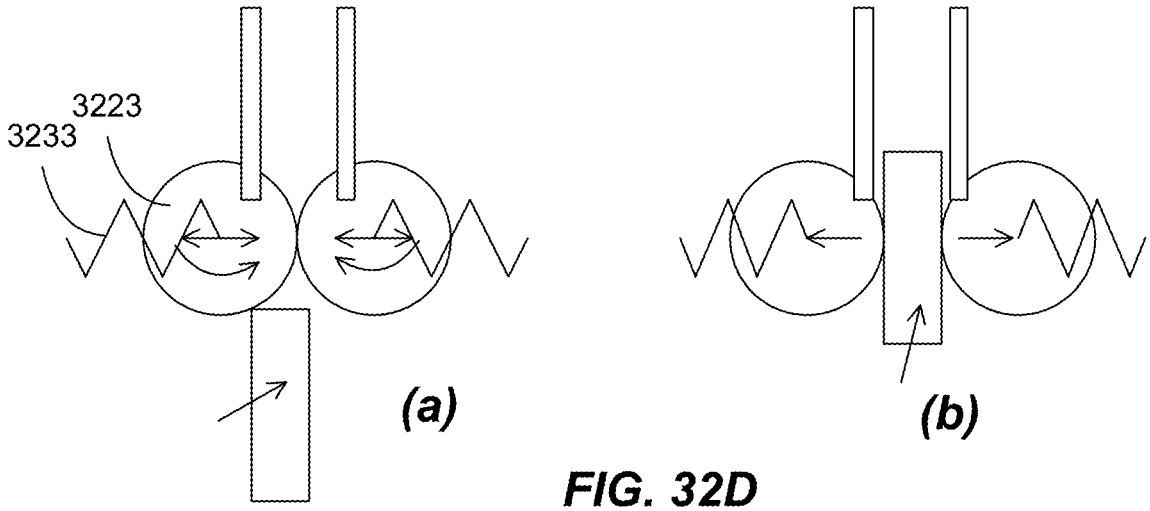

FIGS. 32D(a)-32D(b) show a process for bringing an object to the space between the jaws. An object can be disposed offsetting from the jaw opening. The clamping device can be lowered so that the rollers 3223 can contact the object. When the clamping device is further lowered, the object can push on the rollers to compress the spring mechanism 3233, with the rollers guiding the object to be between the rollers, and align with the space between the jaws.

Figure 33A:
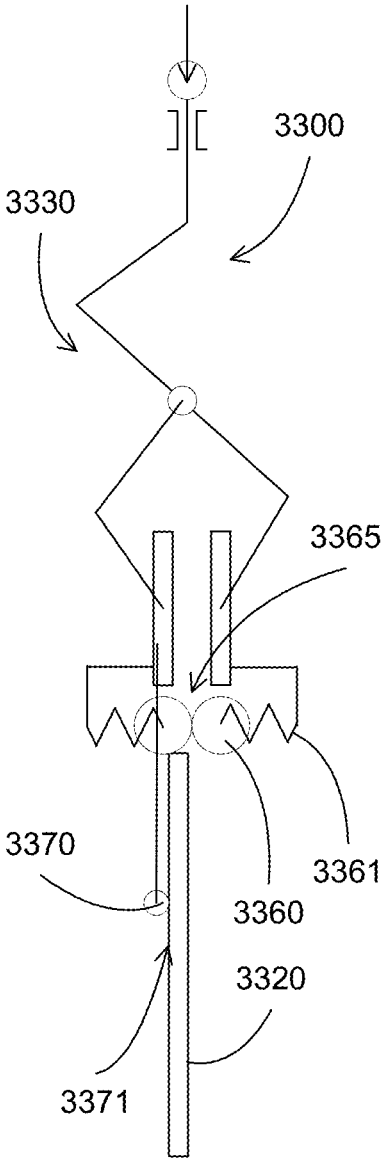
FIGS. 33A-33C illustrate a process for guiding an object according to some embodiments.
Figure 33B:
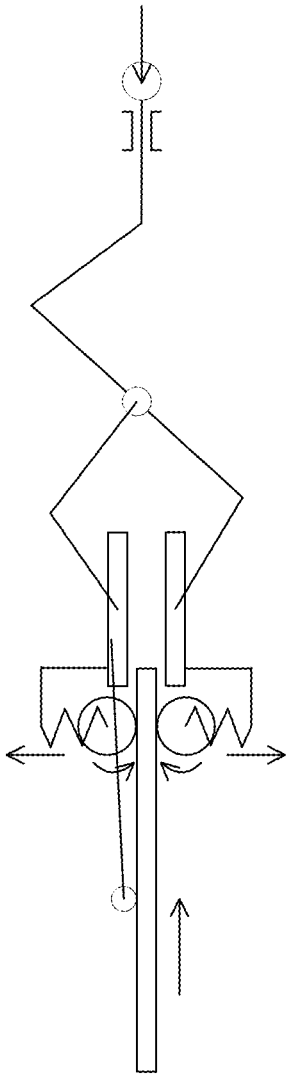
Figure 33C:
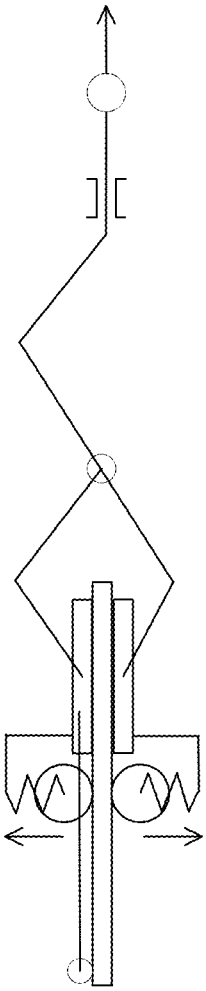

FIGS. 33A-33C illustrate a process for guiding an object according to some embodiments. A clamping device 3300 can include a clamping mechanism 3330 for activating opposite jaws. At the entrance of the jaws is a guiding mechanism in the form of two opposite rollers 3360 touching each other 3365, for example, due to springs 3361 pushing on the rollers.

An object can relatively approach the clamping device, e.g., either the object is moved toward the clamping device or the clamping device is moved toward the object. The object can be positioned at the entrance to the jaw opening. It is desirable that the object is positioned within the opening, so when the clamping device is lowered, the object can be between the jaws. However, sometimes the object is off, e.g., not exactly within the space between the two jaws. The misplacement of the object can cause the object to hit the jaws, instead of getting into the space between the jaws.

The rollers 3360 can guide the misplaced object to return to the space between the jaws. For example, when the object hits the rollers, the rollers can roll, which can bring the object toward the center of the space between jaws, e.g., to the contact point of the rollers. At the contact point of the rollers, the rollers then can bring the object toward the space between the jaws.

A contact mechanism 3370 can be used to detect the object when the clamping device is moved toward the object. The contact mechanism can be particular useful when the object is transparent, such as glass plates.

In some embodiments, the clamping device can include a contact mechanism to visually detecting the object, for example, when the clamping device moves toward the object for clamping. The contact mechanism can be particular useful for transparent objects, such as glass plates, which can be difficult for the operator to see the edge of the plates. The clamping device can include roller feet for rolling the clamping device, for example, for moving between places on the ground.

Figure 34A:
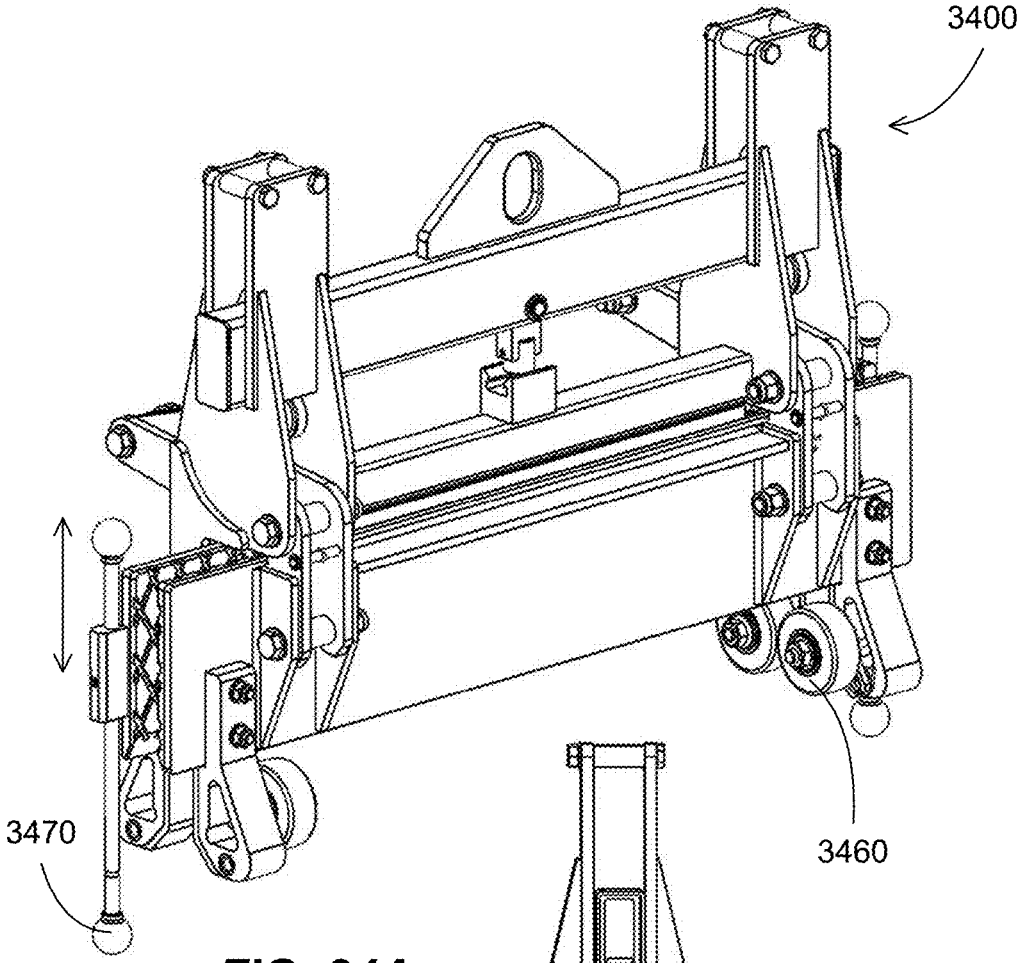
FIG. 34A-34B illustrates a clamping device according to some embodiments.
Figure 34B:
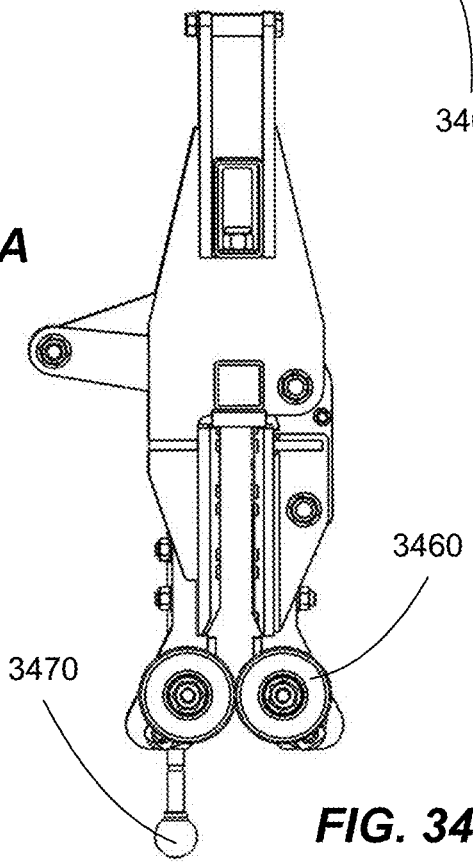

FIG. 34A-34B illustrate a clamping device according to some embodiments. The clamping device 3400 (FIG. 34A) can include multiple clamping mechanisms, such as the clamping mechanism that moves only one jaw while keeping the opposite jaw translational stationary. A connecting bar can be connected to ends of the multiple clamping mechanisms, for example, to actuating the clamping mechanisms together. The clamping mechanism can include a guide to guide the connecting bar into proper movements for actuating the clamping mechanisms. The clamping device can include a locking mechanism 3450 for hand-free actuating the clamping mechanisms, e.g., for engaging or disengaging the clamping mechanisms. The clamping device can include a guiding mechanism 3460 and limiter element 3470 for guiding objects toward the space between the translational stationary jaw and the movable jaw (FIG. 34B).

In some embodiments, the present invention discloses a clamping device having a guiding mechanism, which can be configured to guide an object into the space between the jaws. The guiding mechanism can function to enlarge the opening of the jaws of the clamping device for ease of accepting object. The guiding mechanism can function to stop an object so that the object is aligned with the space of the jaws. The guiding mechanism can enlarge the opening and also align the object with the space between the jaws by stopping the object before the object passes the edge of a jaw.

In some embodiments, the guiding mechanism can include one or more guiding plates, disposed at or near an entrance of the jaw opening. The guiding plates can be configured to guide an object along a surface of the guiding plates. For example, the plates can include a straight surface or a curve surface. The surfaces of the plates can be smooth with no kinks or sudden changes of direction, so that an object can easily travel along the surface. The plates can be configured to enlarge the jaw opening, to allow ease of entrance of the object to the space between the jaws. For example, the plates can have a shape of a funnel, e.g., having a larger entrance than an exit. The exit of the funnel can be provided to the jaw opening, so that when an object is disposed at the entrance of the plates, the object can be guided into the jaw opening.

In some embodiments, the guiding plates can be symmetrical, e.g., the guiding plate for a jaw is similar in shape and size to the guiding plate for the opposite jaw. The guiding plates can be asymmetrical, such as a guiding plate can be longer, with the long end served as a stopper for the object. Thus, the guiding plates can function to enlarge the jaw opening, together with aligning the object to the entrance of the plates. There can be one guiding plate coupled to a jaw, such as a fixed jaw, of the clamping device. The guiding plate can provide a path to guide the object to the jaw opening. The guiding plate can have a longer end, extending farther away from the jaw opening, to function as a limiter to limit the object to the path provided by the plate.

In some embodiments, there can be guiding plates together with a limiter element. The limiter element can stop the object at the entrance to the guiding plates, and the guiding plates can guide the object into the jaw opening.

In some embodiments, the guiding plates can be coupled to a spring mechanism to push the guiding plates together. When an object contacts the guiding plates, the object can push the guiding plates against the spring mechanism to enter the jaw opening. The closeness of the guiding plates can provide support to the object, e.g., an object can contact the guiding plates at both sides, thus the object can be guided by the guiding plates while the guiding plates provide support to prevent the object from falling to one side.

In some embodiments, the guiding mechanism can include one or more rollers, disposed at or near an entrance of the jaw opening. The rollers can be configured to guide an object along a surface of the guiding plates, together with enlarging the jaw opening. The rollers can be coupled to the jaws of the clamping device. One or two rollers can be used. The rollers can be coupled to one or more spring mechanisms to push the rollers together. The spring mechanisms can be linear spring mechanisms, moving the rollers in straight lines toward each other. The spring mechanisms can be rotational spring mechanisms, rotating the rollers toward each other.

The guiding mechanism can include a limiter element, such as a bar, or a bar with a ball at an end of the bar. The limiter element can stop the object at the entrance to the guiding plates, and the guiding plates can guide the object into the jaw opening. The limiter can be configured to extend for functioning as a limiter, or retract for during a process of moving the clamping device on the ground.

Figure 35A:
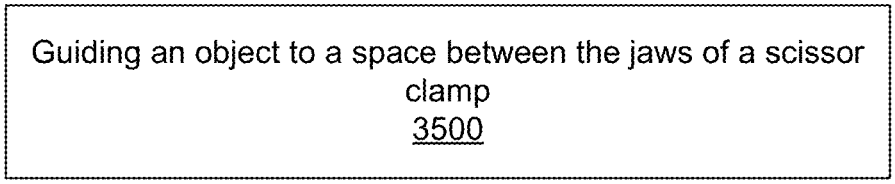
FIGS. 35A-35B illustrate flow charts for guiding objects according to some embodiments.
Figure 35B:
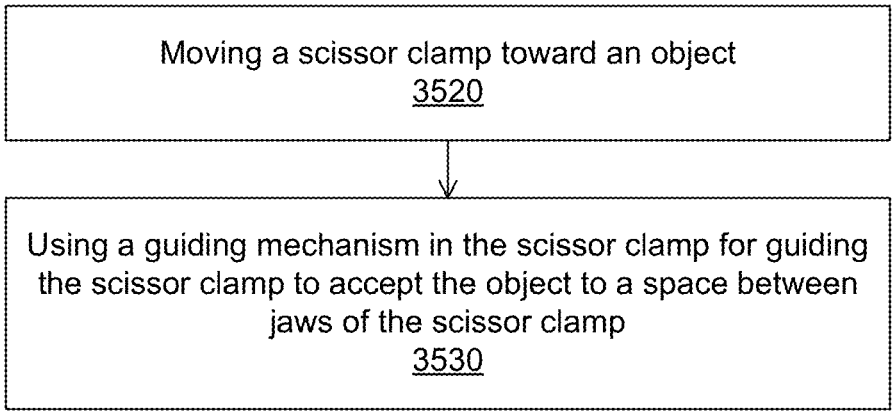

FIGS. 35A-35B illustrate flow charts for guiding objects according to some embodiments. In FIG. 35A, operation 3500 guides an object to a space between the jaws of a clamping device.

In FIG. 35B, operation 3520 moves a clamping device toward an object. Operation 3530 uses a guiding mechanism in the clamping device for guiding the clamping device to accept the object to a space between jaws of the clamping device.

Figure 36:
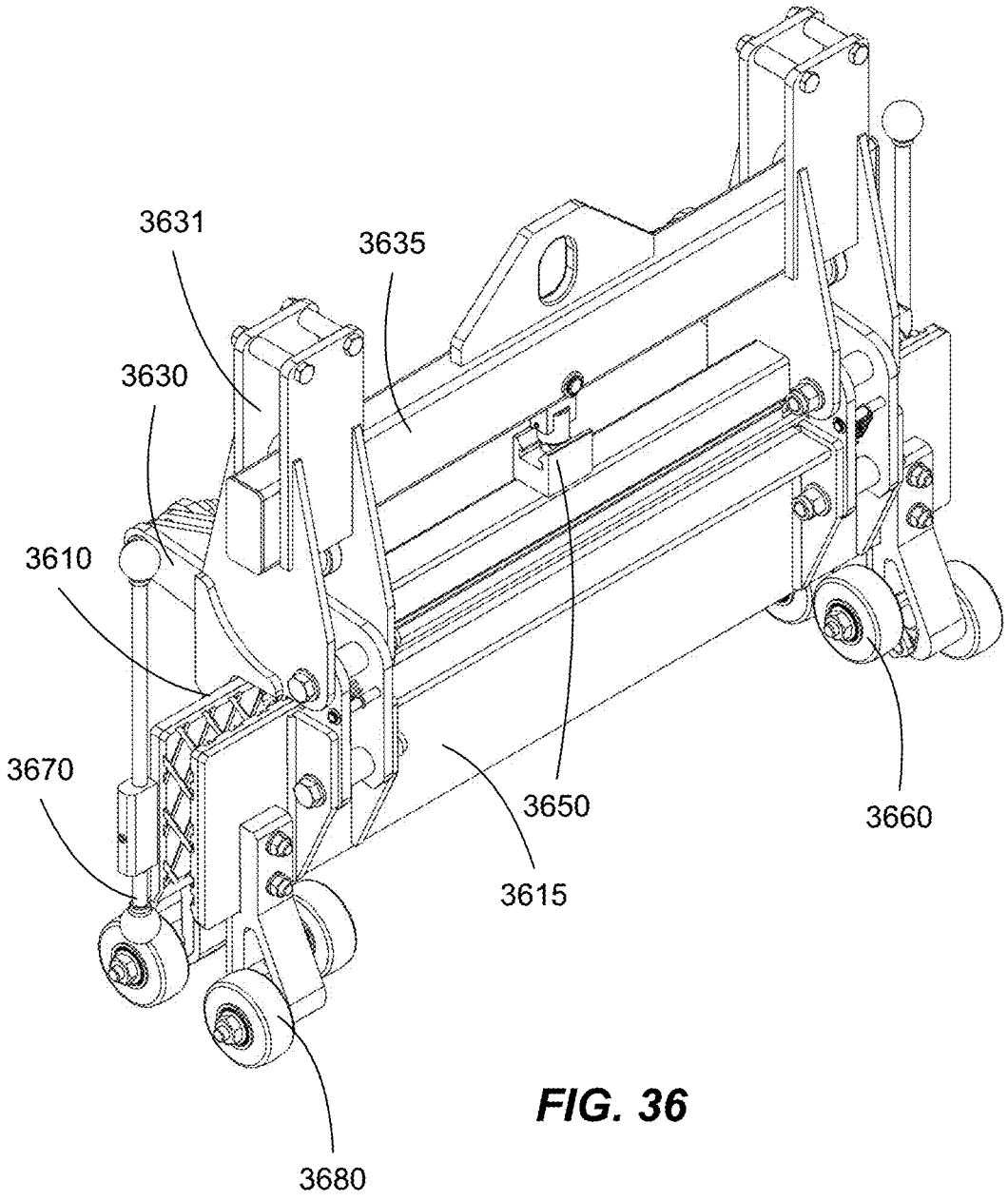
FIG. 36 illustrates a clamping device according to some embodiments.

FIG. 36 illustrates a clamping device according to some embodiments. The clamping device can include multiple clamping mechanisms 3630, such as the clamping mechanism that moves only one jaw 3615 while keeping the opposite jaw 3610 translational stationary. A connecting bar 3635 can be connected to ends of the multiple clamping mechanisms, for example, to actuating the clamping mechanisms together. The clamping mechanism 3630 can include a guide 3631 to guide the connecting bar 3635 into proper movements for actuating the clamping mechanisms.

The clamping device can include elongated jaw 3610 and 3615, which can be coupled to multiple clamping mechanisms at a same side.

A locking mechanism 3650 can be included, for hand-free actuating the clamping mechanisms, e.g., for engaging or disengaging the clamping mechanisms.

A guiding mechanism 3660 can be included, for guiding objects toward the space between the translational stationary jaw and the movable jaw. The guiding mechanism can include limiter element 3670 for stopping an object at locations that can be guided by the guiding mechanism. The limiter element 3670 can double as a contact mechanism for detecting hard-to-see object. The contact mechanism can be particular useful for transparent objects, such as glass plates, which can be difficult for the operator to see the edge of the plates.

Other options can be included, such as roller feet 3680 for rolling the clamping device on the ground. The limiter element 3670 can move vertically, for example, to allow the clamping device to roll on the ground using roller feet.

What is claimed is:

1. A clamping device comprising
a body,
wherein the body is coupled to one or more first jaws,
multiple arm assemblies,
wherein each arm assembly comprises a first end and a second end,
wherein the multiple first ends of the multiple arm assemblies are coupled to a coupler at separate locations,
wherein the multiple second ends of the multiple arm assemblies are rotatably coupled to one or more second jaws facing the one or more first jaws,
wherein the multiple second ends are coupled to the one or more second jaws at separate locations,
wherein the one or more second jaws are configured to be rotatable with respect to the multiple arm assemblies when the multiple arm assemblies are stationary,
wherein each arm assembly is rotatably coupled to the body at a pivot joint so that when the arm assemblies rotate relative to the body around the pivot joint, the one or more second jaws move toward or away from the one or more first jaws,
wherein the coupler is movably coupled to the body so that when the coupler moves with respect to the body, the arm assemblies rotate relative to the body.

2. A clamping device as in claim 1
wherein the second ends of the arm assemblies are coupled to an elongated second jaw,
wherein the elongated second jaw comprises a flat surface for clamping.

3. A clamping device as in claim 1
wherein the second ends of the arm assemblies are coupled to an elongated second jaw having a first dimension longer than a second dimension,
wherein the multiple second ends are coupled to the one or more second jaws at separate locations in the first direction.

4. A clamping device as in claim 1
wherein the body comprises multiple linear guides,
wherein the coupler is coupled to the multiple linear guides to move linearly with respect to the body.

5. A clamping device as in claim 1 further comprising
a mechanical toggling mechanism,
wherein the toggling mechanism comprises a slanting interface between a first element and a second element, wherein the slanting interface is configured to convert repeated linear movements of the first element to repeated rotational movements in a same direction of the first element,
wherein the rotational movements in the same direction is configured to toggle between a first status in which the first element is not separable from a third element and a second status in which the first element is separable from the third element.

6. A clamping device as in claim 1 further comprising
a mechanical toggling mechanism,
wherein the toggling mechanism is configured to switch to a first status in which the jaws are fixedly separated after the clamping device delivers an object,
wherein the toggling mechanism is configured to switch to a second status in which the jaws are movable to clamp on the object when the clamping device approaches the object and places the object between the jaws,
wherein the toggling comprises a rotation in one direction of a locking element coupled to the body, to the coupler, or to the at least one of the arm assemblies,
wherein the toggling mechanism comprises a conversion of a linear movement of the coupler to a rotational movement in one direction of the locking element,
wherein the rotation movement in one direction is configured to toggle between a first status in which the locking element is engaged and a second status in which the locking element is disengaged.

7. A clamping device as in claim 1 further comprising
a mechanical toggling mechanism,
wherein the toggling mechanism comprises a first element rotatably coupled to at least one of the arm assemblies or to the coupler and a second element fixedly coupled to the body,
wherein the first element is configured to repeatedly rotate in one direction to toggle between a locked position and a separable position with the second element.

8. A clamping device as in claim 1 further comprising
a mechanical toggling mechanism coupling the body with at least one of the arm assemblies or with the coupler, wherein the toggling mechanism comprises a slanting interface between a first element and a second element, wherein the slanting interface is configured to convert repeated linear movements of the first element to repeated rotational movements in a same direction of the first element, wherein the rotational movements in the same direction is configured to toggle between a first status in which the first element is not separable from a third element and a second status in which the first element is separable from the third element, wherein either the second element is coupled to the body and the third element is coupled to the at least one of the arm assemblies or to the coupler, or the third element is coupled to the body and the second element is coupled to the at least one of the arm assemblies or to the coupler.

9. A clamping device as in claim 1 further comprising a mechanical toggling mechanism coupling two components on two separate portions of at least one of the arm assemblies, wherein one component of the two components is rotatably coupled to one portion of the two separate portions, wherein the other component of the two components is fixedly coupled to the other portion of the two separate portions, wherein the toggling mechanism is configured to automatically switch between a first status in which the two components are not separable and a second status in which the two components are separable, wherein the automatic switching comprises a conversion of linear movements of the coupler to rotational movements in one direction of the one component.

10. A clamping device as in claim 1 further comprising a mechanical toggling mechanism, wherein the toggling mechanism couples a first component of at least one of the arm assemblies with a second component, wherein the second component is another component of the at least one of the arm assemblies or a component of the body, wherein the coupling of the first component with the second component is configured so that when the first component moves, relatively, toward the second component, followed by a retraction, relatively, of the first component away from the second component, the toggling mechanism toggles between a locked status and an unlocked status, wherein in the locked status, the first component is fixed coupled to the second component, wherein in the unlocked status, the first component is movable relative to the second component, wherein the toggling mechanism comprises a rotation in one direction of the first or the second component.

11. A clamping device as in claim 1 further comprising a first element coupled to the body or to the coupler, wherein the first element comprises a hook, a second element, wherein the second element is coupled to the coupler if the first element is coupled to the body, wherein the second element is coupled to the body if the first element is coupled to the coupler, wherein the second element comprises two slanting surfaces facing each other or facing away from each other, a third element, wherein the third element is movably coupled to the second element, wherein the third element comprises one or two pins which are configured to be mated with the slanting surfaces, wherein the pins and the two slanting surfaces are configured so that when the third element is moved so that one pin of the pins contacts a slanting surface of the two slanting surfaces, the third element rotates an angle, wherein the third element comprises an elongated end configured to toggle between securing to the hook and being separable from the hook by rotating the third element.

12. A clamping device as in claim 1 further comprising a guiding mechanism configured to guide an object disposed in a vicinity of the jaws toward a space between the jaws.

13. A clamping device as in claim 1 further comprising a guiding mechanism, wherein the guiding mechanism comprises a first roller coupled to the first jaws, and a second roller coupled to the second jaws, wherein the guiding mechanism comprises a spring mechanism coupled to the second roller for pushing the second roller toward the first roller.

14. A clamping device as in claim 1 further comprising a guiding mechanism, wherein the guiding mechanism comprises a stopper coupled to the first jaws to limiting movements of the object so that the object is disposed in a vicinity of the first jaws.

15. A clamping device as in claim 1 further comprising a guiding mechanism, wherein the guiding mechanism comprises two facing rotatable rollers configured to bring an object disposed in a vicinity of the rollers to a space between the first and second jaws, wherein the guiding mechanism comprises a stopper to limiting movements of the object so that the object is disposed in the vicinity of the rollers.

16. A clamping device comprising a first jaw coupled to a body, a second jaw facing the first jaw, a clamping mechanism coupled to the second jaw, wherein the clamping mechanism comprises multiple components rotatable around a pivot joint on the body, wherein a first component of the multiple components is rotatably coupled to a second component of the multiple components, wherein the clamping mechanism is configured to convert a movement comprising a vertical component of the first component to a relative movement comprising a horizontal component of the second jaw toward or away from the second first jaw, a toggling mechanism coupled to the first and second components, wherein the toggling mechanism is configured to automatically switch to a first status in which the jaws are fixedly separated after the clamping device delivers an object, wherein the toggling mechanism is configured to automatically switch to a second status in which jaws are movable to clamp on the object after the clamping device approaches the object and places the object between the jaws, wherein the automatic switch comprises a conversion of repeated linear movements of lowering and lifting the clamping device to repeated rotational movements in one direction of an element of a locking mechanism to toggle between the first status and the second status.

17. A clamping device as in claim 16 wherein the locking mechanism comprises a first element, wherein the first element is coupled to the first component, wherein the first element comprises two slanting surfaces facing each other or facing away from each other, wherein the locking mechanism comprises a second element, wherein the second element is coupled to the second component, wherein the second element comprises a hook, wherein the locking mechanism comprises a third element, wherein the third element is movably coupled to the first element, wherein the third element comprises one or two pins which are configured to be mated with the slanting surfaces, wherein the pins and the two slanting surfaces are configured so that when the third element is moved so that one pin of the pins contacts a slanting surface of the two slanting surfaces, the third element rotates an angle, wherein the third element comprises an elongated end configured to toggle, by rotating the third element, between the first status in which the pins are locked to the hook and the second status in which the pins are separable from the hook.

18. A clamping device as in claim 16 further comprising a guiding mechanism coupled to the clamping mechanism, wherein the guiding mechanism is configured to guide an object disposed in a vicinity of the jaws toward a space between the jaws.

19. A clamping device comprising a first jaw coupled to a body, a second jaw facing the first jaw, a clamping mechanism coupled to the second jaw, wherein the clamping mechanism comprises an arm assembly rotatable around a pivot joint on the body, wherein a portion of the arm assembly at one side of the pivot joint comprises multiple components, wherein the multiple components are rotatably coupled together, wherein the clamping mechanism is configured to convert a movement comprising a vertical component of a component of the multiple components to a movement comprising a horizontal component of the second jaw toward or away from the first jaw, a guiding mechanism coupled to the clamping mechanism, wherein the guiding mechanism is configured to guide an object disposed in a vicinity of the jaws toward a space between the jaws.

20. A clamping device as in claim 19 wherein the guiding mechanism comprises a first roller coupled to the first jaws, and a second roller coupled to the second jaws, wherein the guiding mechanism comprises a spring mechanism coupled to the second roller for pushing the second roller toward the first roller wherein the first and second rollers are configured to bring the object disposed in a vicinity of the jaws toward the space between the first and second jaws, wherein the guiding mechanism comprises a stopper to limiting movements of the object so that the object is disposed in the vicinity of the rollers.

* * * * *